US010618289B2

(12) United States Patent
Nakashima et al.

(10) Patent No.: US 10,618,289 B2
(45) Date of Patent: Apr. 14, 2020

(54) LIQUID EJECTING APPARATUS AND CAP

(71) Applicant: SEIKO EPSON CORPORATION, Tokyo (JP)

(72) Inventors: Hiromichi Nakashima, Matsumoto (JP); Yuichi Urabe, Shiojiri (JP); Kentaro Murakami, Matsumoto (JP); Shuji Funada, Shiojiri (JP); Hisashi Sato, Shiojiri (JP); Akihiro Furuya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/211,046

(22) Filed: Dec. 5, 2018

(65) Prior Publication Data

US 2019/0176472 A1 Jun. 13, 2019

(30) Foreign Application Priority Data

Dec. 7, 2017 (JP) ..... 2017-234898

(51) Int. Cl.
*B41J 2/165* (2006.01)

(52) U.S. Cl.
CPC ..... *B41J 2/16505* (2013.01); *B41J 2/16508* (2013.01); *B41J 2/16511* (2013.01); *B41J 2/16523* (2013.01); *B41J 2/16535* (2013.01); *B41J 2/16538* (2013.01); *B41J 2/16544* (2013.01)

(58) Field of Classification Search
CPC ..... B41J 2/16505; B41J 2/16535; B41J 2/16544; B41J 2/16538; B41J 2/16523; B41J 2/16511; B41J 2/16508
See application file for complete search history.

(56) References Cited

U.S. PATENT DOCUMENTS

2002/0008728 A1 1/2002 Usui et al.
2002/0060713 A1 5/2002 Katakura et al.
2002/0075348 A1 6/2002 Shindo et al.
2006/0203032 A1 9/2006 Takagi
(Continued)

FOREIGN PATENT DOCUMENTS

JP H10-264402 A 10/1998
JP 2002-086746 A 3/2002
(Continued)

OTHER PUBLICATIONS

IP.com search (Year: 2019).*

*Primary Examiner* — Lisa Solomon
(74) *Attorney, Agent, or Firm* — Workman Nydegger

(57) ABSTRACT

A liquid ejecting apparatus includes a liquid ejecting head provided with a nozzle and a cap that executes capping for forming a first space to which the nozzle is open, in a surrounding manner. The cap includes a capping member that is provided with a suction hole and an atmosphere communicating hole which is configured to allow an inside of the cap to communicate with an outside, a liquid absorber that is disposed inside the capping member, and a reception member that is disposed inside the capping member so as to form a second space between the liquid absorber and the reception member. The second space is positioned closer to a side of the liquid ejecting head than to the liquid absorber in a posture of capping, and the atmosphere communicating hole is open to the second space.

9 Claims, 21 Drawing Sheets

(56) References Cited

U.S. PATENT DOCUMENTS

| | | | | |
|---|---|---|---|---|
| 2007/0097170 | A1 | 5/2007 | Sekiya et al. | |
| 2007/0171254 | A1 | 7/2007 | Matsuoka et al. | |
| 2008/0136865 | A1 | 6/2008 | Sakurai | |
| 2008/0192083 | A1 * | 8/2008 | Nishida | B41J 2/16508 347/30 |
| 2015/0258795 | A1 | 9/2015 | Kobashi et al. | |

FOREIGN PATENT DOCUMENTS

| | | | |
|---|---|---|---|
| JP | 2002-086757 | A | 3/2002 |
| JP | 2002-240325 | A | 8/2002 |
| JP | 2002-361908 | A | 12/2002 |
| JP | 2004-195801 | A | 7/2004 |
| JP | 2005-169913 | A | 6/2005 |
| JP | 2006-240193 | A | 9/2006 |
| JP | 2007-118508 | A | 5/2007 |
| JP | 2007-196482 | A | 8/2007 |
| JP | 2008-110520 | A | 5/2008 |
| JP | 2008-143030 | A | 6/2008 |
| JP | 2010-076379 | A | 4/2010 |
| JP | 2010-120294 | A | 6/2010 |
| JP | 2015-174364 | A | 10/2015 |
| JP | 2016-221783 | A | 12/2016 |

* cited by examiner

LIQUID EJECTING APPARATUS AND CAP

BACKGROUND

1. Technical Field

The present invention relates to a liquid ejecting apparatus such as an ink jet printer and a cap.

2. Related Art

JP-A-2008-110520 discloses a liquid ejecting apparatus that includes a cap which is configured to be capable of capping a liquid ejecting head provided with a nozzle and inside which an absorption body that is capable of absorbing a liquid is disposed. The cap includes a suction port that is capable of performing suction inside the cap and an atmosphere-open tube for opening an inside of the cap to the atmosphere. The liquid ejecting apparatus performs suction inside the cap from the suction port in a state of capping the liquid ejecting head, thereby executing suction cleaning of discharging a liquid from the nozzle.

In the liquid ejecting apparatus disclosed in JP-A-2008-110520, after the suction cleaning is executed, the inside of the cap may be opened to the atmosphere through the atmosphere-open tube. In this case, when a gas flows swiftly inside the cap through the atmosphere-open tube, the gas flows to the nozzle in some cases. When the gas flows to the nozzle, the nozzle that ejects a liquid may have an ejection trouble.

SUMMARY

Hereinafter, means of the invention will be described.

According to an aspect of the invention, there is provided a liquid ejecting apparatus including: a liquid ejecting head provided with a nozzle that is capable of ejecting a liquid; and a cap that is configured to execute capping for forming a first space to which the nozzle is open, in a surrounding manner, when coming into contact with the liquid ejecting head. The cap includes a capping member that is provided with a suction hole which is configured to suction a fluid inside the cap and an atmosphere communicating hole which is configured to allow an inside of the cap to communicate with an outside, a liquid absorber that is configured to be disposed inside the capping member so as to come into contact with at least a part of an opening of the suction hole and to absorb the liquid, and a reception member that is disposed at an interval from the liquid absorber inside the capping member so as to form a second space between the liquid absorber and the reception member and is provided with a reception surface which receives the liquid that is discharged from the nozzle. The second space is positioned closer to a side of the liquid ejecting head than to the liquid absorber in a posture of capping, and the atmosphere communicating hole is opened to the second space.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. For example, the liquid ejecting apparatus is an ink jet printer that ejects ink, which is an example of a liquid, and prints an image such as a character or a picture on a medium such as paper. In the following description, the liquid ejecting apparatus is installed on a horizontal surface.

Figure 1:
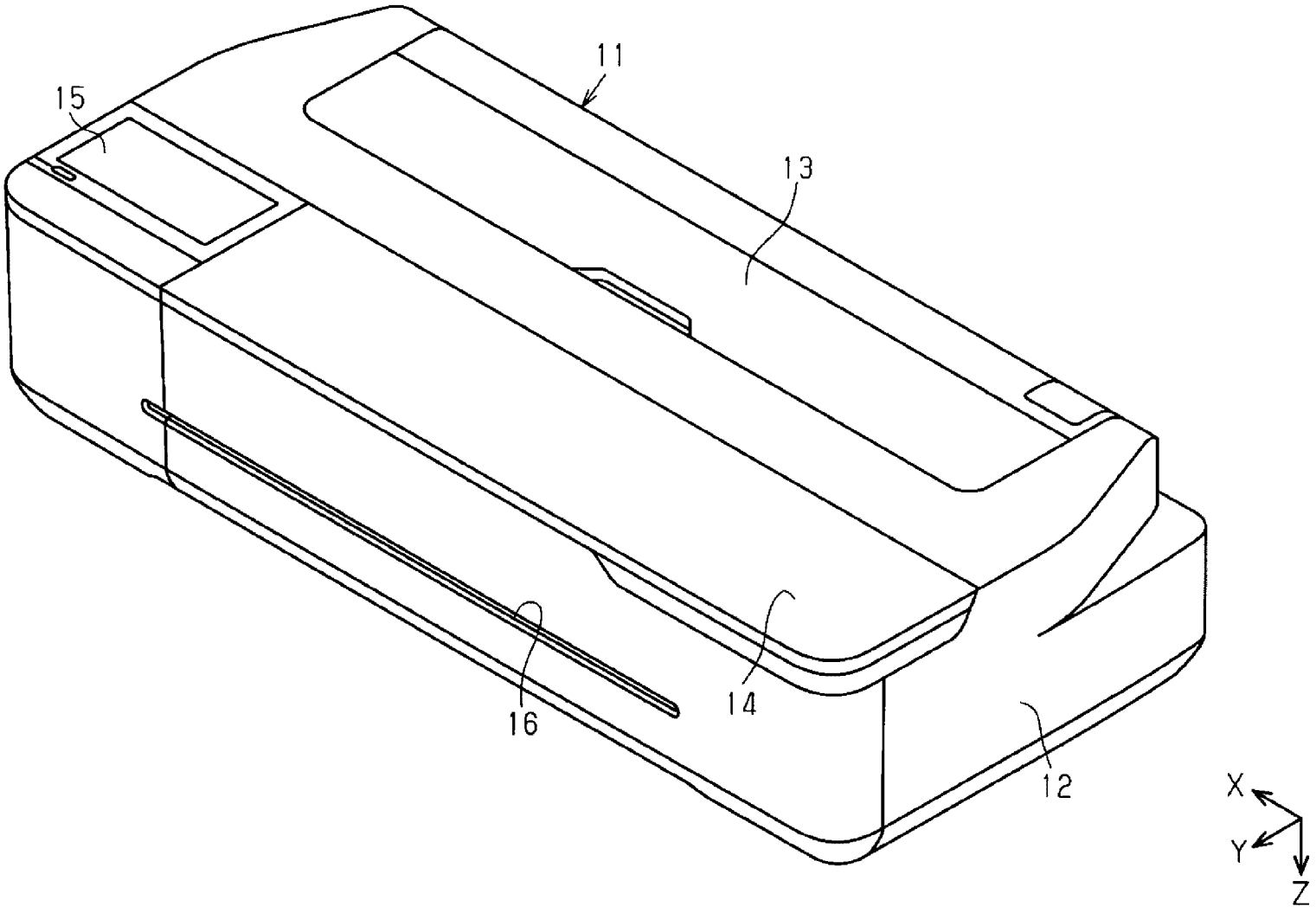
FIG. 1 is a perspective view illustrating an embodiment of a liquid ejecting apparatus.

As illustrated in FIG. 1, a liquid ejecting apparatus 11 includes a housing 12 having a rectangular parallelepiped shape. The housing 12 has an elongated shape in a width direction X. The housing 12 includes a first cover 13 and a second cover 14 on a top surface of the house. The first cover 13 and the second cover 14 are provided to be openable and closeable, and a closed state thereof is illustrated in FIG. 1. The first cover 13 is positioned close to a back surface of the liquid ejecting apparatus 11, and the second cover 14 is positioned close to a front surface of the liquid ejecting apparatus 11.

The housing 12 includes an operation panel 15 on the top surface thereof. The operation panel 15 is operated to give various types of instructions to the liquid ejecting apparatus 11. The operation panel 15 is disposed at a position adjacent to the second cover 14 in the width direction X. For example, the operation panel 15 is a touch panel and makes it possible to display and input various items of information.

The housing 12 is provided with a discharge port 16 on the front surface thereof. The discharge port 16 is an opening for discharging a medium M from an inside of the housing 12 to an outside of the housing 12. The discharge port 16 of the embodiment extends in a slit shape in the width direction X. The medium M moves in a direction from the back surface toward the front surface of the liquid ejecting apparatus 11 in the housing 12, thereby being discharged from the discharge port 16. Therefore, in the embodiment, the direction from the back surface toward the front surface of the liquid ejecting apparatus 11 is set as a transport direction Y in which the medium M is transported. The width direction X is a direction which is different from the transport direction Y and a vertical direction Z.

Figure 2:
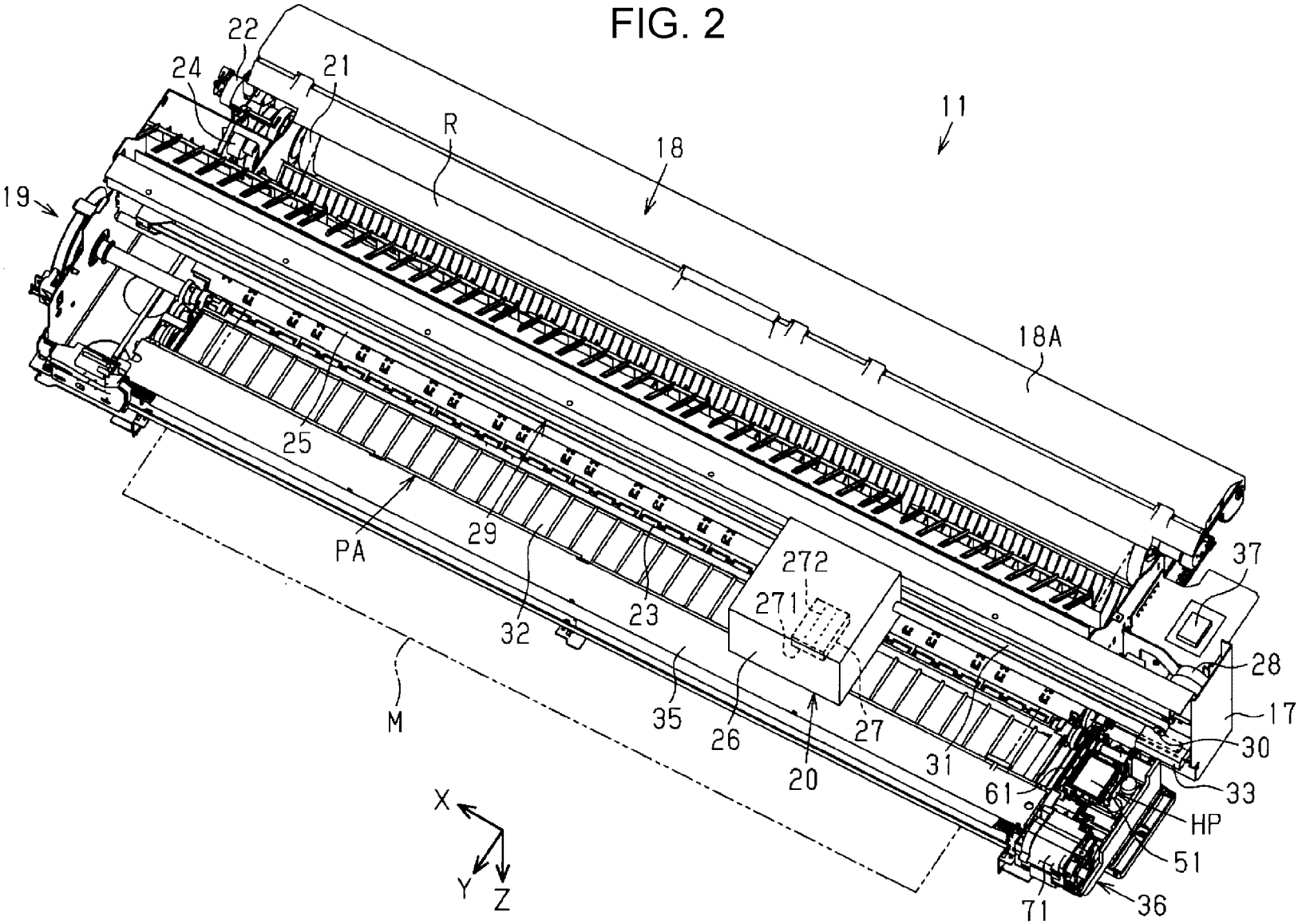
FIG. 2 is a perspective view illustrating an internal configuration of the liquid ejecting apparatus.

Next, an internal configuration of the liquid ejecting apparatus 11 is described with reference to FIG. 2. FIG. 2 illustrates a state in which the housing 12 of the liquid ejecting apparatus 11 is detached.

As illustrated in FIG. 2, the liquid ejecting apparatus 11 includes a frame 17 having a predetermined shape inside the liquid ejecting apparatus. The liquid ejecting apparatus 11 includes an unwinding unit 18 that unwinds the medium M, a transport unit 19 that transports the medium M which is unwound by the unwinding unit 18, and a liquid ejecting unit 20 that ejects a liquid to the medium M.

The unwinding unit 18 of the embodiment unwinds the medium M from a roll R around which an unused medium M is rolled in a cylindrical shape, for example. The unwinding unit 18 includes a rotation supporting mechanism 21 that rotatably supports the roll R and a transport motor 22 that is a drive source of the rotation supporting mechanism 21. The transport motor 22 is disposed at an end portion of the frame 17 in the width direction X. The transport motor 22 of the embodiment is disposed close to a left end of the frame 17 in FIG. 2.

The liquid ejecting apparatus 11 includes a guide cover 18A that covers the accommodated roll R from above. The guide cover 18A is provided to be openable and closeable, and a closed state thereof is illustrated in FIG. 2. The guide cover 18A is provided at a position corresponding to the first cover 13. Therefore, when the first cover 13 is opened, the unwinding unit 18 is exposed. When the guide cover 18A is opened from such a state, the roll R can be set or replaced. The unwinding unit 18 is not limited to a roll type in which the medium M is unwound from the roll R, and the unwinding unit may employ a cassette type in which the medium M, which is accommodated in a cassette that is attachable to and detachable from the housing 12, is unwound. The unwinding unit 18 may employ a tray type in which the medium M set in a tray that is provided in the housing 12 is unwound.

Drive of the transport motor 22 causes the unwinding unit 18 to rotate the roll R set on the rotation supporting mechanism 21 by the drive of the transport motor 22. When the roll R is rotated, the medium M is unwound. The medium M that is unwound from the roll R is unwound toward the liquid ejecting unit 20 that is positioned downstream of the unwinding unit 18 in the transport direction Y.

The transport unit 19 includes a rotatable transport roller pair 23. Rotation of the transport roller pair 23 with the medium M pinched therebetween causes the transport unit 19 to transport the medium M. The transport roller pair 23 of the embodiment is rotated by power transmitted from the transport motor 22 via a wheel train 24. In other words, the unwinding unit 18 and the transport unit 19 share the transport motor 22 as the drive source.

A region in which the medium M is transported by the transport unit 19 in the width direction X is referred to as a transport region. The medium M is transported within the transport region, regardless of a width of the medium. The transport unit 19 is not limited to a roller type transport mechanism that performs transport using a roller and may be a belt type transport mechanism that performs transport using a belt.

The liquid ejecting unit 20 includes a guide shaft 25 extending in the width direction X, a carriage 26 that is supported by the guide shaft 25, and a liquid ejecting head 27 that is capable of ejecting a liquid. The carriage 26 is movable along the guide shaft 25. The liquid ejecting head 27 is mounted on the carriage 26. The liquid ejecting head 27 is attached to a position of the carriage 26, which is opposite to a transport route of the medium M, for example a lower portion of the carriage 26.

The liquid ejecting head 27 is provided with a nozzle-formed surface 271 on a surface that is opposite to the transport route of the medium M, for example on an undersurface of the liquid ejecting head. The nozzle-formed surface 271 is provided with a plurality of nozzles 272 that is capable of ejecting the liquid. The liquid ejecting head 27 is provided with the nozzles 272 that is capable of ejecting the liquid. The liquid ejecting head 27 of the embodiment is a piezoelectric type, that is, a piezo type, of ink jet head in which an actuator such as a piezoelectric element is provided for each nozzle 272. The liquid ejecting head 27 is not limited to the piezoelectric type and may employ a thermal type or an electrostatic type.

The liquid ejecting unit 20 includes a carriage motor 28, which is a drive source that causes the carriage 26 to perform reciprocate in the width direction X, and a moving mechanism 29 that connects the carriage motor 28 and the carriage 26. The carriage motor 28 is disposed at an end portion on an opposite side to the transport motor 22 in the width direction X. The carriage motor 28 of the embodiment is disposed close to a right end of the frame 17 in FIG. 2. The moving mechanism 29 is configured to be capable of transmitting power of the carriage motor 28 to the carriage 26. The moving mechanism 29 of the embodiment includes a pair of pulleys 30 and an endless timing belt 31 wrapped around the pair of pulleys 30.

A pulley 30 on one side of the pair of pulleys 30 is connected to an output shaft of the carriage motor 28. When the output shaft of the carriage motor 28 rotates, the connected pulley 30 rotates. When the pulley 30 rotates, the wrapped timing belt 31 moves in a circle along the pair of pulleys 30. Consequently, the carriage 26 fixed to a part of the timing belt 31 reciprocates in the width direction X. The moving mechanism 29 is not limited to a belt type moving mechanism by the timing belt 31 and may employ a known linear motion mechanism such as a ball screw mechanism.

The liquid ejecting apparatus 11 includes a support base 32 that supports the transported medium M. The support base 32 extends to have an elongated shape in the width direction X and is provided in a plate shape. The support base 32 is disposed at a position opposite to a moving route of the liquid ejecting head 27 during printing, for example a position below the liquid ejecting head 27. The support base 32 sets a gap, that is, a so-called platen gap, between the liquid ejecting head 27 and the medium M supported by the support base 32. In the support base 32, a maximum region, in which the liquid ejecting head 27 is capable of performing printing in the width direction X, is referred to as a print region PA.

The liquid ejecting apparatus 11 includes a gap adjusting mechanism 33 that is capable of adjusting a gap between the liquid ejecting head 27 and the support base 32. The gap adjusting mechanism 33 of the embodiment is disposed at an end portion of the frame 17 on an outer side of the print region PA in the width direction X. Specifically, the gap adjusting mechanism 33 is disposed close to an end portion in the width direction X, in which the carriage motor 28 is positioned.

The gap adjusting mechanism 33 lifts or lowers the guide shaft 25 that supports the carriage 26, thereby, adjusting the gap between the liquid ejecting head 27 and the support base 32 depending on a type of medium. The gap adjusting mechanism 33 may change a height of the carriage 26 with respect to the guide shaft 25, thereby, adjusting the gap between the liquid ejecting head 27 and the support base 32 depending on a type of medium.

It is possible to employ a so-called on-carriage type or off-carriage type as a liquid supply type for supplying the liquid to the liquid ejecting head 27. For example, in the on-carriage type, a liquid container which is an ink cartridge is detachably installed on the carriage 26, and the liquid is supplied from the liquid container to the liquid ejecting head 27. In the off-carriage type, a liquid container is detachably installed on a cartridge holder attached to the frame 17, and the liquid is supplied from the liquid container to the liquid ejecting head 27 through a tube not illustrated.

The liquid ejecting apparatus 11 includes a cutting unit 35 that is capable of cutting the medium M. The cutting unit 35 is disposed downstream of the liquid ejecting unit 20 in the transport direction Y. The cutting unit 35 cuts the medium M having an elongated shape after the printing such that the medium has a designated length in the transport direction Y. The cutting unit 35 includes a movable blade that is movable in the width direction X and a fixed blade having an elongated shape with a length that is longer than a width of the medium M in the width direction X. The movable blade moves along the fixed blade, and thereby the cutting unit 35 cuts the medium M.

The liquid ejecting apparatus 11 is provided with a home position HP at which the liquid ejecting head 27 that does not perform the printing stays on standby. The home position HP is located adjacent to the print region PA in the width direction X. In the embodiment, the home position HP is located close to the end portion in the width direction X, in which the carriage motor 28 is positioned.

The liquid ejecting apparatus 11 includes a maintenance device 36 that is capable of executing maintenance for the liquid ejecting head 27. The maintenance device 36 executes the maintenance for the liquid ejecting head 27 that is positioned at the home position HP. In other words, the maintenance device 36 is disposed at a position opposite to the liquid ejecting head 27 when the liquid ejecting head is positioned at the home position HP. The maintenance device 36 executes maintenance of a liquid supply system including the liquid ejecting head 27, for example prevention of clogging and unclogging of the nozzles 272 of the liquid ejecting head 27.

The maintenance device 36 includes a cap 51, a wiper 61 as an example of a wiping member, and an electric motor 71 as an example of a drive source. The maintenance device 36 executes the maintenance for the liquid ejecting head 27, in a state in which the liquid ejecting head 27 is positioned at a maintenance position opposite to the cap 51. The maintenance position of the embodiment is coincident with the home position HP.

The maintenance device 36 lifts the cap 51, thereby, causing the cap 51 to come into contact with the liquid ejecting head 27 that is positioned at the maintenance position. In this case, the cap 51 comes into contact with the liquid ejecting head 27 so as to cover the nozzle-formed surface 271. In this manner, the cap 51 suppresses drying of a liquid in the nozzles 272, and thus the nozzles 272 are prevented from being clogged. In other words, the cap 51 caps the liquid ejecting head 27.

The maintenance device 36 performs suction in a space surrounded by the nozzle-formed surface 271 and the cap 51, and thereby a pressure in the space becomes a negative pressure. The space surrounded by the nozzle-formed surface 271 and the cap 51 is a space to which the nozzles 272 are open. Therefore, the pressure in the space, to which the nozzles 272 are open, becomes the negative pressure, and thereby the liquid is forcibly suctioned from the nozzles 272. In this case, a thickened liquid in the nozzles 272 is discharged. In this manner, the maintenance device 36 executes suction cleaning of the nozzles 272.

The maintenance device 36 wipes the nozzle-formed surface 271 by the wiper 61 at a predetermined time such as when the above-described cleaning is finished. The wiper 61 relatively moves with respect to the liquid ejecting head 27 in a wiping direction in a state of being in contact with the nozzle-formed surface 271, thereby, wiping the nozzle-formed surface 271. The maintenance device 36 of the embodiment wipes the nozzle-formed surface 271 by the wiper 61, with the carriage 26 moving in the width direction X in a state in which the wiper 61 is disposed at a wiping position to which the wiper 61 is lifted from a retreat position.

The liquid ejecting apparatus 11 includes a control unit 37 attached to an end portion of the frame 17. The control unit 37 of the embodiment is disposed close to the end portion in the width direction X, in which the carriage motor 28 and the maintenance device 36 are positioned. For example, the control unit 37 is configured of a chip including a central processing unit (CPU), an application specific IC (ASIC), a non-volatile memory, and the like installed on a board.

The control unit 37 controls drive of the transport motor 22, the carriage motor 28, the liquid ejecting head 27, the electric motor 71, and the like. Therefore, the control unit 37 controls the unwinding unit 18, the transport unit 19, the liquid ejecting unit 20, the gap adjusting mechanism 33, the cutting unit 35, the maintenance device 36, and the like. The liquid ejecting apparatus 11 repeats a printing operation, in which the liquid ejecting head 27 ejects the liquid from the nozzles 272 toward the medium M while the carriage 26 moves in the width direction X, and a transport operation in which the medium M is transported to the next print position, thereby, printing an image on the medium M.

Next, a configuration of the maintenance device 36 will be described.

Figure 3:
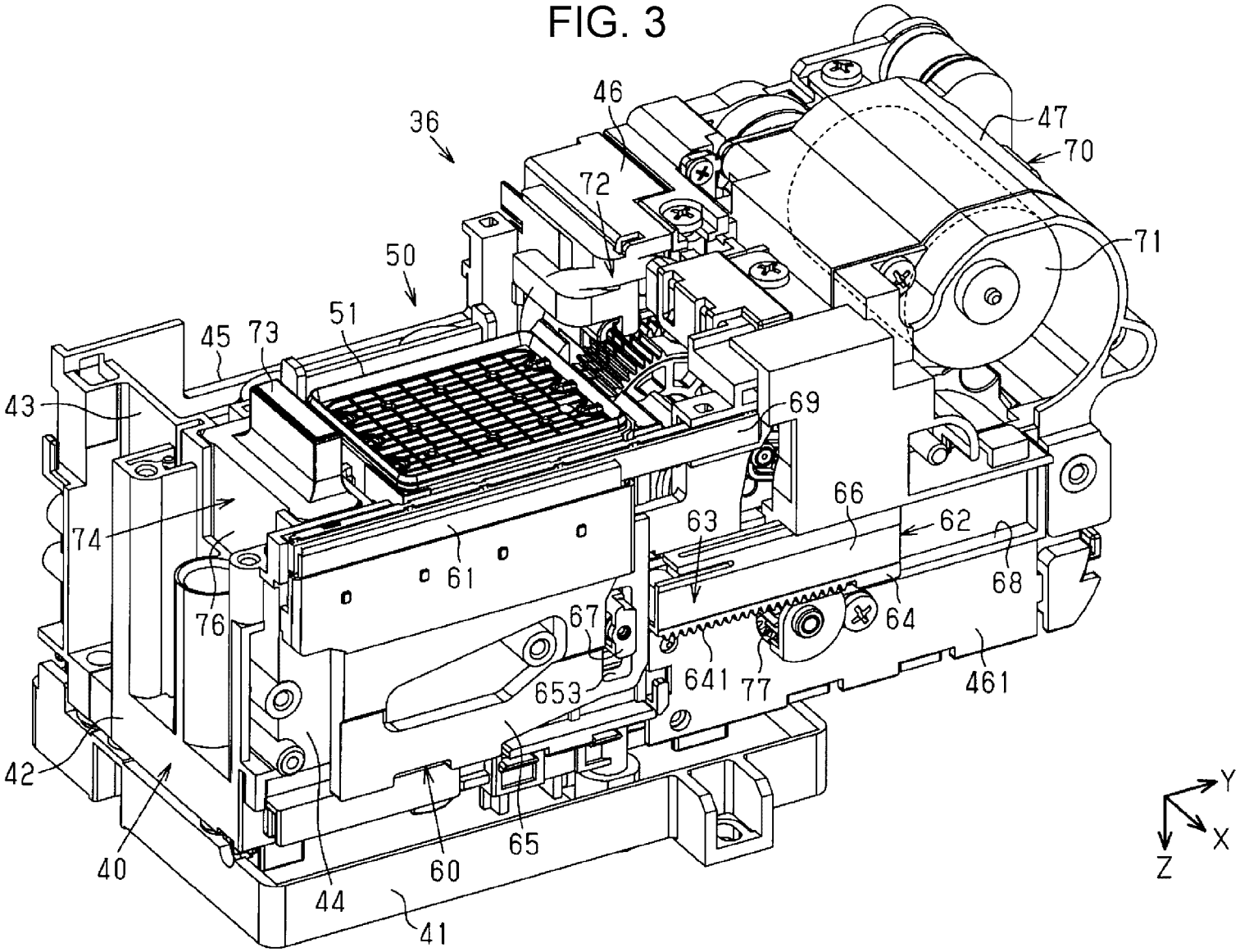
FIG. 3 is a perspective view illustrating a maintenance device.
Figure 4:
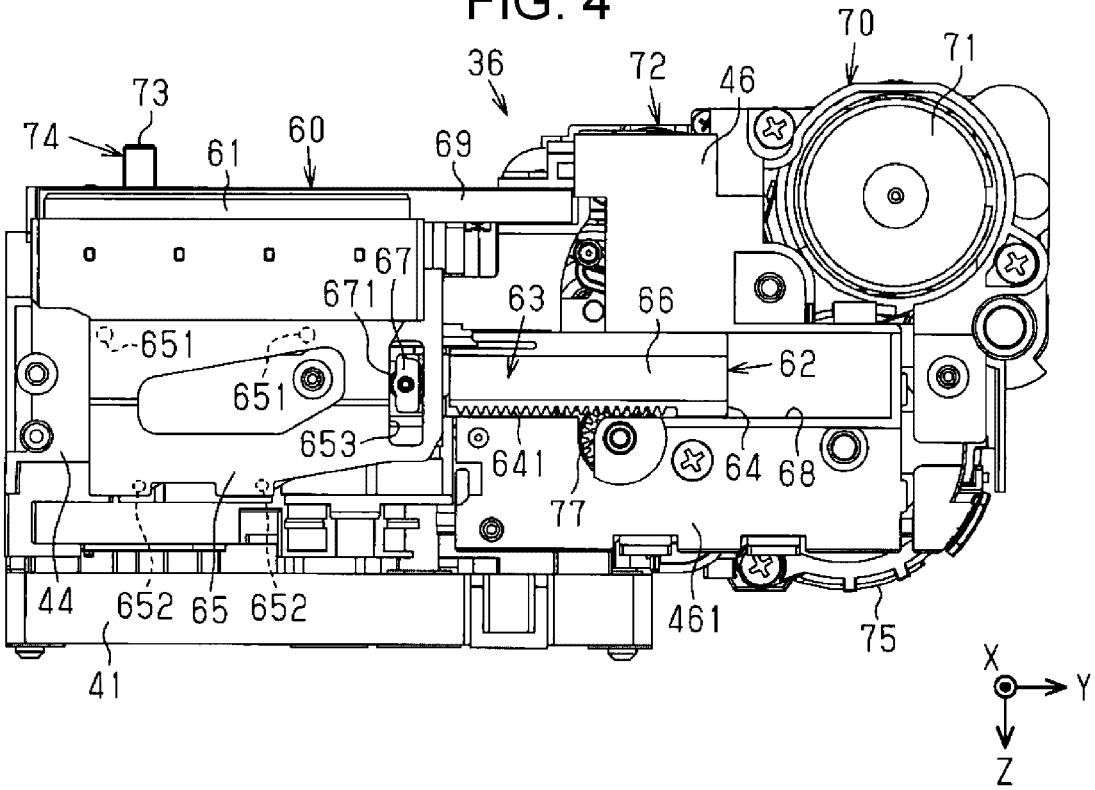
FIG. 4 is a side view illustrating the maintenance device.

As illustrated in FIG. 3, the maintenance device 36 includes a cap unit 50 having the cap 51, a wiper unit 60 having the wiper 61, a driving mechanism 70 having the electric motor 71 and a power transmitting mechanism 72, and a lock unit 74 having a lock member 73. As illustrated in FIG. 4, the maintenance device 36 includes a suction pump 75.

As illustrated in FIG. 3, the electric motor 71 is the drive source of the maintenance device 36. The power transmitting mechanism 72 selectively transmits power of the electric motor 71 to the cap unit 50, the wiper unit 60, the lock unit 74, and the suction pump 75 and drives the units at a predetermined timing.

The power transmitting mechanism 72 is configured to include a cam mechanism. The power transmitting mechanism 72 selects a cam constituting the cam mechanism, and thereby the cap 51, the wiper 61, the lock member 73, the suction pump 75, and an atmosphere-open valve 78 (refer to FIGS. 32 and 33) are driven at the predetermined timing. The suction pump 75 functions as a suction current generating source that generates a suction current for suctioning a fluid from an inside of the cap 51.

The maintenance device 36 includes a base unit 40 in which the cap unit 50, the wiper unit 60, the lock unit 74, the suction pump 75, the driving mechanism 70, and the like are assembled. The base unit 40 includes a dish-shaped waste container 41 that accumulates a waste liquid from the cap 51. The base unit 40 includes a base portion 42 having a substantially quadrangular plate shape, which is disposed above the waste container 41, and a back plate portion 43 and a pair of side plate portions 44 and 45 which extend upward from the base portion 42.

The back plate portion 43 is positioned upstream in the transport direction Y in the base portion 42. The pair of side plate portions 44 and 45 is positioned to be opposite to each other in the width direction X in the base portion 42. The side plate portions 44 and 45 are positioned to interpose a disposition region of the cap unit 50 therebetween in the width direction X in the base unit 40.

The base unit 40 has a housing portion 46 in which the driving mechanism 70 is assembled. The housing portion 46 is provided with a motor housing portion 47 that accommodates the electric motor 71. The motor housing portion 47 constitutes a part of the housing portion 46.

The base unit 40 is fixed to the frame 17 by using a screw, and thereby the maintenance device 36 is disposed at the home position HP. The base unit 40 of the embodiment is capable of selecting a layout of the cap unit 50 and the wiper unit 60 which are assembled in the base unit 40. Details of a configuration in which the layout of the cap unit 50 and the wiper unit 60, which are assembly target in the base unit 40, is selectable will be described below.

Figure 20:
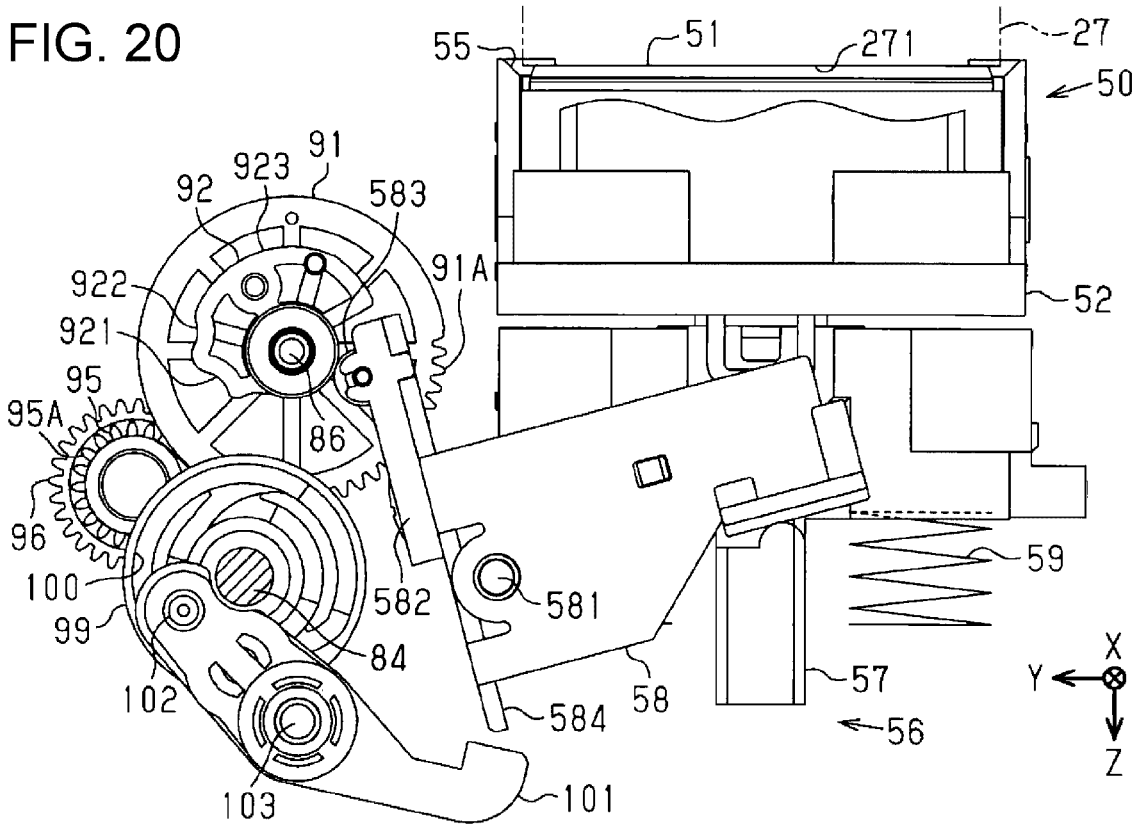
FIG. 20 is a side view illustrating the cap unit in a state in which the cap is disposed at a capping position.

The cap 51 moves between an uncapping position illustrated in FIG. 3 and a capping position illustrated in FIG. 20 by a drive force that is transmitted from the electric motor 71 via the power transmitting mechanism 72. In the embodiment, the cap 51 is lifted and lowered between the uncapping position and the capping position. The cap 51 at the capping position is in contact with the nozzle-formed surface 271. In other words, the cap 51 at the capping position caps the liquid ejecting head 27. The cap 51 at the uncapping position is not in contact with the nozzle-formed surface 271.

Figure 5:
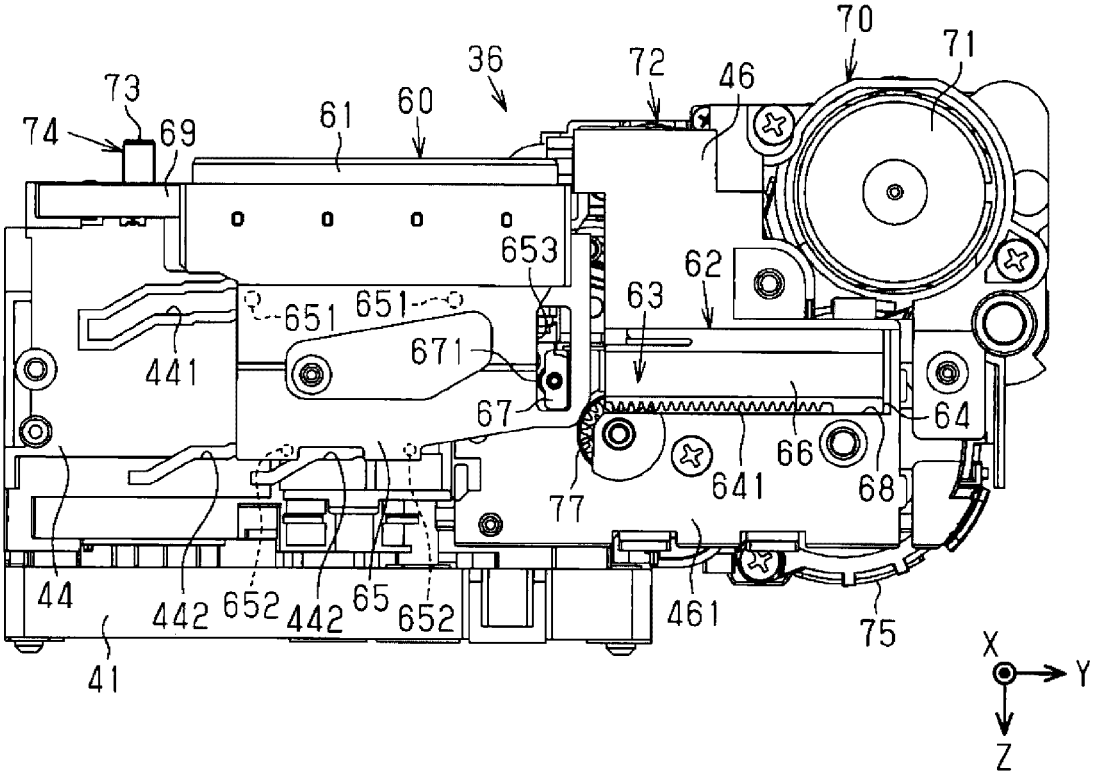
FIG. 5 is a side view illustrating the maintenance device in a state in which a wiper is placed at a wiping position.

As illustrated in FIGS. 4 and 5, for example, the suction pump 75 is configured of a tube pump. Two tubes for suction and discharge are connected to the suction pump 75. One end of the tube for suction is connected to the suction pump 75 and the other end thereof is connected to the cap 51. One end of the tube for discharge is connected to the suction pump 75 and the other end thereof is connected to the waste container 41.

When the suction pump 75 is driven, the fluid in the cap 51 is suctioned. The fluid includes a gas such as air and a liquid that is discharged from the liquid ejecting head 27. When the suction pump 75 is driven in a state in which the cap 51 is in contact with the liquid ejecting head 27, suction cleaning of forcibly suctioning the liquid from the nozzles 272 is performed. The suction pump 75 is not limited to the tube pump and may be a gear pump, a diaphragm pump, or the like.

The cap 51 is connected to the atmosphere-open valve 78 (refer to FIGS. 32 and 33) that is capable of opening a space inside the cap to the atmosphere on the outside in a state in which the cap 51 is in contact with the nozzle-formed surface 271. For example, the atmosphere-open valve 78 is closed during suction cleaning and is opened after the suction cleaning is finished. The atmosphere-open valve 78 is opened, and thereby the inside of the cap 51 is opened to the atmosphere. The suction pump 75 is continuously driven in the state in which the inside of the cap 51 is opened to the atmosphere, and thereby an empty suction is performed. The empty suction means a suction performed inside the cap 51 by the suction pump 75 in the state in which the inside of the cap 51 is opened to the atmosphere. In the embodiment, in a case where the empty suction is executed, the suction is performed inside the cap 51 by the suction pump 75 in a state in which the cap 51 caps the liquid ejecting head 27 and a state in which the atmosphere-open valve 78 is opened. The empty suction also includes a suction performed inside the cap 51 by the suction pump 75 in a state in which the cap 51 is not in contact with the nozzle-formed surface 271. When the empty suction is executed, a liquid accumulated in the cap 51 is discharged without suction of the liquid from the nozzles 272.

The lock unit 74 is disposed at a position on an opposite side to the driving mechanism 70 with the cap 51 interposed therebetween in the transport direction Y. The lock unit 74 has a guide portion 76 and the movable lock member 73 that is guided by the guide portion 76. The lock member 73 is movable between an unlock position and a lock position illustrated in FIG. 3. The lock member 73 may be liftable and lowerable between the unlock position and the lock position. The lock member 73 at the unlock position does not engage with the carriage 26. The lock member 73 at the lock position is engageable with the carriage 26 when the liquid ejecting head 27 is positioned at the maintenance position.

The lock unit 74 has the electric motor 71 as a drive source, and the lock member 73 moves between the unlock position and the lock position at a predetermined timing. The lock member 73 engages with the carriage 26 at the lock position, thereby, locking the carriage 26 in a state in which the liquid ejecting head 27 is positioned at the maintenance position.

The wiper 61 constituting the wiper unit 60 is disposed adjacent to the cap 51. The wiper 61 is disposed close to the print region PA from the cap 51 in the width direction X. The wiper 61 is provided to have an elongated shape so as to be longer than a length of the nozzle-formed surface 271 (refer to FIG. 19) in the transport direction Y and is made of an elastic material such as strip-shaped synthetic rubber. The wiper 61 is configured to have a thickness that is reduced toward a front end thereof.

The wiper unit 60 includes a wiper moving mechanism 62 that moves the wiper 61 between the wiping position illustrated in FIG. 5 and the retreat position illustrated in FIGS. 3 and 4. The wiper 61 at the wiping position is capable of wiping the nozzle-formed surface 271. The wiper 61 at the retreat position is positioned at a position separated from the wiping position in a direction along the nozzle-formed surface 271. The wiper moving mechanism 62 is an example of a wiping member moving mechanism that moves the wiper 61 in an advancing/retreating direction MD (refer to FIGS. 13 and 14). The advancing/retreating direction MD is a direction along the nozzle-formed surface 271. In the embodiment, the advancing/retreating direction MD is a direction indicating the transport direction Y and an opposite direction to the transport direction Y.

As illustrated in FIGS. 3, 4, and 5, the wiper moving mechanism 62 includes a wiper holding mechanism 63, which is an example of the wiping member holding mechanism that holds the wiper 61, and a rack member 64, which is an example of a drive force transmitting unit. The wiper holding mechanism 63 has a wiper holder 65 as an example of a holding member and a slide member 66.

The wiper holder 65 is movable while being guided to guide holes 441 and 442 provided in the side plate portion 44. Each of the guide holes 441 and 442 is an example of the guide portion extending in the advancing/retreating direction MD. The wiper holder 65 is lifted and lowered by moving along the guide holes 441 and 442.

The slide member 66 holds the wiper holder 65 movably. A connection portion 67 is attached to a part of one end of the slide member 66 in the advancing/retreating direction MD. The slide member 66 is connected to the wiper holder 65 via the connection portion 67. The slide member 66 is connected to the rack member 64. The wiper 61 is held on an upper portion of the wiper holder 65 having a predetermined plate shape.

The wiper holder 65 is provided with guide pins 651 and 652 fitted into the guide holes 441 and 442. The guide pins 651 and 652 are guided by the guide holes 441 and 442, and thereby the wiper holder 65 is movable in the advancing/retreating direction MD and is vertically liftable and lowerable.

The wiper holder 65 is provided with a guide groove 653 into which the connection portion 67 is inserted. The guide groove 653 allows the wiper holder 65 to relatively move in a vertical direction Z in a state in which the connection portion 67 is inserted into the guide groove. The connection portion 67 has a roller 671 that is rollable on an inner wall surface of the guide groove 653 in the vertical direction Z. When the wiper holding mechanism 63 moves in the advancing/retreating direction MD, the roller 671 rolls on the inner wall surface of the guide groove 653, and thereby the wiper holder 65 relatively moves with respect to the slide member 66 in the vertical direction Z.

The rack member 64 receives a drive force from the electric motor 71 and moves in the advancing/retreating direction MD in a state of holding the wiper holding mechanism 63. The housing portion 46 is provided with a guide rail 68 having a recessed shape, which extends in the advancing/retreating direction MD. The guide rail 68 is positioned on a side of the housing portion 46 in the width direction X.

The rack member 64 is guided by the guide rail 68, thereby being capable of reciprocating in the advancing/retreating direction MD. When the rack member 64 moves in a first direction from a position illustrated in FIG. 4 toward a position illustrated in FIG. 5, the wiper 61 is lifted. When the rack member 64 moves in a second direction from the position illustrated in FIG. 5 toward the position illustrated in FIG. 4, the wiper 61 is lowered. The wiper 61 is lifted and lowered depending on the reciprocating of the rack member 64.

The power transmitting mechanism 72 has a pinion 77 that rotates by the drive force of the electric motor 71. The pinion 77 is positioned below the rack member 64, and a part of the pinion is exposed from a side of the housing portion 46 in the width direction X. The pinion 77 is fixed to an end portion of a rotary shaft 84 that rotates around an axis along the nozzle-formed surface 271. An axis of the rotary shaft 84 extends in a direction different from the advancing/retreating direction MD. The rotary shaft 84 of the embodiment rotates around an axis extending in the width direction X.

The rotary shaft 84 receives the drive force from the electric motor 71 and rotates. The rack member 64 has a rack 641 that intermeshes with the pinion 77. The rack 641 is configured to be provided with gear cutting on a flat plate, which can intermesh with the pinion 77.

As illustrated in FIGS. 4 and 5, when the electric motor 71 is rotatably driven, rotary motion of the pinion 77 is converted into reciprocating linear motion of the rack member 64 via a rack and pinion mechanism configured of the pinion 77 and the rack 641. When the electric motor 71 is driven forward, the pinion 77 rotates forward, and thereby the slide member 66 moves forward in the first direction. Consequently, the wiper 61 at the retreat position is disposed at the wiping position. The wiper 61 at the retreat position is positioned at the lowest position. The wiper 61 at the wiping position is positioned at the highest position.

When the electric motor 71 is driven in reverse, the pinion 77 rotates in reverse, and thereby the slide member 66 moves backward in the second direction. Consequently, the wiper 61 at the wiping position is disposed at the retreat position. In the embodiment, at least one other wiping position is set between the retreat position and the wiping position of the wiper 61. Specifically, one retreat position and three wiping positions are set. Therefore, the wiper 61 can be disposed at a plurality of wiping positions at different heights.

Figure 6:
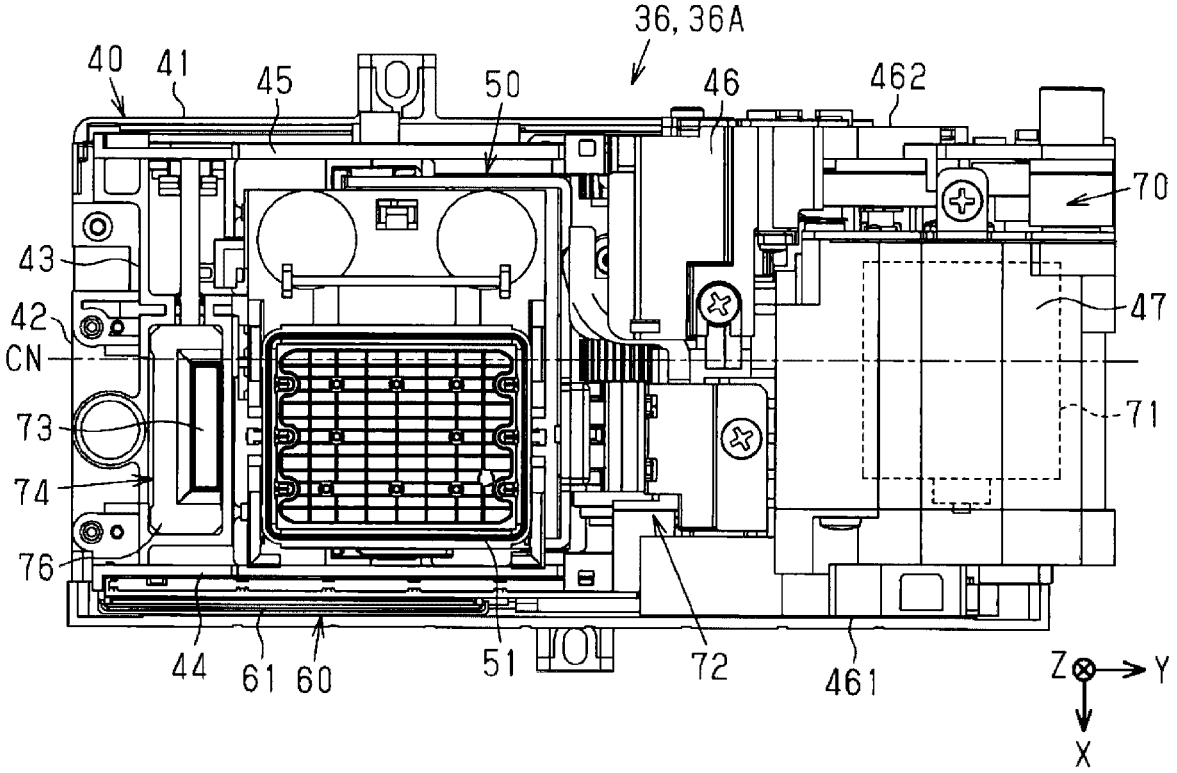
FIG. 6 is a plan view illustrating the maintenance device.
Figure 7:
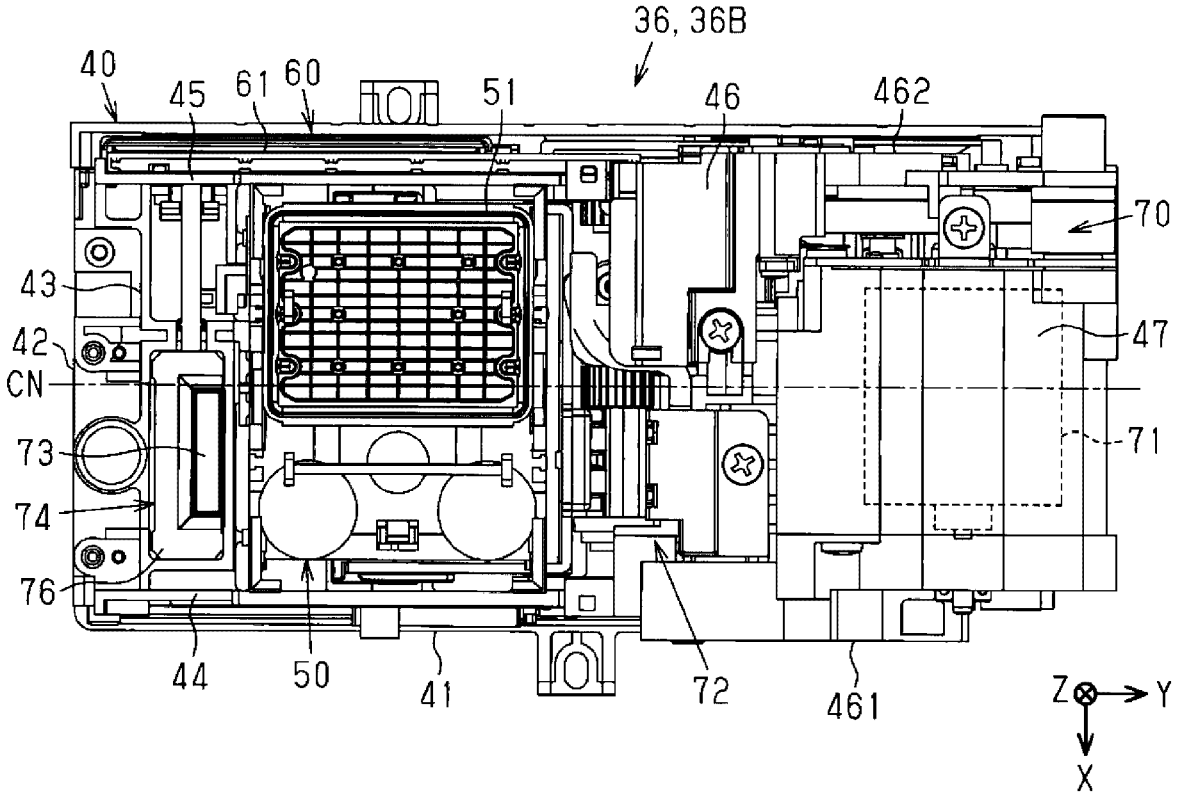
FIG. 7 is a plan view illustrating the maintenance device having another example of layout.

FIG. 6 illustrates the maintenance device 36 (36A) of the embodiment, and FIG. 7 illustrates the maintenance device 36 (36B) of another embodiment in which the layout is changed. In the liquid ejecting apparatus 11 illustrated in FIG. 2, a position close to the right end in FIG. 2 is set as the home position HP, and thus the maintenance device 36 has a rightward disposition so as to be close to the right end. By comparison, in another model of liquid ejecting apparatus, a position close to the left end in the width direction X is set as the home position, and thus the maintenance device 36B has a leftward disposition so as to be close to the left end.

The maintenance device 36 of the embodiment has a configuration in which the base unit 40, in which the units 50 and 60 and the like are assembled, is suitable for both of the rightward disposition and the leftward disposition. In this manner, the base unit 40 is suitable for examples of the rightward disposition and the leftward disposition by changing the layout of the units 50 and 60 while components of the electric motor 71, the power transmitting mechanism 72, and the units 50, 60, and 74 are common.

As can be seen by comparing FIG. 6 with FIG. 7, the cap unit 50 and the wiper unit 60 in the drawings have a line-symmetric positional relationship with respect to a centerline CN of the base unit 40. Therefore, when the common cap 51 and wiper unit 60 are assembled at an orientation obtained by rotating by 180 degrees in each of the plan views of FIGS. 6 and 7, the maintenance device 36 is provided for both of the rightward disposition illustrated in FIG. 6 and the leftward disposition illustrated in FIG. 7.

Next, a configuration of the base unit 40 that is capable of changing the layout will be described.

Figure 8:
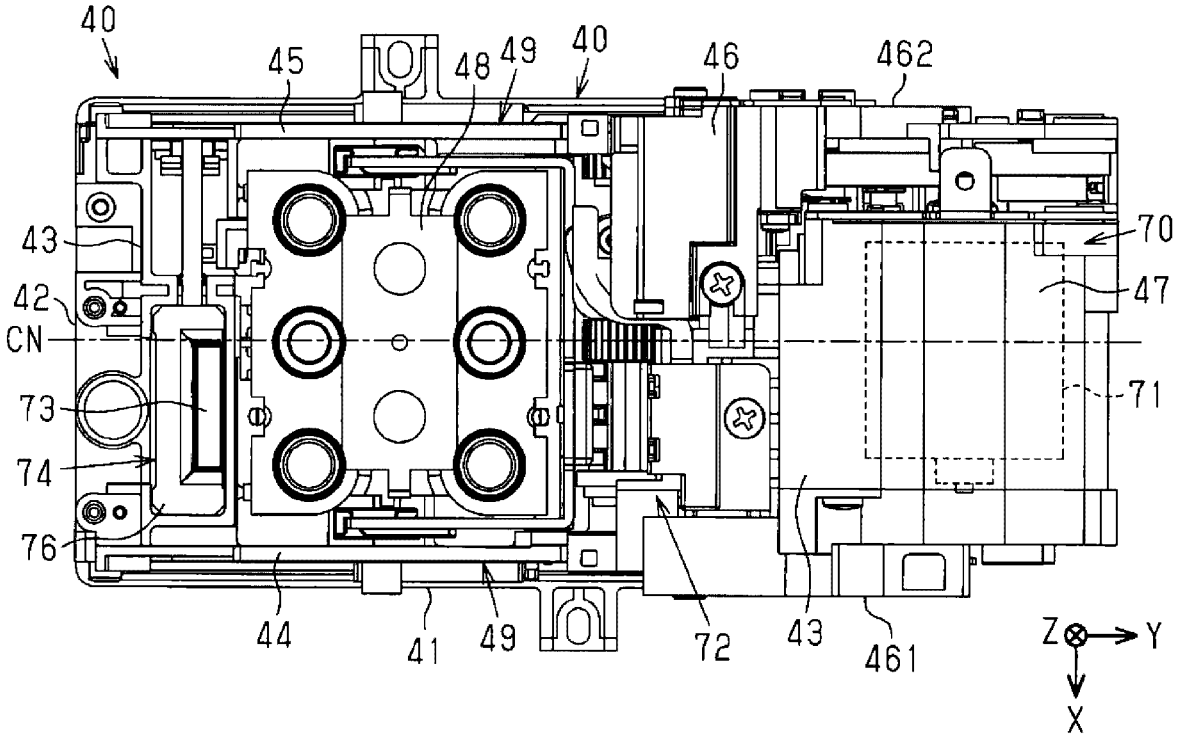
FIG. 8 is a plan view illustrating a base unit.
Figure 9:
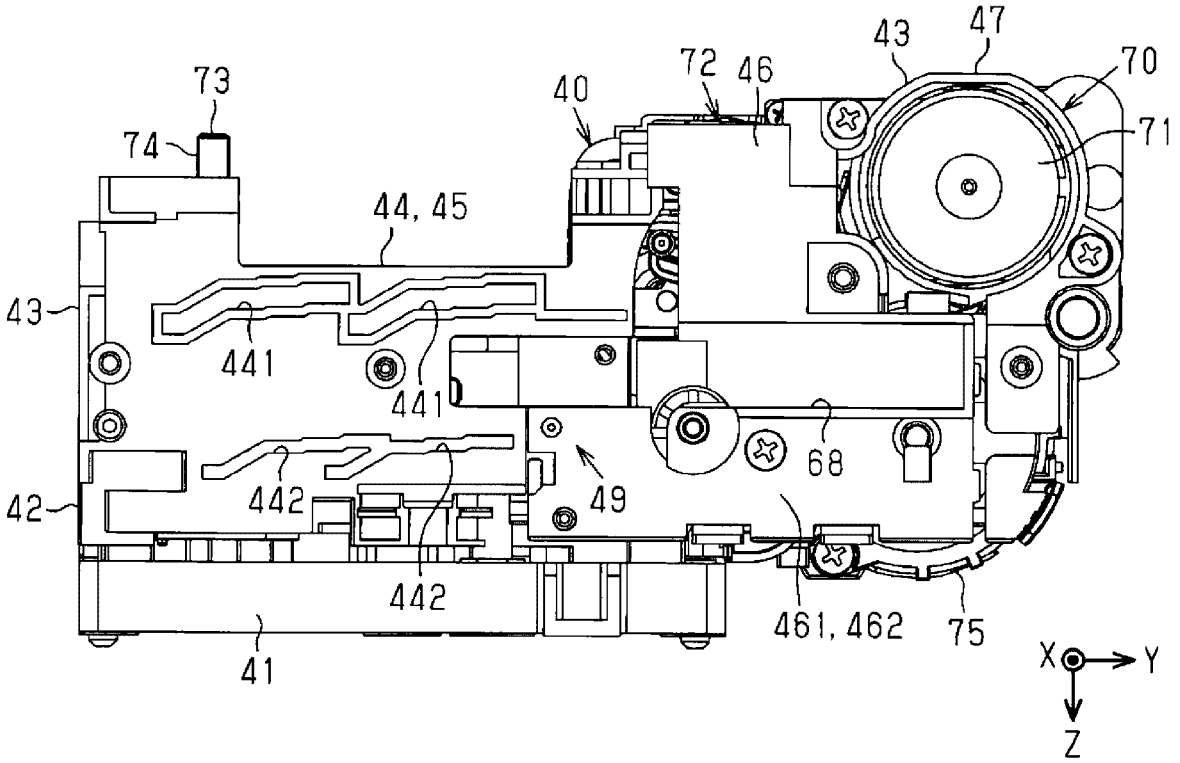
FIG. 9 is a side view illustrating the base unit.

As illustrated in FIGS. 8 and 9, the electric motor 71, the power transmitting mechanism 72, and a part of a lifting/lowering mechanism 56 of the cap unit 50, which have common layout in the rightward disposition and the leftward disposition, are assembled in the base unit 40. In other words, the base unit 40 in the FIGS. 8 and 9 represents a state before the cap 51 and the wiper unit 60, of which the layout change can be performed, are assembled.

The base unit 40 has a cap assembly holding portion 48 in which the cap 51 can be assembled. The cap assembly holding portion 48 holds the assembled cap 51 in a liftable/lowerable state. The cap assembly holding portion 48 is positioned in a region surrounded by the back plate portion 43 and the pair of side plate portions 44 and 45 on the base portion 42. The cap assembly holding portion 48 has a line symmetric shape with respect to the centerline CN of the base portion 42. The cap assembly holding portion 48 has a shape in which the cap 51 can be assembled at two different orientations obtained by rotating by 180 degrees in the plan view illustrated in FIG. 8.

The base unit 40 has a wiper assembly holding portion 49 in which the wiper unit 60 can be assembled. The wiper assembly holding portion 49 holds the assembled wiper unit 60. The wiper assembly holding portion 49 is configured to have a pair of side plate portions 461 and 462 constituting the pair of side plate portions 44 and 45 and the housing portion 46. The pair of side plate portions 44 and 45 has a line symmetric shape with respect to the centerline CN. The pair of side plate portions 461 and 462 has a line symmetric shape with respect to the centerline CN.

As illustrated in FIG. 9, the pair of side plate portions 44 and 45 is provided with two guide holes 441 extending in the advancing/retreating direction MD at the same height as a part which is an upper part of the side plate portions and two guide holes 442 extending in the advancing/retreating direction MD at the same height as a part which is a lower part of the side plate portions. The four guide holes 441 and 442, which are open to the pair of side plate portions 44 and 45, respectively, have a planarly symmetric shape with respect to a vertical plane through the centerline CN.

Four guide pins 651 and 652 (refer to FIG. 4), which are provided on a back surface of the wiper holder 65, are fitted into four the guide holes 441 and 442, respectively. The guide pins 651 and 652 are guided along the guide holes 441 and 442, and thereby the wiper holder 65 is displaced in both directions of the advancing/retreating direction MD and the vertical direction Z. Therefore, the wiper holder 65 can also be assembled in both examples for the rightward disposition illustrated in FIG. 6 and the leftward disposition illustrated in FIG. 7.

The guide rail 68 is formed in each of the pair of side plate portions 461 and 462 at a position and in a planarly symmetric shape with respect to the vertical plane through the centerline CN. Therefore, the rack member 64 that holds the slide member 66 can also be assembled in both examples illustrated in FIGS. 6 and 7.

Next, the cap unit 50 and the power transmitting mechanism 72 will be described.

Figure 10:
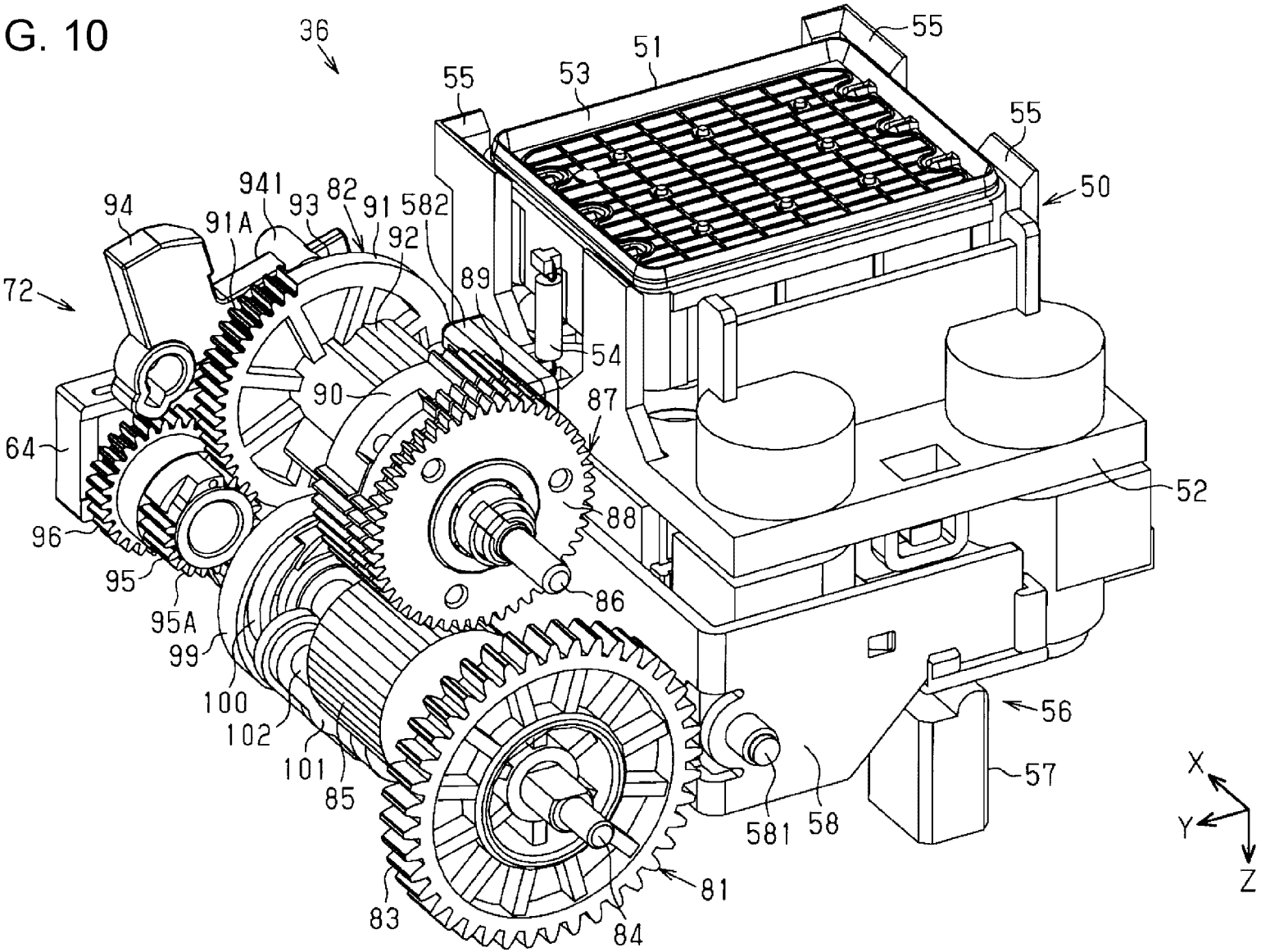
FIG. 10 is a perspective view illustrating a cap unit and a power transmitting mechanism.
Figure 11:
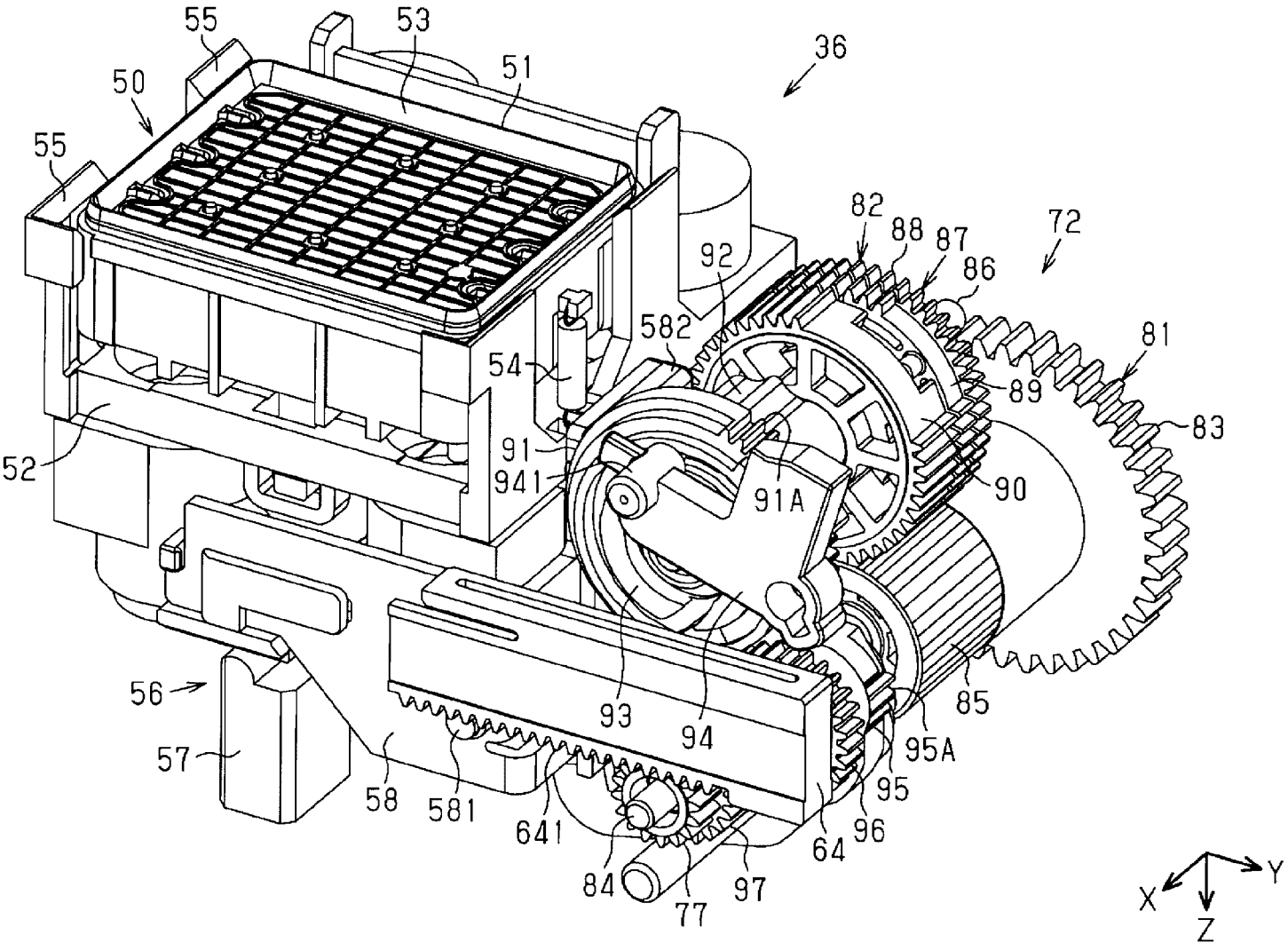
FIG. 11 is a perspective view illustrating the cap unit and the power transmitting mechanism when viewed in a different direction from that in FIG. 10.

As illustrated in FIGS. 10 and 11, the cap 51 has a quadrangular case shape of which an upper portion is opened and is held on a top surface of a cap holder 52. The cap 51 has a substantially quadrangular ring-like sealing portion 53 along an opening on the upper portion of the cap. For example, the sealing portion 53 is made of a synthetic resin material such as an elastomer having rubber elasticity.

The cap 51 is held at a predetermined height in a state of being displaceable in the vertical direction Z by a first spring not illustrated and a second spring 54. The first spring is configured of a compression spring that presses the cap 51 in a direction in which the cap is separated from the cap holder 52. The second spring 54 is configured of a tension spring that is attached between the cap 51 and the cap holder 52. For example, when the cap 51 is lifted, the cap comes into contact with the nozzle-formed surface 271 in a state of being pressed against the nozzle-formed surface by an elastic force from the first spring, the second spring 54, and the like.

An end of a tube extending from the suction pump 75 (refer to FIG. 4) is connected to a suction tube 533 (refer to FIGS. 30 and 31) projecting from a bottom portion of the cap 51. When the suction pump 75 is driven, the fluid in the cap 51 is suctioned.

A head guide 55 is disposed above the cap holder 52 at a position surrounding the sealing portion 53 of the cap 51. The head guide 55 engages with the liquid ejecting head 27 in a process in which the cap 51 is lifted toward the capping position. Consequently, the head guide 55 positions the cap 51 at a normal position with respect to the nozzle-formed surface 271.

The lifting/lowering mechanism 56 that lifts and lowers the cap 51 and the cap holder 52 is assembled below the cap holder 52. The lifting/lowering mechanism 56 has a lifting/lowering rod 57 that is interlocked with the cap holder 52 and the lock member 73 so as to be lifted and lowered and a cap lifting/lowering lever 58 as an example of a turning member that lifts and lowers the cap 51. The cap lifting/lowering lever 58 is turned between a first turning posture illustrated in FIGS. 10 and 11 and a second turning posture illustrated in FIG. 20. The cap lifting/lowering lever 58 in the first turning posture disposes the cap 51 at the uncapping position. The cap lifting/lowering lever 58 in the second turning posture disposes the cap 51 at the capping position.

The cap lifting/lowering lever 58 is supported to be capable of turning in a predetermined angle range around a spindle 581. The cap lifting/lowering lever 58 supports a lower portion of the cap holder 52 in a state of surrounding the lower portion from both sides in the width direction X. The lifting/lowering mechanism 56 has a spring 59 (refer to FIG. 20), which is an example of a pressing member that presses the bottom portion of the cap holder 52 in a direction in which the cap 51 moves from the uncapping position toward the capping position, for example an upward direction.

When the cap lifting/lowering lever 58 is turned around the spindle 581 reciprocably, the cap 51 and the cap holder 52 reciprocate in the vertical direction Z, that is, are lifted. The lifting/lowering rod 57 and the cap lifting/lowering lever 58 are driven by the drive force that is transmitted from the electric motor 71 illustrated in FIG. 3 via the power transmitting mechanism 72.

When turning of the cap lifting/lowering lever 58 causes the lifting/lowering rod 57 to be lifted, the cap 51 and the lock member 73 (refer to FIG. 3) are lifted at respective timings that are individually set in advance. In the embodiment, the lock member 73 starts to be lifted earlier than the cap 51. Consequently, the carriage 26 can be locked even in a state in which the cap 51 is disposed at the uncapping position.

The power transmitting mechanism 72 has the cam mechanism that selectively transmits the drive force from the electric motor 71 to the units 50, 60, and 74 and the atmosphere-open valve 78. The units 50, 60, and 74 and the atmosphere-open valve 78 are driven at respective predetermined timings in response to selection of a cam constituting the cam mechanism.

As illustrated in FIG. 11, the power transmitting mechanism 72 has a first gear train 81 that is positioned in a part which is a lower part of the mechanism and a second gear train 82 that is positioned in a part which is an upper part of the mechanism. The first gear train 81 has a drive gear 83 having a large diameter to which the drive force from the electric motor 71 is input and a gear 85 having a wide width which is provided on the rotary shaft 84 which is coaxial with the drive gear 83. The second gear train 82 has a rotary shaft 86 which is an example of a second rotary shaft that rotates around an axis along the axis of the rotary shaft 84.

The gear 85 meshes with a series of three clutches 87 provided around the rotary shaft 86 of the second gear train 82. The clutch 87 has one gear 88, an intermittent gear 89 that is relatively rotatable with respect to the gear 88 and is integrally rotatable with the gear 88 by being frictionally connected to the gear 88, and an intermittent gear 90 that is relatively rotatable with respect to the intermittent gear 89 in a predetermined angle range.

The gears 88 to 90 constituting the clutch 87 are disposed to be opposite to the gear 85 in a width range of the gear 85 and can mesh with the gear 85. When the gear 85 rotates forward or in reverse along with the drive gear 83, the clutch 87 has a function of causing the intermittent gear 90 to start rotating after a predetermined timing from a start of rotation of the gear 88 that meshes with the gear 85. After the intermittent gear 90 meshes with the gear 85, the drive force is directly transmitted from the gear 85 to the intermittent gear 90.

The intermittent gear 90 rotates in an angle range in which the intermittent gear meshes with the gear 85. The drive gear 83 is connected to the suction pump 75 (refer to FIG. 4) so as to be capable of transmitting power. When the drive gear 83 rotates in reverse, the suction pump 75 is driven, and thereby the fluid is suctioned from the cap 51. When the drive gear 83 rotates forward, the suction pump 75 is released, and thereby the inside thereof is opened to the atmosphere.

A first rotating cam 91, which is an example of a rotating cam that functions as an intermittent gear, is fixed to the rotary shaft 86 which is coaxial with the clutch 87. The first rotating cam 91 is provided with a column-shaped cam portion 92 projecting in an axial direction from one side surface and a cam groove 93 provided to be recessed in the other side surface. In the embodiment, the first rotating cam 91 is referred to as the first cam 91 in some cases.

The first cam 91 is connected to the cap 51 in a state of being capable of lifting and lowering the cap 51. The first cam 91 drives the above-described cap lifting/lowering lever 58 along a cam surface which is an outer circumferential surface of the column-shaped cam portion 92. The first cam 91 drives the cap lifting/lowering lever 58, thereby lifting and lowering the cap 51. A cam pin 941 provided in a part which is a distal end of an oscillation member 94 is fitted into the cam groove 93 of the first cam 91.

When the first cam 91 rotates forward and in reverse, the cam pin 941 is guided along the cam groove 93 to a position close to an outer circumference and a position close to an inner circumference of the first cam 91. Consequently, the oscillation member 94 is reciprocably turned. When the oscillation member 94 is reciprocably turned, the atmosphere-open valve 78 is opened and closed. In other words, the cam groove 93 of the first cam 91 functions as a cam that opens and closes the atmosphere-open valve 78. The oscillation member 94 provided with the cam pin 941 functions as a cam follower with respect to a cam.

As illustrated in FIG. 10, a teeth portion 91A of the first cam 91 is capable of meshing with a teeth portion 95A of an intermittent gear 95. The intermittent gear 95 rotates along with a coaxial gear 96. As illustrated in FIG. 11, the gear 96 meshes with a gear 97 that is provided around the rotary shaft 84 having an end portion to which the pinion 77 is fixed. The pinion 77 meshes with the rack 641 of the rack member 64.

As illustrated in FIG. 10, a second rotating cam 99 is fixed to the rotary shaft 84. The second rotating cam 99 is provided with a cam groove 100 on one side surface thereof. In the embodiment, the second rotating cam 99 is referred to as the second cam 99 in some cases. A cap pressing lever 101 that is an example of a pressing lever is turnably provided at a position opposite to the cam groove 100 of the second cam 99. A cam pin 102 provided in a part which is a distal end of the cap pressing lever 101 is fitted into the cam groove 100 of the second cam 99.

When the second cam 99 rotates forward and in reverse, the cam pin 102 is guided along the cam groove 100 to a position close to an outer circumference and a position close to an inner circumference of the second cam 99. Consequently, the cap pressing lever 101 is turned between a reset position and a set position. When the cap pressing lever 101 is disposed at the set position, the cap lifting/lowering lever 58 is disposed in the first turning posture illustrated in FIG. 10 in which the cap lifting/lowering lever can hold the cap 51 at the uncapping position. When the cap pressing lever 101 is disposed at the reset position, the cap lifting/lowering lever 58 is allowed to be turned in the second turning posture (refer to FIG. 20) in which the cap lifting/lowering lever can hold the cap 51 at the capping position by the elastic force of the spring 59.

The drive gear 83 and the gear 85 are able to relatively rotate with respect to the rotary shaft 84 in a state of being connected to integrally rotate. The pinion 77, the gear 97, and the second cam 99 are fixed to the rotary shaft 84 and are able to integrally rotate with respect to the rotary shaft 84. Therefore, the rotation of the gear 85 is transmitted to the gear 97 via the clutch 87, the first cam 91, the intermittent gear 95, and the gear 96. A detailed configuration of the lifting/lowering mechanism 56 having the lifting/lowering rod 57, the cap lifting/lowering lever 58, the cap pressing lever 101, and the like will be described below.

Next, a configuration of the wiper unit 60 will be described.

Figure 12:
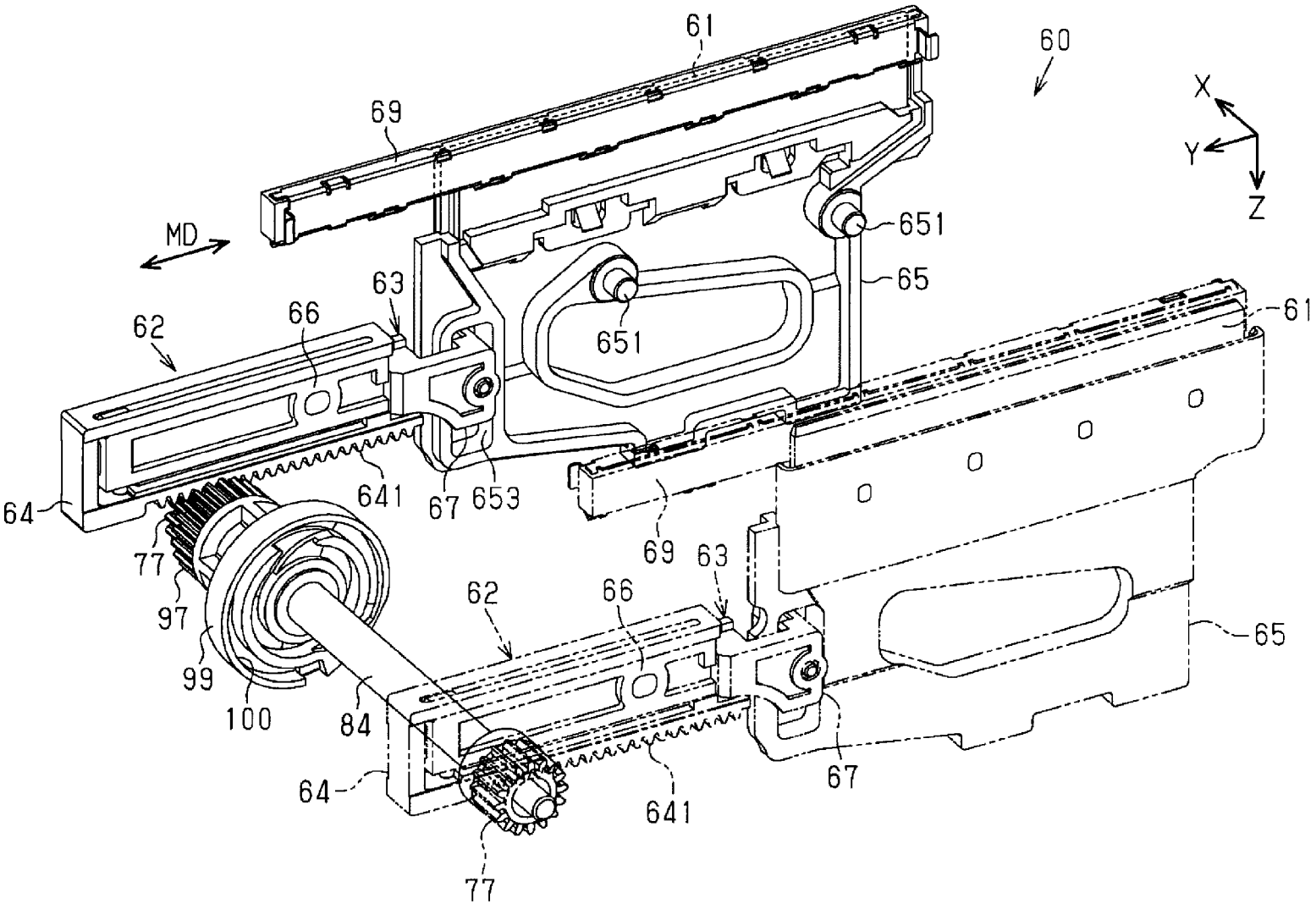
FIG. 12 is a perspective view illustrating a wiper unit.

As illustrated in FIG. 12, the wiper unit 60 has a configuration in which the wiper moving mechanism 62 is assembled in one of both end portions of the rotary shaft 84 in the axial direction. In an example of the maintenance device 36 (36A) having the rightward disposition as in the liquid ejecting apparatus 11 illustrated in FIG. 2, the wiper moving mechanism 62 is assembled at a position represented by a solid line in FIG. 12. In this case, the pinion 77 is fixed to one end of the rotary shaft 84 as represented by the solid line in FIG. 12 and meshes with the rack 641. On the contrary to the liquid ejecting apparatus 11 illustrated in FIG. 2, in an example of the maintenance device 36 (36B), the wiper moving mechanism 62 is assembled at a position represented by a two-dot chain line in FIG. 12. In this case, the pinion 77 is fixed to the other end of the rotary shaft 84 as represented by the two-dot chain line in FIG. 12 and meshes with the rack 641.

When rotation of the pinion 77 causes the rack member 64 having the rack 641 that meshes with the pinion 77 to move in the advancing/retreating direction MD, the slide member 66 held by the rack member 64 moves together in the advancing/retreating direction MD. When the slide member 66 moves in the advancing/retreating direction MD, the wiper holder 65, which is connected to the slide member 66 via the connection portion 67, moves together in the advancing/retreating direction MD.

The wiper holder 65 has the above-described two upper and lower guide pins 651 and 652 (only one pin illustrated in FIG. 12) on a back surface (surface opposite to the side plate portion 44 in FIG. 3) of the wiper holder. When the wiper moving mechanism 62 moves in the first direction (left orientation in the advancing/retreating direction MD in FIG. 12), the guide pins 651 and 652 are guided along the guide holes 441 and 442 such that the wiper 61 and the wiper holder 65 are lifted from the retreat position to the wiping position. When the wiper moving mechanism 62 moves in the second direction (right orientation in the advancing/retreating direction MD in FIG. 12), the guide pins 651 and 652 are guided along the guide holes 441 and 442 such that the wiper 61 and the wiper holder 65 are lowered from the retreat position to the wiping position.

Next, there will be provided description of a mechanism that reduces or eliminating an impact when the wiper 61 hits an obstacle including the liquid ejecting head 27 at an irregular position in a lifting process of the wiper 61.

Figure 13:
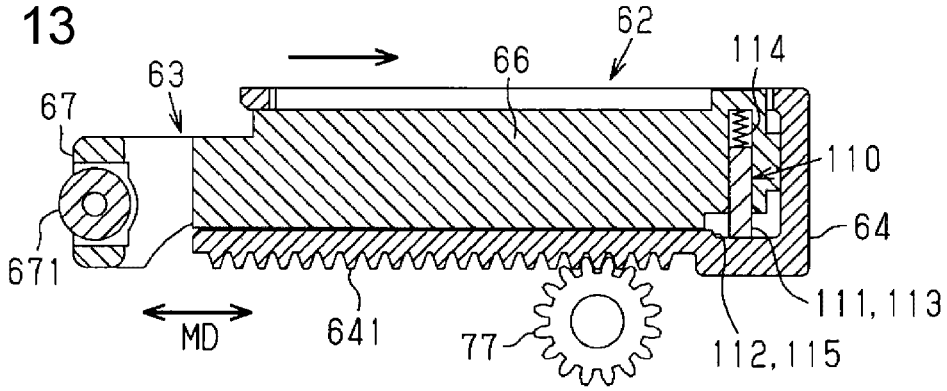
FIG. 13 is a sectional side view illustrating a part of a wiper moving mechanism.
Figure 14:
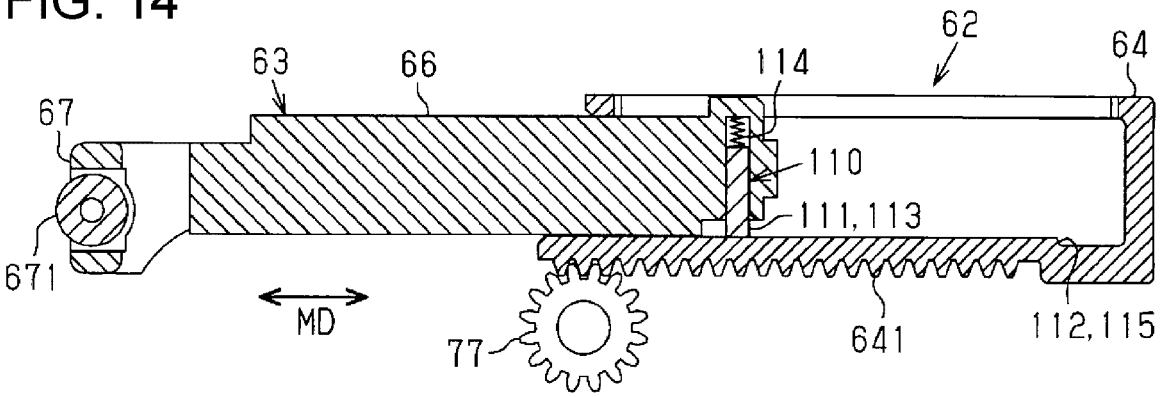
FIG. 14 is a sectional side view illustrating a part of the wiper moving mechanism in a hold releasing state.

As illustrated in FIGS. 13 and 14, the wiper moving mechanism 62 has a holding state canceling mechanism 110 that is capable of canceling a holding state of the wiper holding mechanism 63. The holding state canceling mechanism 110 cancels the holding state of the wiper holding mechanism 63, in a case where the wiper moving mechanism 62 receives a load having a value equal to or higher than a value (set value) set in the advancing/retreating direction MD during the movement of the wiper 61 from the retreat position toward the wiping position.

The wiper moving mechanism 62 including the rack member 64 that holds the wiper holding mechanism 63 moves in the first direction represented by an arrow in FIG. 13 via meshing of the pinion 77 with the rack 641 by forward driving of the electric motor 71. The first direction means a direction in which the wiper 61 is movable from the retreat position toward the wiping position in the advancing/retreating direction MD.

When the wiper moving mechanism 62 receives a load having a value equal to or higher than the set value in the advancing/retreating direction MD during movement in the first direction, the holding state of the wiper holding mechanism 63 that is held by the rack member 64 is canceled by the holding state canceling mechanism 110. The holding state canceling mechanism 110 before canceling connects the slide member 66 and the rack member 64 to each other in the state in which the rack member 64 holds the slide member 66. The holding state canceling mechanism 110 of the embodiment has a function of connecting the rack member 64 and the slide member 66 by locking the members and maintains a state in which the rack member 64 holds the slide member 66 by the locking of both members.

Figure 15:
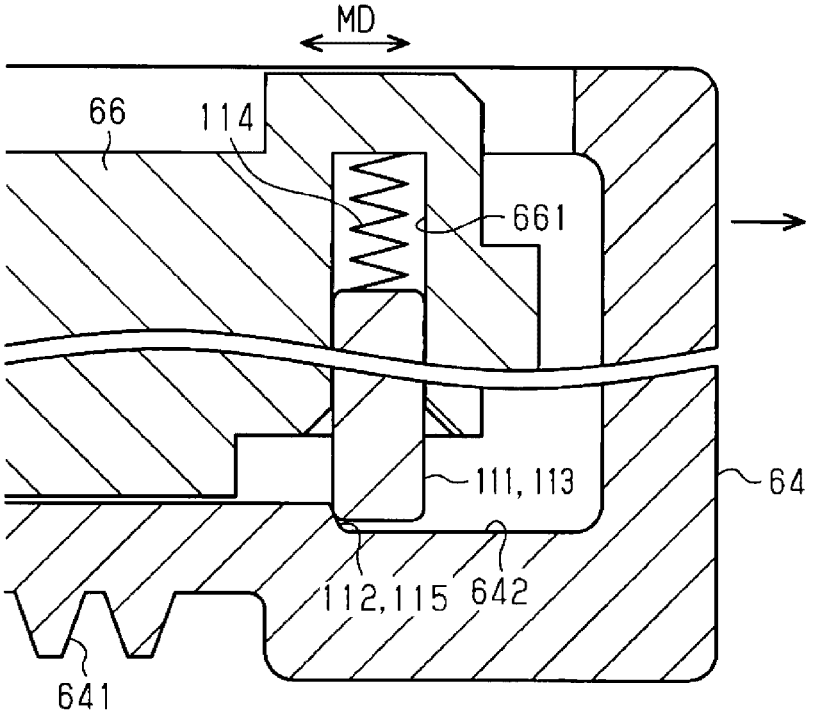
FIG. 15 is a sectional side view of a main part for illustrating an operation of a holding-state releasing mechanism.

As illustrated in FIGS. 13, 14, and 15, the holding state canceling mechanism 110 has a locking target portion 111 provided on the slide member 66 and a locking portion 112 provided on the rack member 64 in a state of being lockable to the locking target portion 111. In a case where the wiper moving mechanism 62 receives a load having a value equal to or higher than the set value during the movement of the wiper 61 from the retreat portion toward the wiping portion, the locking target portion 111 moves from a locking position illustrated in FIG. 13, at which the locking target portion is locked to the locking portion 112, to an unlocking position illustrated in FIG. 14, at which the locking target portion is not locked to the locking portion 112.

In the embodiment, the locking target portion 111 is configured of a slide shaft 113 that is an example of a locking target member provided to be movable with respect to the slide member 66 in a direction intersecting a surface of the rack member 64, which extends in the advancing/retreating direction MD. The slide member 66 has a slide shaft 113 as a part of the holding state canceling mechanism 110 and a spring 114 that presses the slide shaft 113 in a direction in which the slide shaft hits the surface of the rack member 64, which extends in the advancing/retreating direction MD.

As illustrated in FIG. 15, the rack member 64 has a surface 642 that is hit by the slide shaft 113 projecting from the slide member 66 by the elastic force of the spring 114. The surface 642 is provided with an inclined surface 115 which is an example of the locking portion 112 to which the slide shaft 113 is lockable. When the rack member 64 moves in the first direction when the wiper 61 is lifted, the slide shaft 113 is locked to the inclined surface 115, and relative movement of the slide member 66 with respect to the rack member 64 in the advancing/retreating direction MD is regulated.

The slide member 66 has a recessed accommodation portion 661 extending in a direction intersecting the surface 642 of the rack member 64. The recessed accommodation portion 661 is formed in the slide member 66 at an end portion thereof on an opposite side to an end portion thereof, at which the connection portion 67 is provided, in the advancing/retreating direction MD. The recessed accommodation portion 661 accommodates the slide shaft 113 and the spring 114 that presses the slide shaft 113 toward the surface 642 of the rack member 64.

The surface 642 of the rack member 64 is provided with the inclined surface 115 that is lockable to the slide shaft 113 which is to regulate movement of the slide member in a direction of being separated from a position at which the slide member 66 is held by the rack member 64. A force (set load) for moving the slide shaft 113 to the unlocking position by moving over the inclined surface 115 from the locking position is determined by the elastic force of the spring 114, a step and a slope of the inclined surface 115, and the like. In the embodiment, a value of the elastic force of the spring 114, the step and the slope of the inclined surface 115, and the like is set to the extent that the wiper 61 is shifted or detached from the wiper holder 65 so as not to be scratched when the wiper 61 hits an obstacle during lifting.

In a case where the wiper moving mechanism 62 receives a load having a value equal to or higher than the set value during the movement of the wiper 61 from the retreat portion toward the wiping portion, the slide shaft 113 that is held by the slide member 66 rides on the inclined surface 115 and is displaced to the unlocking position against the elastic force of the spring 114. The slide shaft 113 moves over the inclined surface 115 from the locking position at which the slide shaft is locked to the inclined surface 115 and moves to the unlocking position. Therefore, as illustrated in FIG. 14, the slide member 66 and the rack member 64 are disconnected from each other, and only the rack member 64 moves in the first direction even when the pinion 77 rotates. When a load having a value equal to or higher than the set value is received when the wiper 61 hits an obstacle such as the liquid ejecting head 27 or the medium M which is placed at an irregular position, in a process in which the wiper 61 is lifted from the retreat portion toward the wiping portion, the wiper 61 stops lifting at a time point of hitting.

Next, there will be provided description of a mechanism in which the guide pins 651 and 652 of the wiper holder 65 are guided along the guide holes 441 and 442 such that the wiper 61 is caused to be lifted and lowered. The guide holes 441 and 442 corresponding to the upper and lower guide pins 651 and 652 have the same hole shape basically. Therefore, hereinafter, the guide pins 651 and the guide holes 441 positioned on the upper side will be described.

Figure 16:
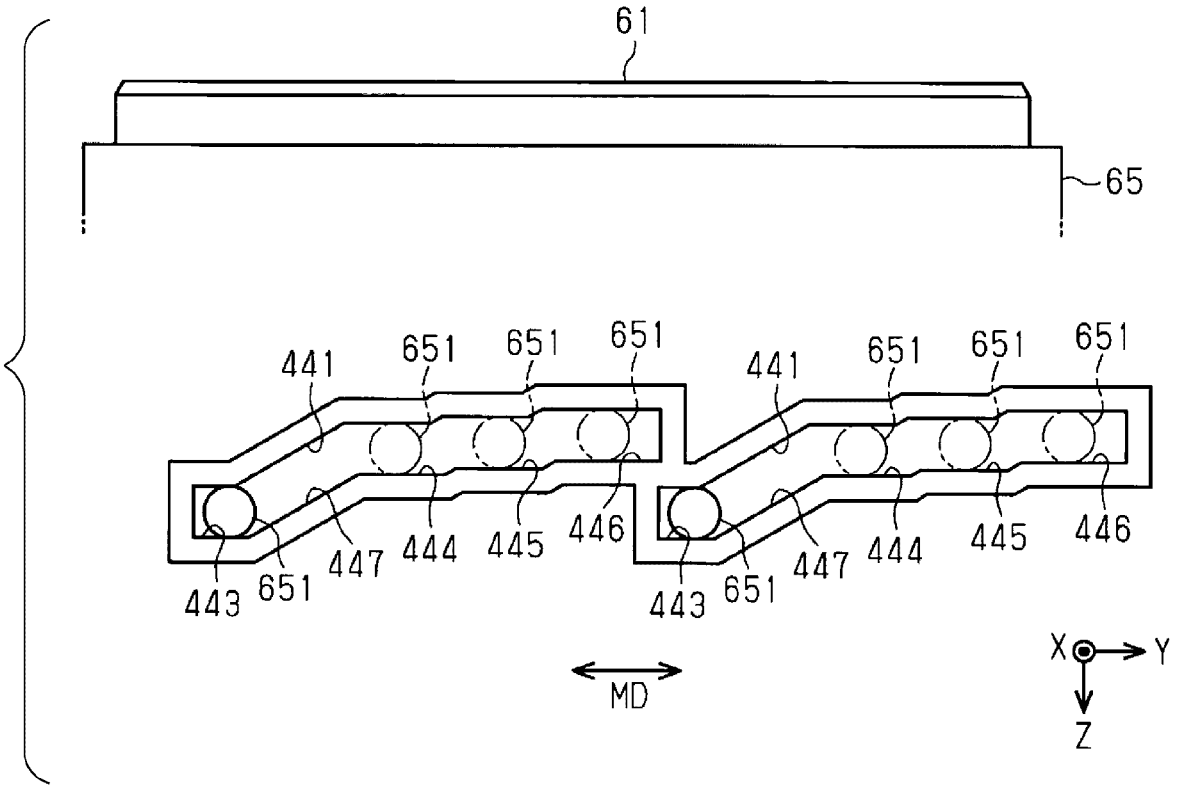
FIG. 16 is a side view illustrating a state in which a guide pin of a wiper holder is guided to a guide hole.

As illustrated in FIG. 16, the guide holes 441 are formed as a route extending in the advancing/retreating direction MD. The guide pin 651 is fitted into the corresponding guide hole 441. The guide hole 441 has a route in which a position of the guide pin 651 is changed in a direction (vertical direction Z) orthogonal to the nozzle-formed surface 271, depending on a change in the position of the fitted guide pin 651 in the advancing/retreating direction MD.

The guide pin 651 slides along the guide hole 441 which is an inclined route, and thereby the wiper 61 is also displaced in the vertical direction Z while moving in the advancing/retreating direction MD. In this case, the wiper holder 65 is stopped at a position in the advancing/retreating direction MD, and thereby a height of the wiper 61 is adjusted in a direction orthogonal to the nozzle-formed surface 271, that is, the vertical direction Z. The height of the wiper 61 of the embodiment is adjustable in a plurality of levels (three levels in the example) of a wiping position W1 (first wiping position W1), a second wiping position W2 lower than the wiping position W1, and a third wiping position W3 lower than the second wiping position W2, as the wiping position for wiping the nozzle-formed surface 271 (refer to FIG. 17).

The guide hole 441 is provided with a plurality of flat portions 443, 444, 445, and 446 which are formed at different positions in the advancing/retreating direction MD and are also formed at different positions in the vertical direction Z orthogonal to the nozzle-formed surface 271. In the embodiment, the four flat portions 443 to 446 are provided as assigned to each of the flat portions. The flat portion 443 having the lowest height of the flat portions 443 to 446 supports the guide pin 651 such that the wiper 61 is positioned at a height of a retreat position Ws. In the embodiment, the flat portion 443 is referred to as the flat portion for the retreat position.

The other three flat portions 444 to 446 have different heights step by step and support the guide pin 651 such that the wiper 61 is positioned at the height of the wiping position. In the embodiment, the three flat portions 444 to 446 are referred to as the flat portions for the wiping positions.

The guide pin 651 is disposed at a total of four positions of a position represented by a solid line and three positions represented by two-dot chain lines in the guide hole 441. The guide pin 651 at the position represented by the solid line is supported by the flat portion 443. The guide pins 651 at the three positions represented by the two-dot chain lines are supported by the first flat portion 446, the second flat portion 445, and the third flat portion 444, respectively.

The guide hole 441 is provided with a plurality of inclined surfaces which are provided between the flat portions 443 to 446, respectively. The guide hole 441 is provided with an inclined surface 447 between the flat portion 443 and the third flat portion 444. The inclined surface 447 has a predetermined slope so as to ascend gradually in a direction (direction which is the right in FIG. 16) in which the wiper 61 moves from the retreat position Ws to the wiping position W1 in the advancing/retreating direction MD.

Short inclined surfaces having a slope which is substantially equal to that of the inclined surface 447 are provided between the flat portions 444 to 446 for the wiping positions, respectively. FIG. 16 illustrates a shape of the upper guide hole 441 and a positional relationship between the upper guide pin 651 and the upper guide hole 441, and the shape and the positional relationship between the lower guide pin 652 and the lower guide hole 442 are the same as those on the upper side.

Figure 17:
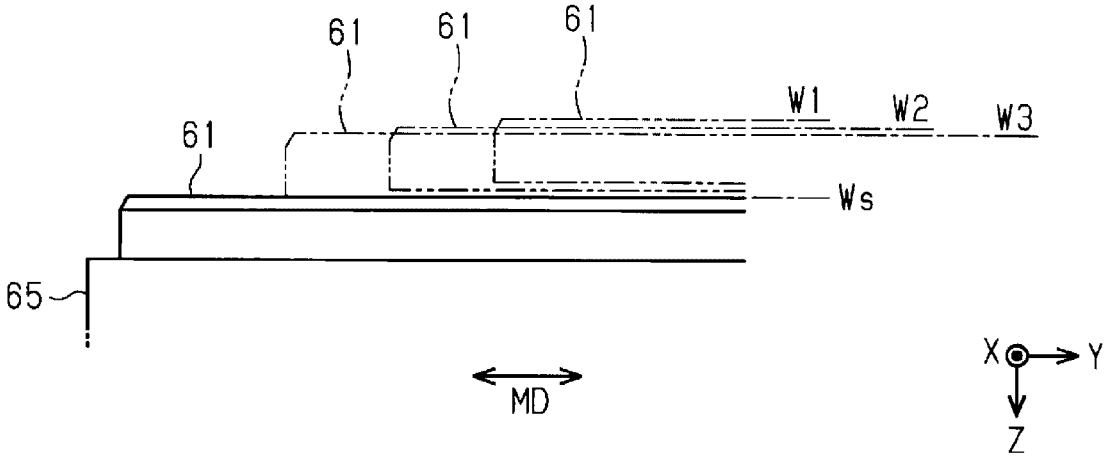
FIG. 17 is a side view of a part for illustrating the wiping position of the wiper.

As illustrated in FIG. 17, the second wiping position W2 for wiping the nozzle-formed surface 271 is set between the retreat position Ws and the wiping position W1. The second wiping position W2 is set at a position at which a distance from the wiping position W1 is shorter than a distance from the retreat position Ws in an orthogonal direction orthogonal to the nozzle-formed surface 271. In other words, the second wiping position W2 is set at a position closer to the first wiping position W1 between the first wiping position W1 and the retreat position Ws in the vertical direction Z.

The third wiping position W3 for wiping the nozzle-formed surface 271 is set between the second wiping position W2 and the retreat position Ws. The third wiping position W3 is set at a position at which a distance from the second wiping position W2 is shorter than a distance from the retreat position Ws in the orthogonal direction orthogonal to the nozzle-formed surface 271. In other words, the third wiping position W3 is set at a position closer to the second wiping position W2 between the second wiping position W2 and the retreat position Ws in the vertical direction Z.

In the embodiment, when the above-described wiping position at the highest position is set as the first wiping position W1, the second wiping position W2 and the third wiping position W3 are set as contact positions which are lower than the first wiping position W1. In other words, in the embodiment, the first wiping position W1 is set as a wiping position that is most separated from the retreat position Ws in the advancing/retreating direction MD. The second wiping position W2 and the third wiping position W3 are set in this order from the first wiping position W1 in the orthogonal direction orthogonal to the nozzle-formed surface 271.

When the guide pin 651 illustrated in FIG. 16 is disposed in the flat portion 443, the wiper 61 is disposed at the retreat position Ws represented by a solid line in FIG. 17. When the guide pin 651 illustrated in FIG. 16 is disposed in the third flat portion 444, the wiper 61 is disposed at the third wiping position W3 represented by a two-dot chain line in FIG. 17. When the guide pin 651 illustrated in FIG. 16 is disposed in the second flat portion 445, the wiper 61 is disposed at the second wiping position W2 represented by a two-dot chain line in FIG. 17. When the guide pin 651 illustrated in FIG. 16 is disposed in the first flat portion 446, the wiper 61 is disposed at the first wiping position W1 represented by a two-dot chain line in FIG. 17.

Figure 18:
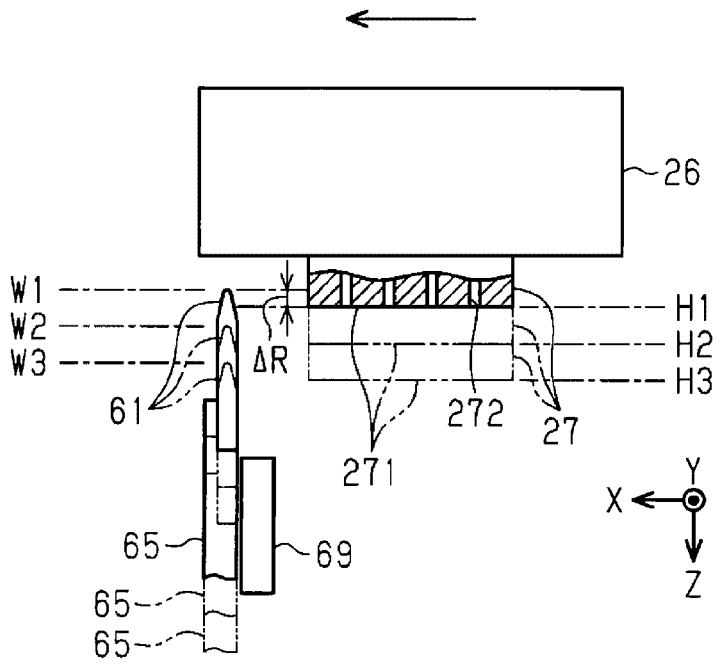
FIG. 18 is a schematic front view illustrating a relationship between a height of a liquid ejecting head and the wiping position of the wiper.

As illustrated in FIG. 18, the liquid ejecting head 27 is displaceable in the direction (vertical direction Z) orthogonal to the nozzle-formed surface 271 by driving of the gap adjusting mechanism 33 (refer to FIG. 2). When the control unit 37 acquires a print job, the control unit drives the gap adjusting mechanism 33 such that a gap is obtained depending on a thickness of the medium M which is set from information of a type of medium, which is included in the print job. Consequently, a gap between the nozzle-formed surface 271 of the liquid ejecting head 27 and the medium M is adjusted to an appropriate value.

The liquid ejecting head 27 is disposed at a first position H1 represented by a solid line in FIG. 18 in a case where the medium M has the largest thickness. The liquid ejecting head 27 is disposed at a second position H2 represented by a two-dot chain line in FIG. 18 in a case where the medium M has a thickness in a medium degree. The liquid ejecting head 27 is disposed at a third position H3 represented by a two-dot chain line in FIG. 18 in a case where the medium M has the smallest thickness.

The liquid ejecting head 27 is provided with the plurality of nozzles 272 as illustrated on a partial sectional plane in FIG. 18. During printing, mist generated when a liquid such as ink is ejected from the nozzles 272 is attached to the nozzle-formed surface 271 in some cases. During suction cleaning, the liquid scattered when the liquid such as ink is forcibly suctioned from the nozzles 272 is attached to the nozzle-formed surface 271 in some cases. The liquid attached on the periphery of the nozzles 272 causes a liquid to travel in a curve when the liquid is ejected from the nozzles 272, thereby, resulting in a shift of a landing position of the liquid, and thus print quality deteriorates. Therefore, wiping is performed, in which the nozzle-formed surface 271 is wiped by the wiper 61, and the liquid attached to the nozzle-formed surface 271 is removed.

The control unit 37 selects a wiping position from the first to third wiping positions W1 to W3 depending on a height position of the liquid ejecting head 27. The control unit 37 drives the electric motor 71 so as to move the wiper moving mechanism 62 to a position depending on the selected wiping position W. The wiper 61 is disposed at the first wiping position W1 which is the highest wiping position represented by the solid line in FIG. 18 when the liquid ejecting head 27 is disposed at the first position H1. In this state, a predetermined overlap amount ΔR is secured between the liquid ejecting head 27 and the wiper 61 in the vertical direction Z. The overlap amount means an amount of overlap of the liquid ejecting head 27 and the wiper 61 in the vertical direction Z.

The wiper 61 is disposed at the second wiping position W2 which is the second highest wiping position represented by the two-dot chain line in FIG. 18 when the liquid ejecting head 27 is disposed at the second position H2. The wiper 61 is disposed at the third wiping position W3 which is the lowest wiping position represented by the two-dot chain line in FIG. 18 when the liquid ejecting head 27 is disposed at the third position H3. Also at the second wiping position W2 and the third wiping position W3, a predetermined overlap amount ΔR is secured between the liquid ejecting head 27 and the wiper 61 in the vertical direction Z. In the following description, the plurality of wiping positions W1 to W3 are simply referred to as the "wiping position W" in a case where the wiping positions are not particularly distinguished from each other, and the plurality of height positions H1 to H3 of the liquid ejecting head 27 are simply referred to as the "height position H" in a case where the height positions are not particularly distinguished from each other.

The wiper 61 moves to a contact position at which the wiper 61 is capable of coming into contact with the nozzle-formed surface 271 when the wiper 61 moves to the wiping position W1 from the retreat position Ws which is the position separated from the nozzle-formed surface 271 in the orthogonal direction orthogonal to the nozzle-formed surface 271. Therefore, even when the liquid ejecting head 27 is disposed at the highest position during the printing, it is possible to secure the predetermined overlap amount ΔR between the liquid ejecting head 27 and the wiper 61 in the orthogonal direction. The predetermined overlap amount ΔR is secured, and thereby the wiper 61 is capable of appropriately wiping the nozzle-formed surface 271.

Figure 19:
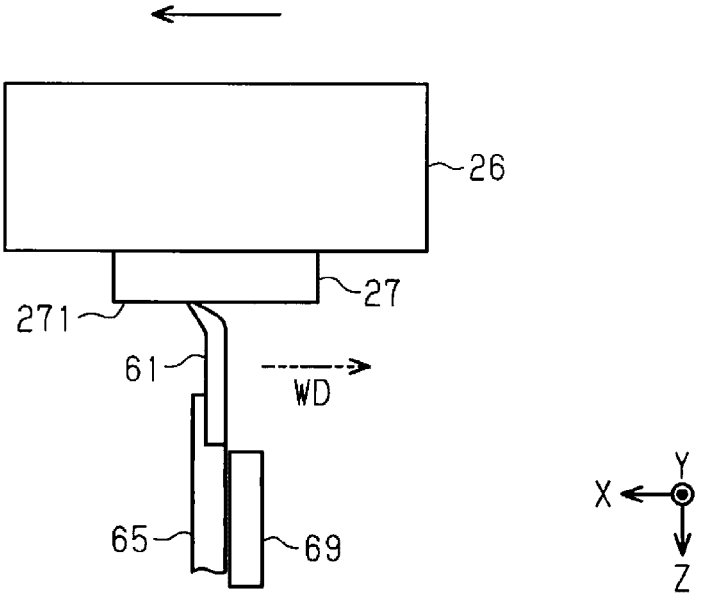
FIG. 19 is a schematic front view for illustrating a wiping operation on a nozzle-formed surface by the wiper.

As illustrated in FIG. 19, after the wiper 61 is disposed at the predetermined wiping position W depending on the height position H of the liquid ejecting head 27, the carriage 26 moves by a predetermined distance in a direction from the maintenance position opposite to the cap 51 (refer to FIG. 2) toward the print region PA. In other words, the carriage 26 moves by the predetermined distance in a direction represented by an arrow in FIG. 19. The predetermined distance means a distance necessary for wiping the nozzle-formed surface 271 by the wiper 61. As a result, in a case of any height positions H and wiping positions W in FIG. 18, the wiper 61 wipes the nozzle-formed surface 271 with an appropriate overlap amount ΔR. Consequently, a distal portion of the wiper 61 comes into contact with the nozzle-formed surface 271 at a predetermined contact pressure. The wiper 61 moves while being in contact with the nozzle-formed surface 271 in a state in which the distal portion of the wiper is slightly bent, thereby, efficiently removing the liquid attached to the nozzle-formed surface 271.

The maintenance device 36 includes a wiper cleaner 69 that removes a liquid attached to the wiper 61. The wiper cleaner 69 is disposed at a position at which the wiper cleaner is capable of coming into contact with the wiper 61 positioned at the retreat position Ws. The wiper cleaner 69 comes into contact with a surface of the wiper 61 on an advancing side of a wiping direction WD.

The wiped liquid is attached to the surface of the wiper 61 on the advancing side in the wiping direction WD when the wiping of the nozzle-formed surface 271 is finished. When the wiper 61 is lowered from the wiping position W to the retreat position Ws after the wiping, the surface of the wiper 61 on the advancing side of the wiping direction WD comes into contact with the wiper cleaner 69. Consequently, the liquid attached to the wiper 61 is absorbed by the wiper cleaner 69, and the liquid is removed from the wiper 61. In other words, the wiper cleaner 69 is an example of an absorption member that absorbs the liquid attached to the wiper 61.

Figure 21:
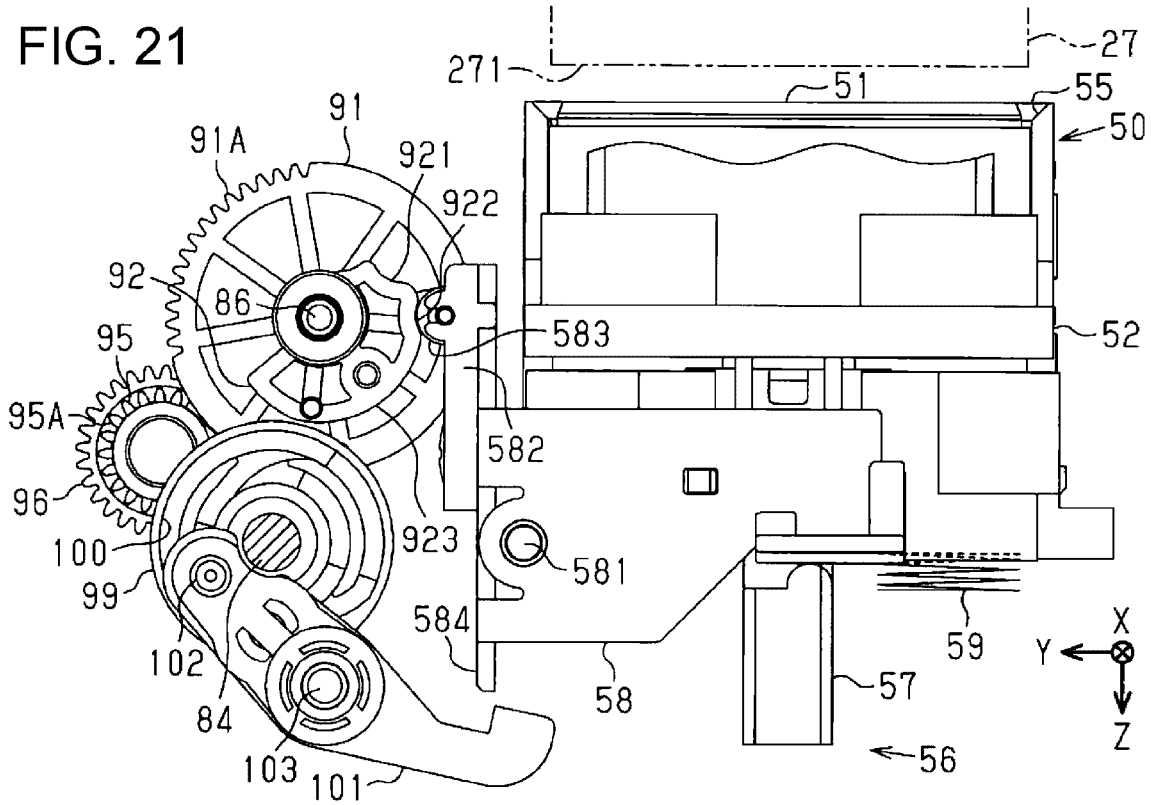
FIG. 21 is a side view illustrating the cap unit in a state in which the cap is disposed at an uncapping position.
Figure 22:
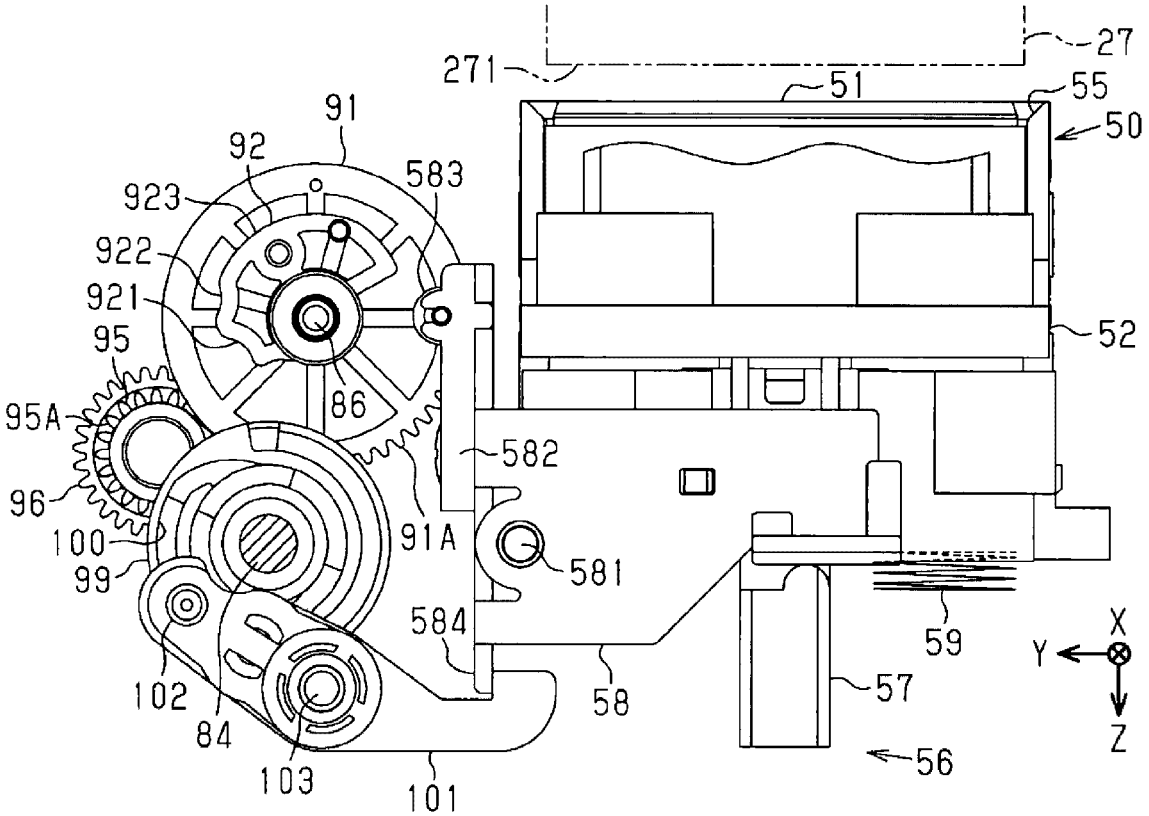
FIG. 22 is a side view illustrating the cap unit in which the cap is held at the uncapping position by a cap pressing lever.

Next, the lifting/lowering mechanism 56 of the cap 51 and a lifting/lowering operation will be described with reference to FIGS. 20, 21, and 22. FIG. 20 illustrates a state in which the cap 51 is disposed at the capping position. FIGS. 21 and 22 illustrate a state in which the cap 51 is disposed at the uncapping position.

As illustrated in FIGS. 20, 21, and 22, the lifting/lowering mechanism 56 includes the lifting/lowering rod 57, the cap lifting/lowering lever 58, the spring 59, the first cam 91, the intermittent gear 95, the second cam 99, the cap pressing lever 101, and the like. The lifting/lowering mechanism 56 includes the first cam 91, the second cam 99, and the like of the power transmitting mechanism 72.

The cap lifting/lowering lever 58 is supported to be turnable around the spindle 581 in a state in which an end portion of the cap lifting/lowering lever is connected to the cap holder 52 pressed upward by the spring 59. The cap lifting/lowering lever 58 is provided with a cam follower 582 that is engageable with the first cam 91. The cam follower 582 has a roller 583 at a distal portion thereof, the roller as an example of a rotating body that is engageable with a cam surface that is an outer circumferential surface of the cam portion 92 of the first cam 91. To be specific, the cap lifting/lowering lever 58 has a lever member having a substantially U shape in plan view, which surrounds the lower portion of the cap holder 52 in three directions, for example. The cam follower 582 extends in an arm shape from a part of the lever member which is opposite to the first cam 91 and supports the roller 583 by the distal portion of the arm-shaped part of the cam follower.

As illustrated in FIG. 21, the first cam 91 turns the cap lifting/lowering lever 58 to the first turning posture in a zone of a rotation angle at which the cam follower 582 engages with the cam surface that is an outer circumferential surface of the cam portion 92. As illustrated in FIG. 20, the first cam 91 allows the cap lifting/lowering lever 58 to be turned to the second turning posture illustrated in FIG. 20 by the elastic force of the spring 59 in a zone of a rotation angle at which the cam portion 92 and the cam follower 582 are disengaged from each other.

As illustrated in FIG. 20, the second cam 99 rotates in a range of a rotation angle at which the teeth portion 91A of the first cam 91 meshes with the teeth portion 95A of the intermittent gear 95. The cap pressing lever 101 is supported in the vicinity of the second cam 99 in a state of being turnable around a spindle 103. The cam pin 102 provided in a proximal portion of the cap pressing lever 101 is fitted into the cam groove 100 provided on one side surface of the second cam 99. The cap lifting/lowering lever 58 has an engagement target portion 584 at a lower end portion thereof which is a part opposite to the distal portion thereof on an opposite side to the cam pin 102 of the cap pressing lever 101 such that the engagement target portion projects downward.

In the state illustrated in FIG. 20, the roller 583 of the cam follower 582 is disengaged from the cam portion 92 of the first cam 91. Therefore, the cap holder 52 is raised by the elastic force of the spring 59 in response to tilting of the cap lifting/lowering lever 58. As a result, the cap 51 comes into contact with the nozzle-formed surface 271 so as to be disposed at the capping position at which a space including the nozzles 272 is formed. The cap 51 is disposed at the capping position during print standby and during cleaning. Rotation positions of the first cam 91 illustrated in FIG. 20 are set as a cap closing position and a suction position. In the embodiment, the rotation angle when the first cam 91 is disposed at the cap closing position and the suction position is 0°, for example.

In a state in which the first cam 91 is disposed at the suction position illustrated in FIG. 20, that is, has the rotation angle of 0°, the suction pump 75 is driven. The suction pump 75 is driven in a direction in which the electric motor 71 rotates the first cam 91 in a clockwise direction in FIG. 20; however, in this case, the first cam 91 has the rotation angle of 0° which is a rotation limit in the clockwise direction. Therefore, the first cam 91 is maintained to have the rotation angle of 0° during an operation of suction cleaning in which the suction pump 75 is driven. Consequently, the cap 51 is held at the capping position.

When the first cam 91 rotates from the rotation angle illustrated in FIG. 20 to the rotation angle illustrated in FIG. 21, the roller 583 of the cam follower 582 engages with the cam portion 92 and is displaced to a position close to the outer circumference of the first cam 91. As a result, the cap lifting/lowering lever 58 is turned in a direction which is the clockwise direction in FIG. 20 around the spindle 581 and is disposed in the second turning posture from the first turning posture illustrated in FIG. 20. Consequently, the cap holder 52 is pressed down against the elastic force of the spring 59, and the cap 51 is disposed at the uncapping position illustrated in FIG. 21 at which the cap is separated from the nozzle-formed surface 271.

When the cap 51 is positioned at the uncapping position, the suction pump 75 is driven in some cases. In this case, the cam pin 102 is guided by the cam groove 100 of the second cam 99, and thereby the cap pressing lever 101 is turned from the state illustrated in FIG. 21 to the state illustrated in FIG. 22.

In the state illustrated in FIG. 22, the cap pressing lever 101 presses the engagement target portion 584 from below such that the cap lifting/lowering lever 58 is raised. Since the cap lifting/lowering lever 58 is in the first turning posture, the cap 51 is disposed at the uncapping position. In this state, when the suction pump 75 is driven, it is possible to discharge the liquid from the cap 51 in a state in which the cap 51 is disposed at the uncapping position.

During the printing, the carriage 26 is moved to the home position HP, and flushing, that is, idle ejection, in which liquid droplets are ejected toward the cap 51 disposed at the uncapping position regardless of the printing from all of the nozzles 272 of the liquid ejecting head 27, is performed in some cases. Liquid droplets such as thickening ink in the nozzles 272 unused in the flushing are discharged, and thereby the nozzles 272 are refilled with a liquid, and thus the nozzles 272 are prevented from being clogged. When the flushing is repeated, the liquid is accumulated in the cap 51, and thus the suction pump 75 is driven during printing on a regular or irregular basis such that the liquid accumulated in the cap 51 is discharged.

Next, the cam portion 92 of the first cam 91 and the cam follower 582 will be described.

Figure 23:
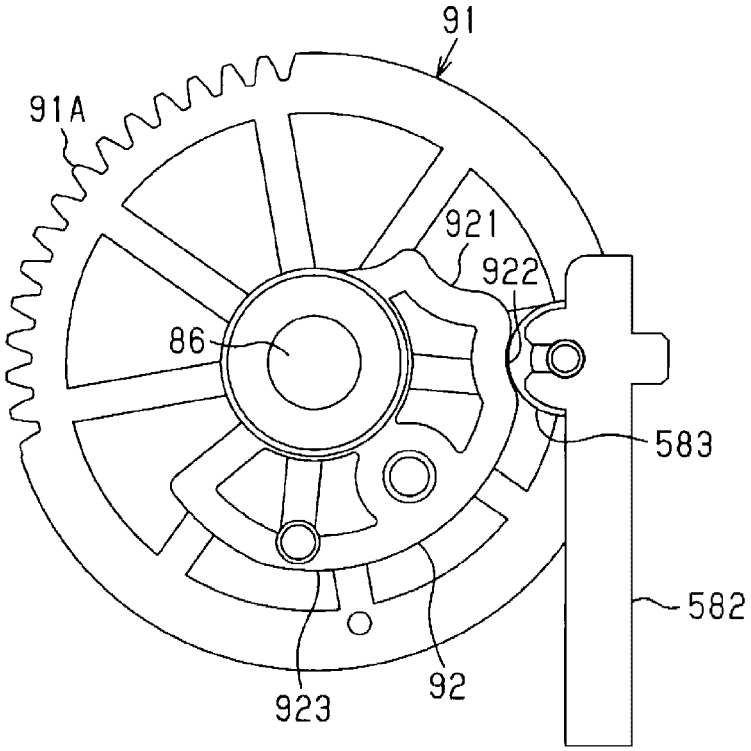
FIG. 23 is a side view illustrating a positional relationship between a second cam and a cam follower of a cap lifting/lowering lever.

As illustrated in FIG. 23, the cam portion 92 has a shape in which a part extending in a predetermined angle range of a part of a periphery of the rotary shaft 86 of the first cam 91 bulges in a radial direction. Therefore, the cam portion 92 has a configuration in which a distance from the rotary shaft 86 to an outer circumferential surface of the cam portion in the radial direction is longer than that in a part on the periphery of the rotary shaft 86, at which the cam portion 92 is not provided.

The outer circumferential surface of the cam portion 92 becomes the cam surface that engages with the roller 583. The cam portion 92 is provided with a first recessed portion 921 which is an example of a recessed portion at an end portion in a direction which is a counterclockwise direction in FIG. 23. The cam portion 92 is provided with a second recessed portion 922 which is an example of a recessed portion at a position adjacent to the first recessed portion 921 in a direction which is a clockwise direction in FIG. 23. The second recessed portion 922 has a longer distance from the rotary shaft 86 than that of the first recessed portion 921. In the states illustrated in FIGS. 21 and 23 in which the roller 583 engages with the second recessed portion 922, the cap lifting/lowering lever 58 is disposed in the first turning posture. As a result, the cap 51 is disposed at the uncapping position.

As illustrated in FIG. 23, a part of the cam portion 92 which is positioned in the direction which is the clockwise direction in FIG. 23 from the second recessed portion 922 is set as a cam surface 923 having a substantially arcuate surface shape. The cap lifting/lowering lever 58 is disposed in the first turning posture in a zone in which the roller 583 engages with the cam surface 923, and the cap 51 is held at the uncapping position. Since the zone in which the roller 583 engages with the cam surface 923 corresponds to a rotation region of the second cam 99 in which a lifting/lowering operation of the wiper 61 is performed, the cap 51 is disposed at the uncapping position.

When the roller 583 engages with the first recessed portion 921, the first recessed portion holds the turning posture of the cap lifting/lowering lever 58 to a turning posture obtained by slightly turning in the direction which is the counterclockwise direction from the first turning posture illustrated in FIG. 20. The carriage 26 engages with the lock member 73, thereby being locked at the position of the lifting/lowering rod 57, and the cap 51 is disposed at the uncapping position. For example, in a case where the liquid ejecting apparatus 11 is housed in a warehouse or the like when the apparatus is not used, it is necessary to completely discharge a liquid in the liquid ejecting head 27 depending on a type of liquid to be used and to dispose the cap 51 at the uncapping position. In this case, the roller 583 of the cam follower 582 is caused to engage with the first recessed portion 921.

A reason of providing the recessed portions 921 and 922 at an engagement target part, at which the roller 583 engages with the cam portion 92 when the first cam 91 is stopped at a target rotation angle at which the cap 51 is disposed at the uncapping position, is as follows. When the roller 583 is pressed to the first recessed portion 921 or the second recessed portion 922 by the elastic force of the spring 59, the first cam 91 slightly rotates in a direction in which the roller 583 is positioned around the recessed portions 921 and 922. Variations in a rotation stopping position of the first cam 91 occur when the first cam 91 is rotated to the target rotation angle by rotation control of the electric motor 71, in some cases. Even when a slight variation in the rotation stopping position of the first cam 91 occurs, the first cam 91 is stopped at an appropriate target rotation angle as long as the first cam 91 rotates in a direction in which the roller 583 is positioned around the recessed portions 921 and 922 by a pressing force received from the roller 583.

Figure 24:
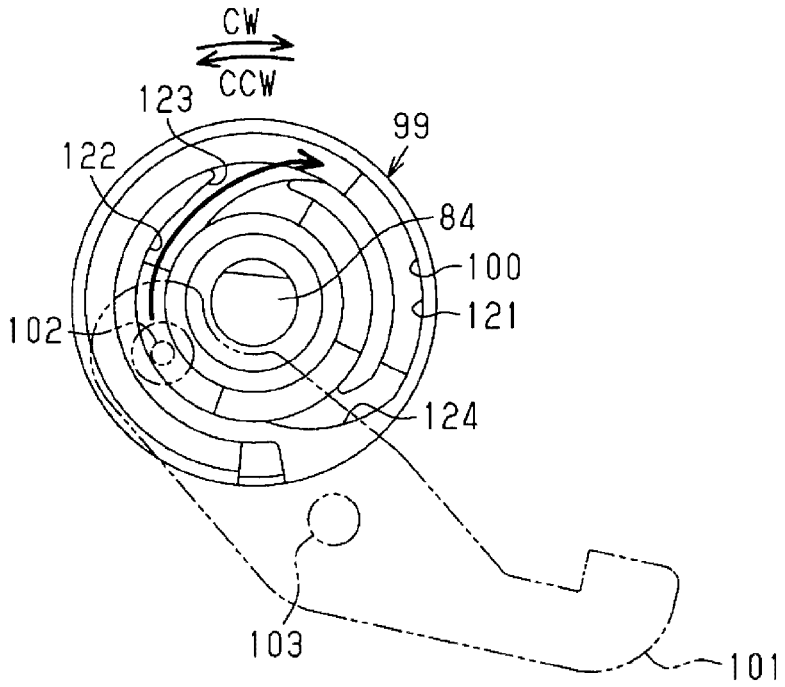
FIG. 24 is a side view illustrating a state in which the second cam disposes the cap pressing lever at a set position.

Next, an operation of the cap pressing lever 101 by the second cam 99 will be described with reference to FIGS. 24 and 25. FIG. 24 illustrates a state in which the cap pressing lever 101 is disposed at the reset position, and FIG. 25 illustrates a state in which the cap pressing lever 101 is disposed at the set position.

Figure 25:
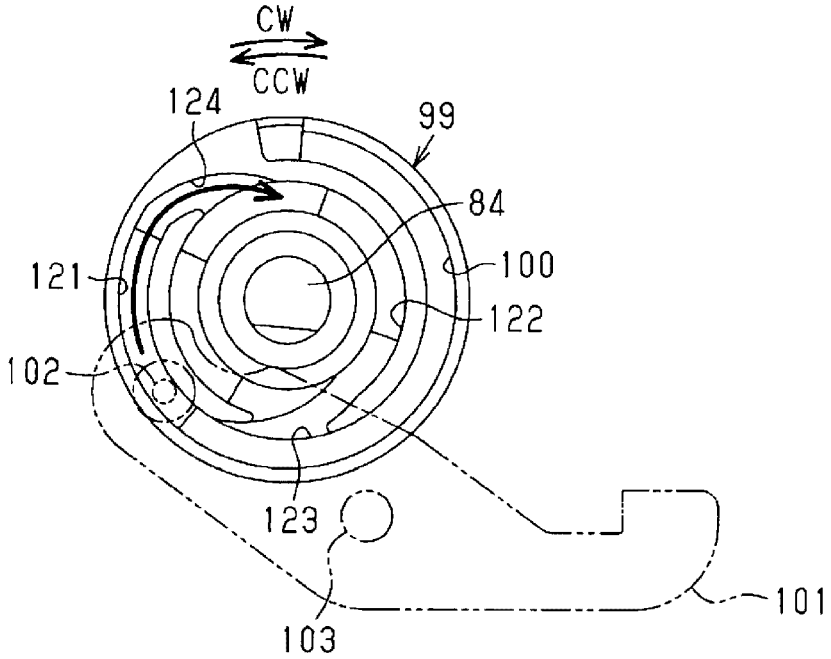
FIG. 25 is a side view illustrating a state in which the second cam disposes the cap pressing lever at a reset position.

As illustrated in FIGS. 24 and 25, the cam groove 100 of the second cam 99 is provided with a first cam groove portion 121 passing on an outer circumferential side of the second cam and a second cam groove portion 122 passing on an inner circumferential side of the second cam. The cam groove 100 of the second cam 99 is provided with a first connection groove portion 123 and a second connection groove portion 124 which are connected to the first cam groove portion 121 and the second cam groove portion 122 at two positions different from each other in a circumferential direction of the second cam 99.

In a state in which the cam pin 102 of the cap pressing lever 101 is positioned in the second cam groove portion 122 of the second cam 99 on the inner circumferential side, the cap pressing lever 101 is disposed at the reset position at which the cap pressing lever does not hold the cap lifting/lowering lever 58. In a state in which the cam pin 102 is positioned in the first cam groove portion 121 of the second cam 99 on the inner circumferential side, the cap pressing lever 101 is disposed at the set position at which the cap pressing lever raises and holds the cap lifting/lowering lever 58.

When the second cam 99 rotates in a counterclockwise direction CCW from the state illustrated in FIG. 24, the cam pin 102 moves in a clockwise direction CW. To be more specific, the cam pin 102 moves along the cam groove 100 as illustrated by an arrow in FIG. 24. Consequently, the cap pressing lever 101 is disposed at the set position illustrated in FIG. 25.

When the second cam 99 rotates in the counterclockwise direction CCW from the state illustrated in FIG. 25, the cam pin 102 moves in the clockwise direction CW. To be more specific, the cam pin 102 moves along the cam groove 100 as illustrated by an arrow in FIG. 25. Consequently, the cap pressing lever 101 is disposed at the reset position illustrated in FIG. 24.

Next, an opening/closing operation of the atmosphere-open valve 78 that is performed by rotating the first cam 91 will be described.

Figure 26:
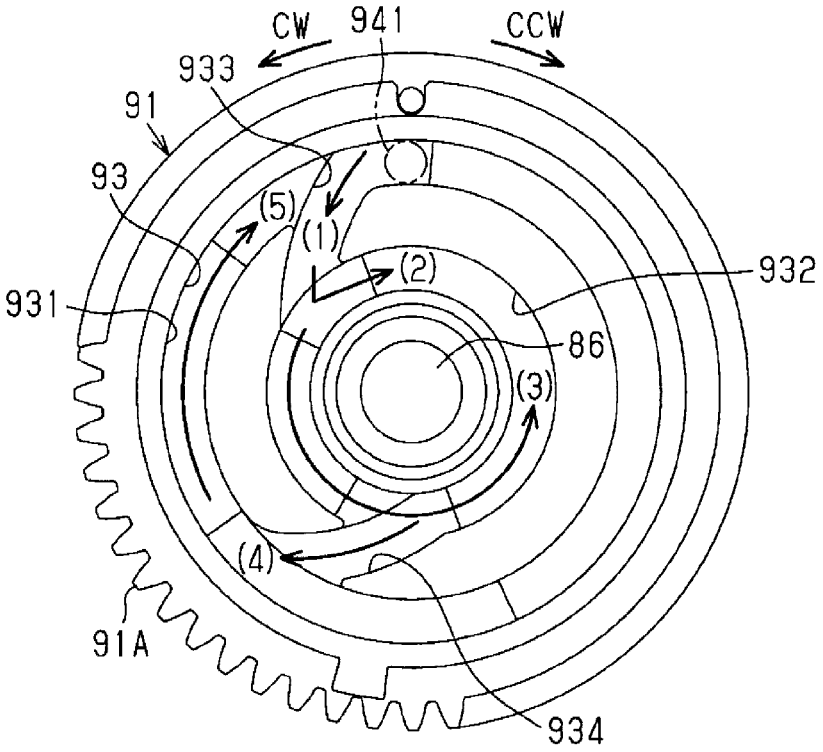
FIG. 26 is a side view illustrating a cam groove of a first cam.

As illustrated in FIG. 26, the cam pin 941 of the oscillation member 94 (refer to FIG. 11) is fitted into the cam groove 93 of the first cam 91. The cam groove 93 is provided with a first cam groove portion 931 passing on an outer circumferential side of the first cam 91 and a second cam groove portion 932 passing on an inner circumferential side of the first cam 91. The cam groove 93 is provided with a first connection groove portion 933 and a second connection groove portion 934 which are connected to the first cam groove portion 931 and the second cam groove portion 932 at two positions different from each other in a circumferential direction of the first cam 91.

A position of the cam pin 941 represented by a two-dot chain line in FIG. 26 is a position to which the first cam 91 is guided by the cam groove 93 when the rotation angle is 0°. When the first cam 91 rotates in the clockwise direction CW, the cam pin 941 moves in the counterclockwise direction CCW. When the first cam 91 rotates in the counterclockwise direction CCW, the cam pin 941 relatively moves in the clockwise direction CW.

The control unit 37 controls the electric motor 71 and rotates the first cam 91 in the clockwise direction CW and the counterclockwise direction CCW so as to control the rotation angle of the first cam 91. The control unit 37 controls the rotation angle of the first cam 91 and moves the cam pin 941 in routes of (1) to (5) represented by arrows in FIG. 26, for example. The oscillation member 94 is disposed at a valve closed position when the cam pin 941 is positioned in the first cam groove portion 931 on the outer circumferential side of the first cam 91, and thus the atmosphere-open valve 78 is closed. The oscillation member 94 is disposed at a valve opening position when the cam pin 941 is positioned in the second cam groove portion 932 on the inner circumferential side of the first cam 91, and thus the atmosphere-open valve 78 is opened.

Next, a turning operation of the cap pressing lever 101 which is performed by rotating the second cam 99 will be described.

Figure 27:
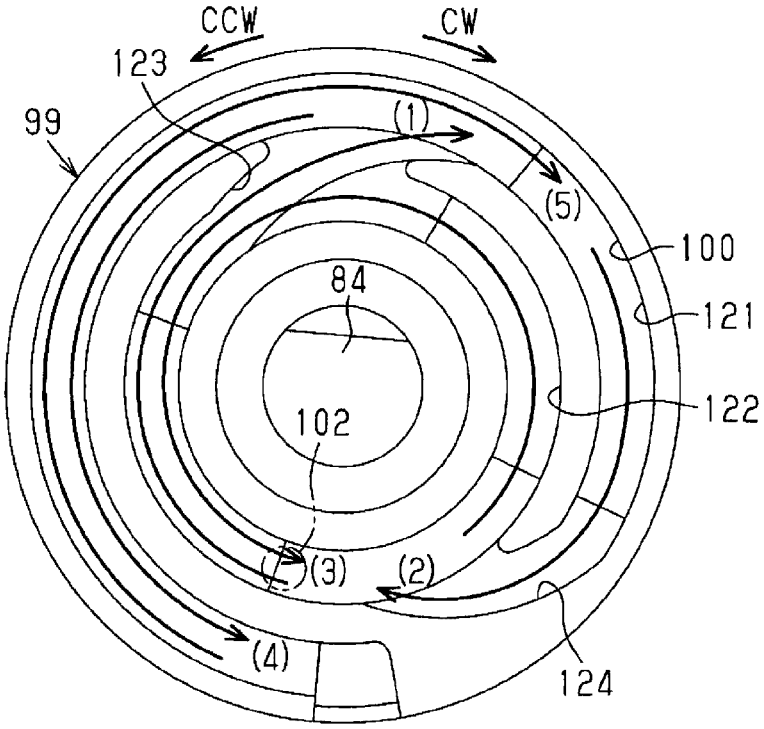
FIG. 27 is a side view illustrating a cam groove of the second cam.

As illustrated in FIG. 27, the cam pin 102 of the cap pressing lever 101 is fitted into the cam groove 100 of the second cam 99. As described above, the cam groove 100 is provided with the first cam groove portion 121, the second cam groove portion 122, and the first and second connection groove portions 123 and 124.

A position of the cam pin 102 represented by a two-dot chain line in FIG. 27 is a position to which the first cam 91 is guided by the cam groove 100 when the rotation angle is 0°. In the embodiment, the second cam 99 rotates when the first cam 91 has a range of rotation angle of 205° to 310°. Therefore, when the first cam 91 has the rotation angle in a range of 0° to 205°, the cam pin 102 is disposed at a position represented by the two-dot chain line in FIG. 27. When the second cam 99 rotates in the clockwise direction CW in a range of the rotation angle of the first cam 91 of 205° to 310°, the cam pin 102 moves in the counterclockwise direction CCW. When the second cam 99 rotates in the counterclockwise direction CCW in a range of the rotation angle of the first cam 91 of 205° to 310°, the cam pin 102 moves in the clockwise direction CW.

The control unit 37 controls the electric motor 71 and rotates the second cam 99 in the clockwise direction CW and the counterclockwise direction CCW so as to control the rotation angle of the second cam 99. The control unit 37 controls the rotation angle of the second cam 99 and moves the cam pin 102 in the routes of (1) to (5) represented by arrows in FIG. 27, for example. The cap pressing lever 101 is disposed at the reset position when the cam pin 102 is positioned in the second cam groove portion 122 on the inner circumferential side of the second cam 99 (refer to FIG. 24). The cap pressing lever 101 is disposed at the set position when the cam pin 102 is positioned in the first cam groove portion 931 on the outer circumferential side of the second cam 99 (refer to FIG. 25).

The control unit 37 executes a program for maintenance control stored in a memory and controls rotation of the electric motor 71. The control unit 37 controls the rotation angle of the first cam 91 and the second cam 99, thereby, controls drive of the cap 51, the wiper 61, the lock member 73, the atmosphere-open valve 78, or the like. The control unit 37 drives the electric motor 71 in reverse such that the suction pump 75 is driven when a predetermined suction drive period comes.

The maintenance device 36 of the embodiment includes an encoder (not illustrated), for example a rotary encoder, which outputs an encoder signal including a number of pulses in proportion to the rotation amount of the electric motor 71. The control unit 37 performs counting by adding or subtracting the number of pulse edges of the encoder signal which is input from the encoder depending on the rotation direction of the electric motor 71 and detects the rotation angle of the first cam 91 based on the counted value. The control unit 37 controls the electric motor 71 based on the detected rotation angle of the first cam 91 and controls the rotation angles of the first cam 91 and the second cam 99.

Next, a configuration of the cap 51 will be described.

Figure 28:
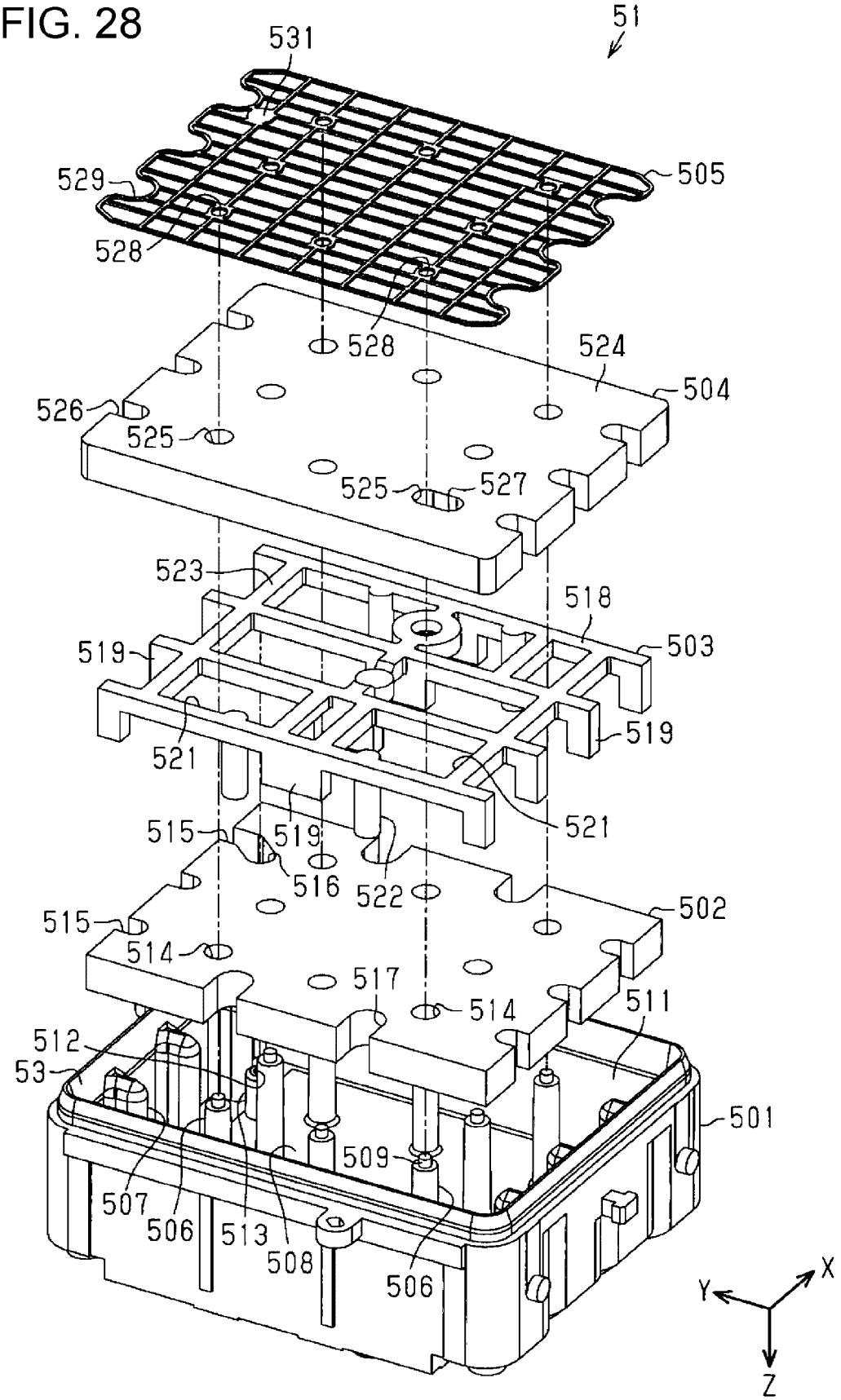
FIG. 28 is an exploded perspective view of the cap.

As illustrated in FIG. 28, the cap 51 has a capping member 501, a liquid absorber 502, a space forming member 503, a reception member 504, and a regulation member 505. The capping member 501 is configured to have a case shape of which an upper portion is opened and is attached to the cap holder 52. The capping member 501 of the embodiment is opened in an elongated shape. Therefore, the opening part of the capping member 501 in the embodiment has an elongated side part and a short side part.

The capping member 501 is capable of accommodating the liquid absorber 502, the space forming member 503, the reception member 504, and the regulation member 505 in an overlapping state vertically. In other words, the capping member 501 has an accommodation space in which the liquid absorber 502, the space forming member 503, the reception member 504, and the regulation member 505 can be accommodated. The capping member 501 houses the liquid absorber 502, the space forming member 503, the reception member 504, and the regulation member 505 in this order from below.

The capping member 501 has a fixing column 506 and a fixed rib 507 for fixing various types of members to be accommodated. The fixing column 506 extends upward from an inner bottom surface 508 of the capping member 501. Eight fixing columns 506 of the embodiment are disposed to surround a central part on the inner bottom surface 508 of the capping member 501. The fixing column 506 is provided with a protrusion having a protrusion 509 having a small diameter at a distal end of the fixing column.

The fixed rib 507 is provided to extend to the inner bottom surface 508 and an inner side surface 511 of the capping member 501 and extends upward from the inner bottom surface 508 along the inner side surface 511. Since the capping member 501 of the embodiment is opened in an elongated shape, the capping member has four inner side surfaces 511 which are continuous to each of the elongated side part and the short side part. The three fixed ribs 507 of the embodiment are provided on each of the two inner side surfaces 511 that are each continuous to the short side part of an opening part in the capping member 501.

The capping member 501 is provided with an atmosphere communicating hole 512 for opening the accommodation space that is an internal space of the capping member to the atmosphere. The atmosphere communicating hole 512 enables the accommodation space of the capping member 501 to communicate with the outside. The atmosphere communicating hole 512 is provided to enable the inside of the cap 51 to communicate with the outside.

The capping member 501 has an atmosphere communicating tube 513 to which the atmosphere communicating hole 512 is open. The atmosphere communicating tube 513 extends vertically to penetrate a bottom portion of the capping member 501. A part of the atmosphere communicating tube 513 extends upward from the inner bottom surface 508 of the capping member 501.

The atmosphere communicating tube 513 is positioned on an outer side of a region surrounded by the fixing columns 506 on the inner bottom surface 508 of the capping member 501. The atmosphere communicating hole 512 is open at a position close to the inner side surface 511 on the inner bottom surface 508 of the capping member 501.

The capping member 501 has the sealing portion 53. The sealing portion 53 is provided in the capping member 501 so as to extend from an opening part to the inner side surface 511 of the capping member. Therefore, the inner side surface 511 and the fixed rib 507 of the capping member 501 are covered with the sealing portion 53. The sealing portion 53 comes into contact with the nozzle-formed surface 271 of the liquid ejecting head 27 during the capping, and thereby the accommodation space of the capping member 501 can be sealed.

For example, the liquid absorber 502 is made of a porous resin material such as urethane and is disposed on the inner bottom surface 508 of the capping member 501. The liquid absorber 502 is capable of absorbing a liquid that is ejected from the nozzles 272 of the liquid ejecting head 27. The liquid absorber 502 of the embodiment is formed to have a plate shape, and an edge part thereof is provided to be formed along the inner side surface 511 of the capping member 501. Therefore, the liquid absorber 502 has the elongated side part and the short side part as the edge parts thereof.

The liquid absorber 502 is provided with an insertion hole 514 into which the fixing column 506 is inserted. The insertion holes 514 penetrate the liquid absorber 502 vertically and are provided to correspond to the number of fixing columns 506. Therefore, eight insertion holes 514 of the embodiment are disposed to surround the central part in the liquid absorber 502.

The liquid absorber 502 is provided with a cutout groove 515 into which the fixed rib 507 is fitted. The cutout groove 515 is provided in the edge part of the liquid absorber 502 and is formed by cutting out a part of the edge part thereof. The cutout grooves 515 are provided to correspond to the number of the fixed ribs 507, and three cutout grooves are provided in the short side part of the liquid absorber 502 in the embodiment.

The liquid absorber 502 has an insertion portion 516 into which the atmosphere communicating tube 513 extending upward from the inner bottom surface 508 is inserted. The insertion portion 516 penetrates the liquid absorber 502 vertically and is positioned at a position corresponding to the atmosphere communicating tube 513. The atmosphere communicating tube 513 that is inserted into the insertion portion 516 penetrates the liquid absorber 502 through the insertion portion 516. The insertion portion 516 of the embodiment is positioned on the outer side of the region surrounded by the insertion holes 514 in the liquid absorber 502. The insertion portion 516 of the embodiment is provided to be continuous to one cutout groove 515 of the plurality of cutout grooves 515. The insertion portion 516 may be a groove or a hole.

The liquid absorber 502 is provided with a fixing groove 517 to which the space forming member 503 is fixed. The fixing groove 517 is provided in the edge part of the liquid absorber 502 and is formed by cutting out a part of the edge part thereof. A plurality of fixing grooves 517 of the embodiment are provided and two fixing grooves are formed in each of the elongated side parts of the liquid absorber 502.

The space forming member 503 is disposed above the liquid absorber 502. The space forming member 503 has a grid part 518 having a grid shape and a leg portion 519 that supports the grid part 518. The grid part 518 is formed such that a plurality of columns extending in both of the width direction X and the transport direction Y intersect each other. Therefore, the grid part 518 is provided with a plurality of openings 521. The fixing columns 506 are inserted into the plurality of respective openings 521.

The leg portion 519 extends from the grid part 518 in the vertical direction Z (vertically downward orientation). The plurality of leg portions 519 are provided, and 12 leg portions are provided in the embodiment. A lower end of the leg portion 519 comes into contact with a top surface of the liquid absorber 502. The leg portion 519 is disposed at a position at which the insertion hole 514, the cutout groove 515, and the fixing groove 517 of the liquid absorber 502 do not overlap each other vertically.

The space forming member 503 is provided with a rod 522 that is inserted into the fixing groove 517 of the liquid absorber 502. The rod 522 is provided at a position corresponding to the fixing groove 517 and extends downward from the grid part 518. In the embodiment, four rods 522 are provided to correspond to the number of the fixing grooves 517. The rod 522 is inserted into the fixing groove 517, and thereby the space forming member 503 is fixed to the liquid absorber 502.

The space forming member 503 has a suppressing portion 523. The suppressing portion 523 is positioned closer to a side of the reception member 504 than to an upper end of the atmosphere communicating tube 513. The suppressing portion 523 suppresses flow of a fluid from the atmosphere communicating hole 512 toward the reception member 504. In the embodiment, a part of the grid part 518 which overlaps the atmosphere communicating hole 512 vertically is set as the suppressing portion 523. Therefore, the suppressing portion 523 also overlaps the insertion portion 516 of the liquid absorber 502 vertically.

The reception member 504 is supported by the space forming member 503. Therefore, the reception member 504 is disposed at an interval from the liquid absorber 502 in the capping member 501. An undersurface of the reception member 504 comes into contact with the grid part 518 of the space forming member 503.

The reception member 504 has a reception surface 524 for receiving the liquid that is discharged from the nozzles 272 of the liquid ejecting head 27. The reception surface 524 is the top surface of the reception member 504. The reception member 504 is formed to have a plate shape, and an edge part thereof is provided to be formed along the inner side surface 511 of the capping member 501. Therefore, the reception member 504 has an elongated side part and a short side part as the edge parts thereof.

The reception member 504 is provided with an insertion hole 525 into which the fixing column 506 is inserted. The insertion holes 525 penetrate the reception member 504 vertically and are provided to correspond to the number of fixing columns 506. Therefore, eight insertion holes 525 of the embodiment are disposed to surround the central part in the reception member 504. The insertion hole 525 of the reception member 504 overlaps the insertion hole 514 of the liquid absorber 502 vertically.

The reception member 504 is provided with a cutout groove 526 into which the fixed rib 507 is fitted. The cutout groove 526 is provided in the edge part of the reception member 504 and is formed by cutting out a part of the edge part thereof. The cutout grooves 526 are provided to correspond to the number of the fixed ribs 507, and three cutout grooves are provided in the short side part of the reception member 504 in the embodiment.

Similar to the liquid absorber 502, the reception member 504 is, preferably, formed to be capable of absorbing the liquid. Therefore, the reception member 504 is preferably made of a porous resin material such as urethane. The reception member 504 may be made of a resin material that does not absorb the liquid or may be made of metal without being limited to the resin.

The reception member 504 is provided with a through-hole 527 through which a space that is positioned above the reception member 504 communicates with a space that is positioned below the reception member 504, in the accommodation space of the capping member 501. The through-hole 527 penetrates the reception member 504 vertically. Therefore, the through-hole 527 is open to the reception surface 524 of the reception member 504. The through-hole 527 of the embodiment also serves as the insertion hole 525. In the embodiment, one insertion hole 525 of the plurality of insertion holes 525 that are provided in the reception member 504 is an elongated hole extending in the transport direction Y. The insertion hole 525 that is provided as the elongated hole may be the through-hole 527.

The fixing column 506 that is inserted into the through-hole 527 penetrates the reception member 504 through the through-hole 527. Since the through-hole 527 is the elongated hole, the through-hole is open in a size larger than a diameter of the inserted fixing column 506. Therefore, even in a state in which the fixing column 506 is inserted into the through-hole 527, the through-hole allows the space positioned above the reception member 504 to communicate with the space positioned below the reception member 504. The through-hole 527 is not limited to a configuration in which the through-hole also serves as the insertion hole 525 and may be provided separately from the insertion hole 525.

The regulation member 505 is provided as a mesh-like material. The regulation member 505 is provided with a hole 528 into which the protrusion 509 of the fixing column 506 is inserted. The holes 528 are open in a size smaller than that of the insertion holes 514 and 525 and are provided to correspond to the number of fixing columns 506. Therefore, eight holes 528 of the embodiment are disposed to surround a central part in the regulation member 505.

The protrusion 509 inserted into the hole 528 is crimped by heat, and thereby the regulation member 505 is fixed to the capping member 501. Consequently, detachment of the liquid absorber 502, the space forming member 503, and the reception member 504, which are positioned between the regulation member 505 and the inner bottom surface 508 of the capping member 501, from the capping member 501 is suppressed.

Figure 29:
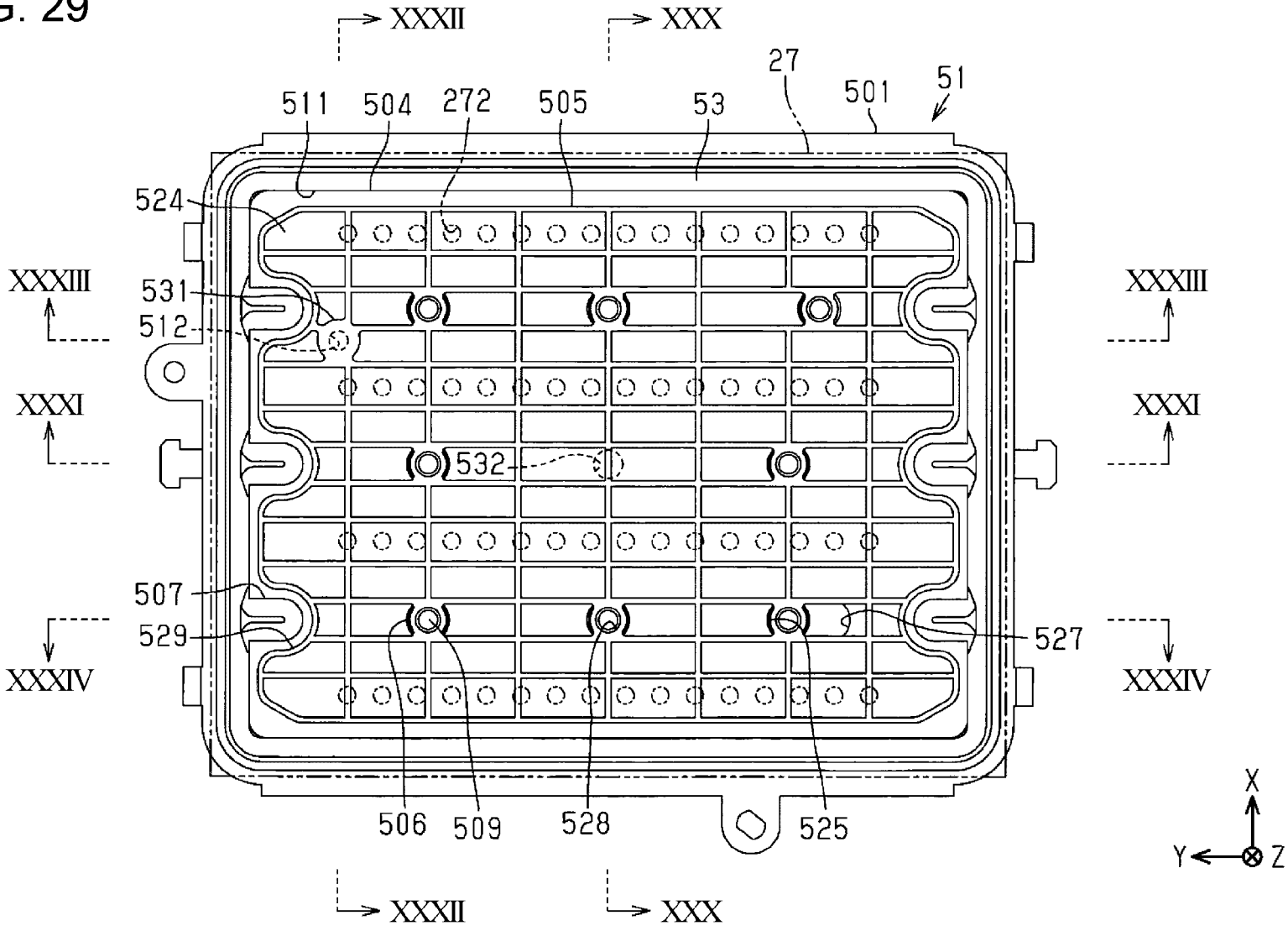
FIG. 29 is a top view of the cap.

As illustrated in FIGS. 28 and 29, the regulation member 505 is provided with a recess 529. The recess 529 is provided in an edge part of the regulation member 505 and is formed to be recessed toward an inner side from the edge part thereof. The recess 529 has a shape for avoiding interference between the regulation member 505 and the fixed rib 507. The recesses 529 are provided to correspond to the number of the fixed ribs 507, and six recesses are provided in the embodiment.

The regulation member 505 has a cover portion 531. The cover portion 531 is positioned at a position of overlapping the atmosphere communicating hole 512 in a case where the cap 51 is viewed from a side of the reception surface 524, that is, in a case where the cap 51 is viewed from above. The cover portion 531 covers the atmosphere communicating hole 512 from above. The cover portion 531 of the embodiment is provided to have a circular plate shape and is positioned at a position of overlapping the atmosphere communicating hole 512 vertically. The cover portion 531 overlaps the atmosphere communicating hole 512, the insertion portion 516, and the suppressing portion 523 vertically. Therefore, the cover portion 531 is positioned on an outer side of a region surrounded by the holes 528 in the regulation member 505.

As illustrated in FIG. 29, the through-hole 527 is provided in the reception member 504 at a position that is not opposite to the nozzles 272 of the liquid ejecting head 27. Two-dot chain lines in FIG. 29 represent the liquid ejecting head 27 and the nozzles 272 which are positioned at the maintenance position. In other words, the through-hole 527 is open in the reception surface 524 of the reception member 504 at the position that is not opposite to the liquid ejecting head 27 and the nozzles 272 which are positioned at the maintenance position.

The liquid ejecting head 27 of the embodiment is provided with four rows of nozzles in a configuration in which the plurality of nozzles 272 are aligned in the transport direction Y. The nozzles 272 are positioned not to be opposite to the fixing column 506, the fixed rib 507, the cover portion 531, or the like, at the maintenance position. Consequently, the reception surface 524 can effectively receive the liquid that is discharged from the nozzles 272.

Figure 30:
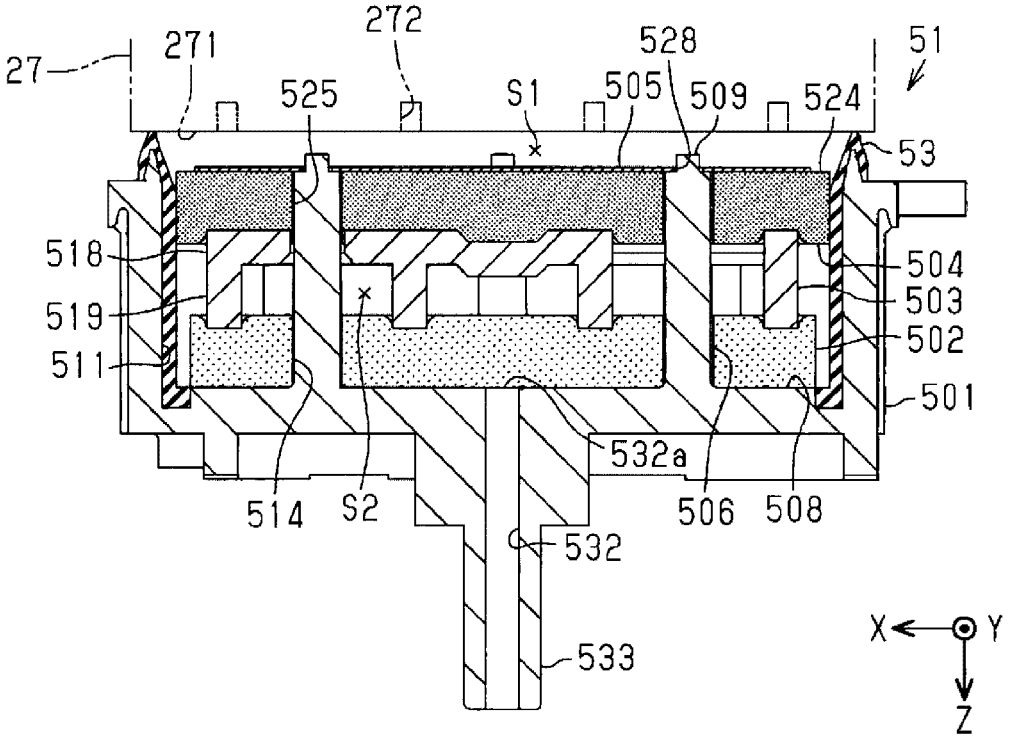
FIG. 30 is a sectional view taken along line arrow XXX-XXX in FIG. 29.
Figure 31:
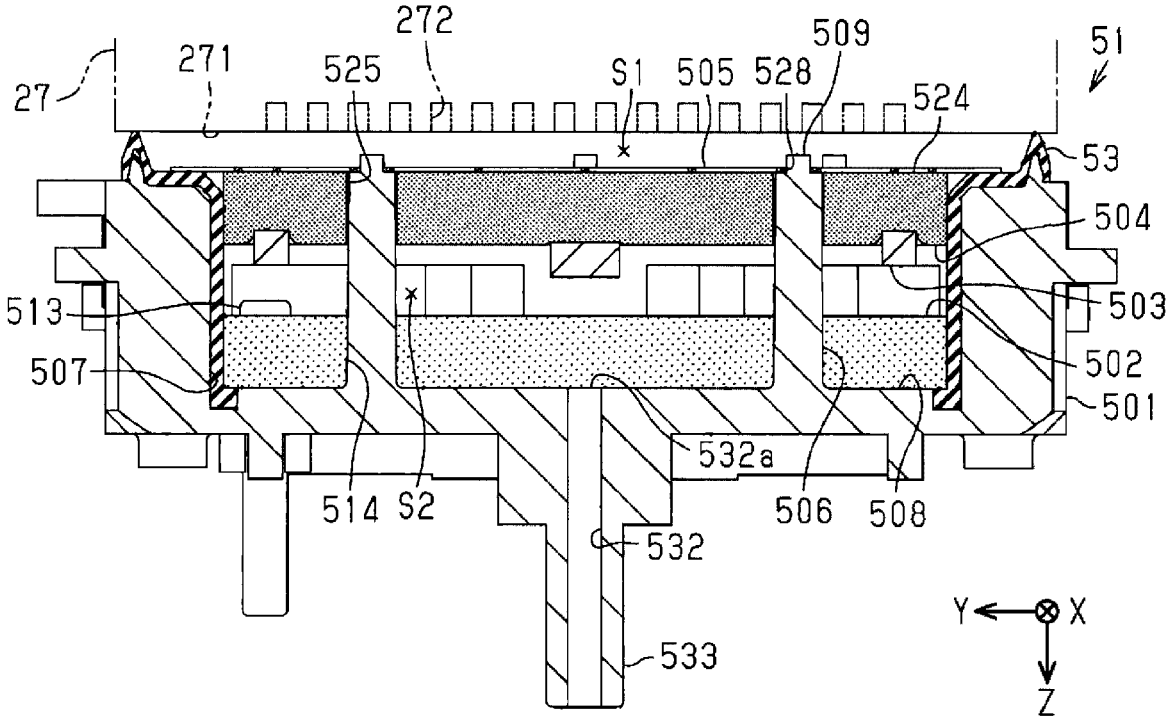
FIG. 31 is a sectional view taken along line arrow XXXI-XXXI in FIG. 29.

As illustrated in FIGS. 29, 30, and 31, the capping member 501 is provided with a suction hole 532 that is capable of suctioning the fluid in the accommodation space. The suction hole 532 is open to the inner bottom surface 508 of the capping member 501 and allows the inside and outside of the capping member 501 to communicate with each other. In other words, the suction hole 532 has an opening 532*a* in the inner bottom surface 508 of the capping member 501. The suction hole 532 is capable of suctioning the fluid in the cap 51.

The opening 532*a* of the suction hole 532 which is formed in the inner bottom surface 508 comes into contact with a part of the liquid absorber 502 that is disposed on the inner bottom surface 508. In other words, the liquid absorber 502 is disposed inside the capping member 501 so as to come into contact with at least a part of the opening 532*a* of the suction hole 532. The suction hole 532 is open to the central part of the inner bottom surface 508. Therefore, the opening 532*a* of the suction hole 532 is disposed within the region surrounded by the fixing columns 506 in the inner bottom surface 508.

The capping member 501 has the suction tube 533 to which the suction hole 532 is open. The suction tube 533 extends downward from the bottom portion of the capping member 501 and is connected to the suction pump 75 via the tube for suction. When the suction pump 75 is driven, the suction cleaning of suctioning the liquid from the nozzles 272 or the idle suction of discharging the liquid in the cap 51 is performed.

When the cap 51 performs capping of the liquid ejecting head 27, a first space S1, to which the nozzles 272 are open, is formed in the cap 51. In other words, the cap 51 surrounds and forms the first space S1 to which the nozzles 272 are open when the cap comes into contact with the liquid ejecting head 27. The first space S1 is a space that is positioned closer to a side of the liquid ejecting head 27 than to the reception member 504 in a posture of the capping. In the embodiment, the first space S1 is a space that is positioned above the reception member 504 and is a space that is positioned between the liquid ejecting head 27 and the reception member 504 in the vertical direction Z.

A second space S2 different from the first space S1 is formed in the cap 51. The second space S2 is a space that is positioned closer to the side of the liquid ejecting head 27 than to the liquid absorber 502 in a posture of the capping. The reception member 504 is disposed at an interval from the liquid absorber 502 in the capping member 501, and thereby the second space S2 is formed. In the embodiment, the second space S2 is a space that is positioned below the reception member 504 and is a space that is positioned between the reception member 504 and the liquid absorber 502 in the vertical direction Z. The interval between the reception member 504 and the liquid absorber 502 is set to be larger than an interval between the nozzle-formed surface 271 and the reception surface 524 of the reception member 504 during capping. As a result, a volume of the second space S2 is larger than a volume of the first space S1.

The first space S1 and the second space S2 are a part of the accommodation space of the capping member 501. In other words, the first space S1 and the second space S2 are present in the cap 51 during capping. The space forming member 503 supports the reception member 504 at a position separated from the liquid absorber 502, and thereby the second space S2 of the embodiment is formed. In other words, the space forming member 503 functions as a so-called spacer and forms the second space S2. The cap 51 may not have the space forming member 503. In this case, a projecting piece may be provided on the inner side surface 511 of the capping member 501, and the projecting piece may support the reception member 504. In this manner, the second space S2 may be formed.

Figure 32:
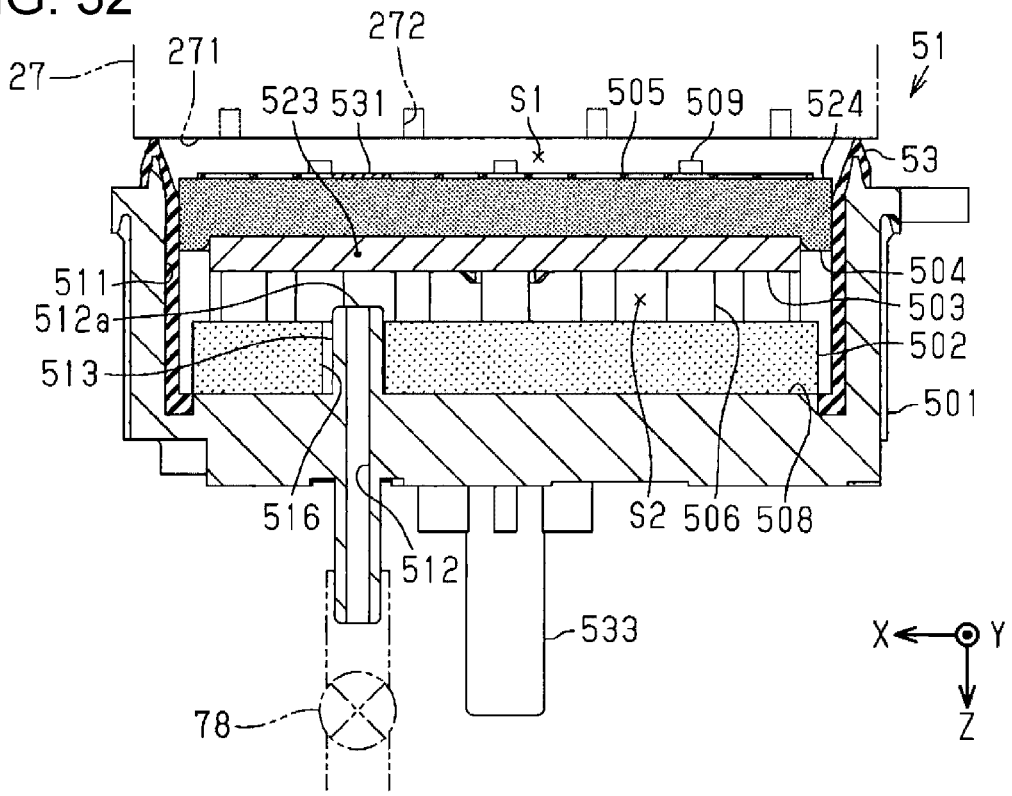
FIG. 32 is a sectional view taken along line arrow XXXII-XXXII in FIG. 29.
Figure 33:
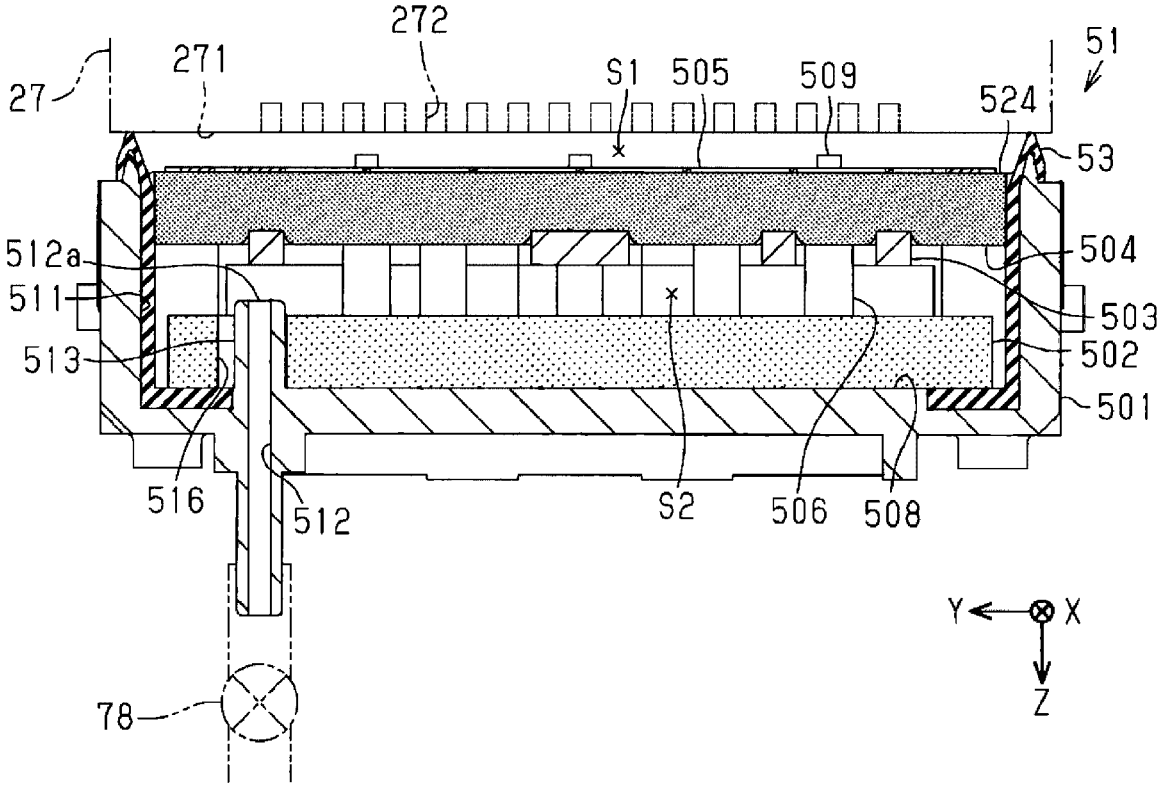
FIG. 33 is a sectional view taken along line arrow XXXIII-XXXIII in FIG. 29.

As illustrated in FIGS. 32 and 33, the atmosphere communicating tube 513 extends such that an upper end thereof is positioned in the second space S2. The atmosphere communicating hole 512 is provided with an opening 512*a* at a distal end thereof, which is an upper end of the atmosphere communicating tube 513 extending from the inner bottom surface 508 of the capping member 501. Therefore, the atmosphere communicating hole 512 is open to the second space S2. The atmosphere-open valve 78 is attached to a lower end of the atmosphere communicating tube 513.

The upper end of the atmosphere communicating tube 513 is positioned at a position closer to the liquid absorber 502 than to the reception member 504 in the second space S2. In other words, a distance from the distal end of the atmosphere communicating tube 513 and the liquid absorber 502 is shorter than a distance between the atmosphere communicating tube 513 and the reception member 504. Therefore, the opening 512*a* of the atmosphere communicating hole 512 which is positioned in the second space S2 is formed at a position at which a distance to the liquid absorber 502 is shorter than a distance to the reception member 504. The atmosphere communicating hole 512 is open at a position closer to the liquid absorber 502 than to the reception member 504 in the second space S2.

The suppressing portion 523 is positioned closer to the side of the reception member 504 than to the opening 512*a* of the atmosphere communicating hole 512. The suppressing portion 523 of the embodiment is positioned above the opening 512*a* of the atmosphere communicating hole 512. Therefore, the suppressing portion 523 suppresses the flow of the fluid from the opening 512*a* of the atmosphere communicating hole 512 toward the reception member 504.

The cover portion 531 is positioned above the suppressing portion 523. Therefore, the cover portion 531 is positioned above the opening 512*a* of the atmosphere communicating hole 512. The cover portion 531 is positioned at a position of overlapping the opening 512*a* of the atmosphere communicating hole 512 in a case where the cap 51 is viewed from the side of the reception surface 524, that is, in a case where the cap 51 is viewed from above. The cover portion 531 covers the opening 512*a* of the atmosphere communicating hole 512.

Figure 34:
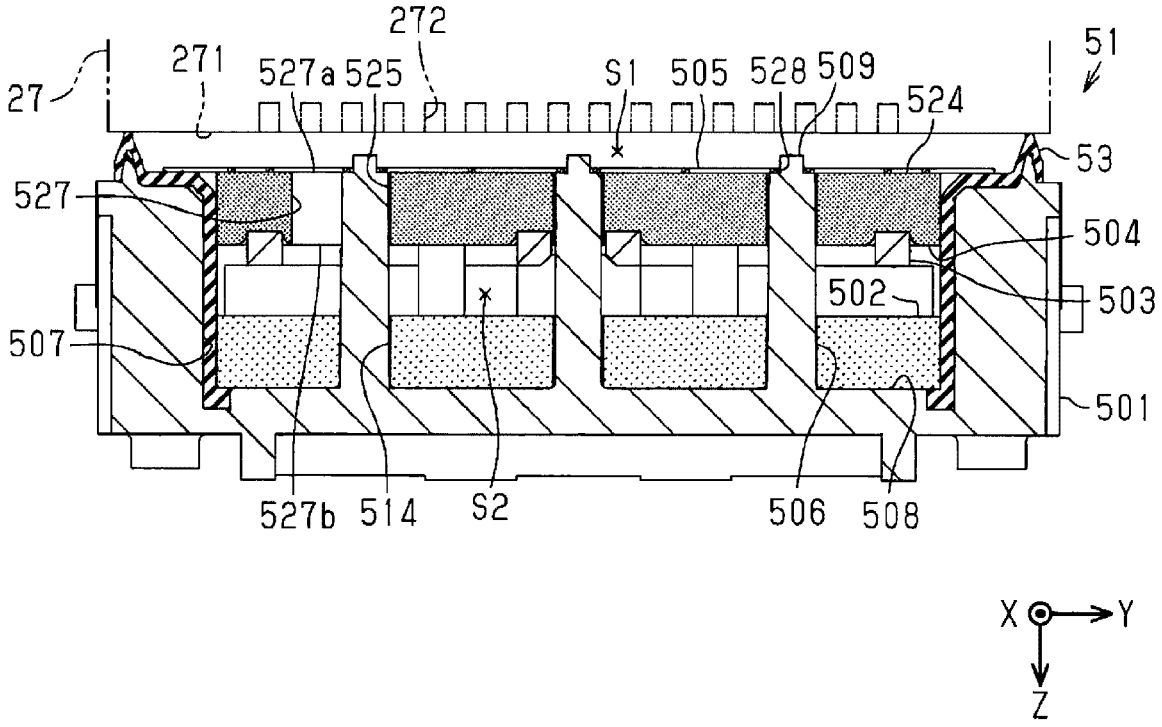
FIG. 34 is a sectional view taken along line arrow XXXIV-XXXIV in FIG. 29.

As illustrated in FIG. 34, the through-hole 527 of the reception member 504 allows the first space S1 to communicate with the second space S2. Therefore, the through-hole 527 has an opening 527*a* that is position on a side of the first space S1 and an opening 527*b* that is positioned on a side of the second space S2. The opening 527*a* is formed in the reception surface 524. The through-hole 527 allows the first space S1 to communicate with the second space S2.

The opening 527*a* of the through-hole 527 on the side of the first space S1 is provided at a position that is not opposite to the nozzles 272 during capping. In the embodiment, similar to the through-hole 527, the fixing column 506, the fixed rib 507, and the cover portion 531 are provided at a position that is not opposite to the nozzles 272.

As illustrated in FIG. 29, the atmosphere communicating hole 512 and the through-hole 527 are diagonally positioned with the suction hole 532 interposed therebetween when the cap 51 is viewed from above. Therefore, the through-hole 527 does not overlap the atmosphere communicating hole 512 vertically. The opening 527*b* of the through-hole 527 on the side of the second space S2 is provided at a position that is not opposite to the opening 512*a* of the atmosphere communicating hole 512.

The through-hole 527 is positioned at a position more separated from the atmosphere communicating hole 512 than from the suction hole 532. A distance between the through-hole 527 and the atmosphere communicating hole 512 is longer than a distance between the suction hole 532 and the atmosphere communicating hole 512. In particular, the opening 527*b* of the through-hole 527 on the side of the second space S2 is provided at a position that is more separated from the opening 512*a* of the atmosphere communicating hole 512 than from the opening 532*a* of the suction hole 532.

Next, operations of the cap 51 configured as described above and the liquid ejecting apparatus 11 that includes the cap 51 will be described.

When the suction cleaning is executed on the liquid ejecting head 27, the suction pump 75 is driven in a state in which the cap 51 performs capping of the liquid ejecting head 27. When the suction pump 75 is driven, the fluid in the capping member 501 51 is suctioned from the suction hole 532. In this case, the fluid in the accommodation space is suctioned through a gap in the cap 51 such as a cell of the liquid absorber 502 made of the porous resin material, the insertion holes 514 and 525, the cutout grooves 515 and 526, the fixing groove 517, and a gap between the reception member 504 and the inner side surface 511. Therefore, when the suction hole 532 performs the suctioning, a load is imposed to the entire accommodation space of the capping member 501 including the first space S1 and the second space S2. In other words, the suction hole 532 is capable of suctioning the fluid in the first space S1 and the second space S2.

When the liquid is discharged from the nozzles 272 into the cap 51 due to a load generated by the driving of the suction pump 75, the liquid is received by the reception surface 524 of the reception member 504. The liquid received by the reception surface 524 flows toward the suction hole 532 through the gap in the above-described cap 51.

A part of the liquid discharged from the nozzles 272 by the suction cleaning is absorbed to the liquid absorber 502 and is held. When the idle suction is executed after the suction cleaning is executed, the liquid held in the liquid absorber 502 is discharged from the inside of the cap 51. The liquid discharged in the cap 51 during suction cleaning is effectively discharged from the suction hole 532 via the liquid absorber 502.

When the idle suction is executed, the atmosphere-open valve 78 is opened, and thereby the atmosphere communicating hole 512 allows the inside of the cap 51 to communicate with the atmosphere. After the suction cleaning is executed, a pressure in the cap 51 becomes a negative pressure. Therefore, when the atmosphere-open valve 78 is opened, a gas flows swiftly into the cap 51 from the atmosphere communicating hole 512 in some cases. When the gas flows swiftly into the cap 51, there is a concern that the gas will flow to the nozzles 272. When the gas flows into the nozzles 272, bubbles are generated in the nozzles 272, and the bubbles can cause defective ejection of the nozzles 272 that eject the liquid.

In this respect, in the embodiment, the atmosphere communicating hole 512 is open to the second space S2 that is different from the first space S1 to which the nozzles 272 are open. Even when the fluid flows swiftly from the atmosphere communicating hole 512 to the second space S2 by opening the atmosphere-open valve 78, the first space S1 and the second space S2 are partitioned by the reception member 504. Therefore, there is less concern that the gas flowing to the second space S2 flows to the first space S1 forcibly. The gas flowing to the second space S2 flows gently to the first space S1 through the above-described gap in the cap 51. In this manner, the negative pressure in the cap 51 is canceled. Since the gas flows gently to the first space S1, it is difficult for the gas to flow to the nozzles 272.

When the liquid is discharged to the cap 51 in a case where the suction cleaning, the flushing, or the like is executed, the liquid is attached to the opening 512*a* of the atmosphere communicating hole 512 in some cases. When the gas flows in the cap 51 from the atmosphere communicating hole 512, the liquid attached to the opening 512*a* of the atmosphere communicating hole 512 is scattered or foams. When the liquid is attached to the nozzle-formed surface 271 of the liquid ejecting head 27 due to scattering, foaming, or the like of the liquid, or the liquid enters the nozzles 272, defective ejection of the nozzles 272 occurs. In this respect, in the embodiment, the first space S1 and the second space S2 are partitioned by the reception member 504. Therefore, even though the liquid attached to the opening 512*a* of the atmosphere communicating hole 512 is scattered or foams, the liquid is accumulated in the second space S2.

According to the embodiments described above, it is possible to obtain the following effects.

(1) For example, when the inside of the cap 51 is opened to the atmosphere through the atmosphere communicating hole 512 that is to execute the idle suction after the suction cleaning of suctioning the liquid from the nozzles 272 by causing the pressure in the inside of the cap 51 to become the negative pressure, the gas flows swiftly from the atmosphere communicating hole 512 to the inside of the cap 51. When the gas flows swiftly into the cap 51 through the atmosphere communicating hole 512, there is a concern that the gas will flow to the nozzles 272.

In this respect, in the embodiment, the second space S2, to which the atmosphere communicating hole 512 is open, and the first space S1, to which the nozzles 272 are open, are partitioned by the reception member 504 in the cap 51. Therefore, the gas flowing to the inside of the cap 51 through the atmosphere communicating hole 512 is prevented from flowing swiftly to the first space S1. Consequently, it is possible to reduce a concern that the gas will flow to the nozzles 272. Hence, it is possible to reduce an occurrence of the defective ejection.

(2) The atmosphere communicating hole 512 is open at a position closer to the liquid absorber 502 than to the reception member 504 in the second space S2. Therefore, the gas flowing to the inside of the cap 51 through the atmosphere communicating hole 512 is further prevented from flowing swiftly to the first space S1. Consequently, it is possible to reduce the concern that the gas will flow to the nozzles 272.

(3) The reception member 504 is provided with the through-hole 527. Therefore, the liquid received by the reception surface 524 can drop through the through-hole 527. Consequently, the liquid that is received by the reception member 504 can effectively flow toward the liquid absorber 502.

(4) The opening 527*b* of the through-hole 527 on the side of the second space S2 is provided at the position that is not opposite to the opening 512*a* of the atmosphere communicating hole 512. In this manner, the distance from the through-hole 527 to the atmosphere communicating hole 512 more increases in the second space S2, compared to a case where the opening 527*b* of the through-hole 527 on the side of the second space S2 is opposite to the opening 512*a* of the atmosphere communicating hole 512. Therefore, the gas flowing to the inside of the cap 51 through the atmosphere communicating hole 512 is prevented from passing swiftly through the through-hole 527. In other words, the gas flowing to the inside of the cap 51 is prevented from flowing swiftly toward the first space S1. Consequently, it is possible to reduce the concern that the gas will flow to the nozzles 272.

(5) The opening 527*a* of the through-hole 527 on the side of the first space S1 is provided at a position that is not opposite to the nozzles 272 during the capping. In this manner, the distance from the through-hole 527 to the nozzles 272 more increases in the first space S1, compared to a case where the opening 527*a* of the through-hole 527 on the side of the first space S1 is opposite to the nozzles 272. Therefore, it is possible to reduce the concern that the gas flowing into the first space S1 through the through-hole 527 will flow to the nozzles 272.

(6) The opening 527*b* of the through-hole 527 on the side of the second space S2 is provided at a position that is more separated from the opening 512*a* of the atmosphere communicating hole 512 than from the opening 532*a* of the suction hole 532. In this manner, the distance from the atmosphere communicating hole 512 to the through-hole 527 more increases in the second space S2, compared to a case where the opening 527*b* of the through-hole 527 on the side of the second space S2 is closer to the opening 512*a* of the atmosphere communicating hole 512 than to the opening 532*a* of the suction hole 532. In other words, since the through-hole 527 and the atmosphere communicating hole 512 are disposed to be separated from each other in the second space S2, the gas flowing to the inside of the cap 51 is prevented from flowing swiftly to the first space S1. Consequently, it is possible to reduce the concern that the gas will flow to the nozzles 272.

(7) The fixing column 506 for fixing the reception member 504 penetrates the reception member 504 through the through-hole 527. Consequently, the through-hole 527 can also serve as the hole (insertion hole 525) through which the fixing column 506 penetrates the reception member 504. Consequently, since there is no need to provide another hole (insertion hole 514) in addition to the through-hole 527 in the reception member 504, it is possible to simplify a configuration of the reception member 504. In the embodiment, the through-hole 527 also serves as one insertion hole 514 of the eight insertion holes 514. Therefore, there is no need to provide a total of nine holes of the insertion holes 514 and the through-hole 527 with respect to the eight fixing columns 506, and it is enough to provide a total of eight holes of the insertion holes 514 and the through-hole 527.

(8) The regulation member 505 has the cover portion 531 that covers the opening 512*a* of the atmosphere communicating hole 512 at the position of overlapping the opening 512*a* of the atmosphere communicating hole 512 in a case where the cap 51 is viewed from the side of the reception surface 524. Since the gas flowing into the cap 51 through the atmosphere communicating hole 512 is received by the cover portion 531, it is possible to reduce the concern that the gas will flow to the nozzles 272.

(9) The space forming member 503 has the suppressing portion 523 that is positioned closer to the side of the reception member 504 than to the opening 512*a* of the atmosphere communicating hole 512 and suppresses the flow of the fluid from the opening 512*a* of the atmosphere communicating hole 512 toward the reception member 504. Since the gas flowing into the cap 51 through the atmosphere communicating hole 512 is received by the suppressing portion 523, it is possible to reduce the concern that the gas will flow to the nozzles 272.

(10) The opening 527*b* of the through-hole 527 on the side of the second space S2 is provided at the position that is more separated from the opening of the atmosphere communicating hole 512 than from the opening of the suction hole 532. In other words, the distance between the opening 527*b* of the through-hole 527 and the opening 512*a* of the atmosphere communicating hole 512 is shorter than the distance between the opening 527*b* of the through-hole 527 and the opening 532*a* of the suction hole 532. Therefore, when suction is performed from the suction hole 532, it is easy for the suction force to occur in the through-hole 527. Consequently, when suction is performed in the cap 51, the liquid received by the reception surface 524 can effectively flow to the through-hole 527.

The embodiments described above may be modified as the following modification examples. In addition, any configuration included in the embodiment and any configuration included in the following modification example may be combined, or any configurations included in the following modification examples may be combined.

Only one fixing column 506 may be provided. The fixed rib 507 may not be provided.

The through-hole 527 is not limited to the cylindrical shape extending in the vertical direction Z, may have a shape of penetrating the reception member 504 while meandering, or may have a shape of penetrating the reception member 504 while bending. In other words, the through-hole 527 may have a shape in which the opening 527*a* on the side of the first space S1 and the opening 527*b* on the side of the second space S2 are provided at positions shifted in the vertical direction Z.

The through-hole 527 may be provided in the reception member 504. For example, the fixed rib 507 may not be provided on the capping member 501, and the cutout groove 526 may be provided instead of the through-hole 527.

The posture of the cap 51 that is positioned at the uncapping position is not limited to the posture in which the opening is directed upward. For example, the cap 51 may have a posture in which the opening is directed downward, at the uncapping position. The cap 51 may move while rotating between the uncapping position and the capping position.

The space forming member 503 is not limited to a shape of having the grid part 518 and the leg portion 519. Any shape may be employed as long as the reception member 504 is supported such that a gap is formed between the liquid absorber 502 and the reception member 504.

The wiping member (wiper 61) may not move in the direction orthogonal to the nozzle-formed surface 271 between the retreat position and the wiping position. In this case, the wiping member may be fixed to the slide member 66, or the wiper holder 65 may be fixed to the slide member 66.

The slide member 66 may be provided with the locking portion 112 (inclined surface 115), or the drive force transmitting unit (rack member 64) may be provided with the locking target portion (slide shaft 113).

In the embodiment, the wiping member (wiper 61) at the retreat position is provided at a position below a scanning region of the liquid ejecting head 27; however, the wiping member may be provided at a position that does not overlap the scanning region.

In the embodiment, the maintenance device 36 is employed in a serial printer in which the liquid ejecting head 27 performs scanning; however, the maintenance device 36 may be employed in a line printer in which the liquid ejecting head 27 does not perform the scanning. In this case, the wiping member (wiper 61) may move between the retreat position that is positioned in a region adjacent to a transport region, in which the medium M is transported, in a direction intersecting the transport direction Y and a wiping position that overlaps the transport region. In addition, the wiping member may move between the retreat position that overlaps the transport region and is adjacent to the liquid ejecting head 27 in the transport direction Y and the wiping position that overlaps the transport region.

The rotating body of the cam follower is not limited to the roller and may be a ball. Also in the configuration, even when variations in the rotation stopping position of the second cam 99 with respect to a normal stopping position occur due to variations in accuracy of the stopping position of the electric motor 71, dimensions of components, and assembly, it is possible to adjust the rotation stopping position of the second cam 99 such that the ball is disposed at the center of the recessed portion.

The wiping member (wiper 61) may have one wiping position. In addition, two, four, or more wiping positions at different positions in the direction orthogonal to the nozzle-formed surface 271 may be provided. Further, the wiping position of the wiping member may continuously change in the orthogonal direction orthogonal to the nozzle-formed surface 271.

The embodiment is not limited to the configuration in which the plurality of wiping positions at different positions in the direction orthogonal to the nozzle-formed surface 271 are gradually raised continuously from the retreat position Ws toward the wiping position W1 of the wiper 61, the embodiment may employ a configuration in which the positions are gradually lowered or change irregularly.

The liquid ejecting head 27 may be moved in the direction orthogonal to the nozzle-formed surface 271 from a position during printing such that the overlap amount ΔR of the wiping member (wiper 61) may be adjusted. In this case, even when one wiping position of the wiping member is provided, for example, it is possible to wipe the nozzle-formed surface 271 by an appropriate overlap amount ΔR.

A configuration may be employed, in which the locking portion provided on the rack member 64 is a step portion, and the locking target portion provided on the slide member 66 has an inclined surface that ascents over the step portion. Conversely, the step portion is provided on the slide member, and the locking target portion having the inclined surface may be provided on the rack member.

One recessed portion of the first recessed portion and the second recessed portion may be omitted. In short, in a case where there are provided a plurality of rotation stopping positions of the first cam 91 that is capable of disposing the cap 51 at the uncapping position, the recessed portion may be provided in at least one of the plurality of locking target parts in which the first cam 91 engages with the cam follower at the plurality of rotation stopping positions.

The lifting/lowering mechanism 56 of the cap 51 may be a rack and pinion type moving mechanism that lifts and lowers the cap holder 52.

The wiping member (wiper 61) may be configured to be movable in the width direction X or the transport direction Y, and the wiping member may move in a direction along the nozzle-formed surface 271 so as to wipe the nozzle-formed surface 271. For example, a configuration may be employed, in which the base unit 40 of the maintenance device 36 is placed on a rail such that the entire device is movable by the drive of the drive source, and the drive of the maintenance device 36 causes the wiping member to wipe the nozzle-formed surface 271 of the liquid ejecting head 27 that is on standby at a predetermined wiping performing position. In addition, a configuration may be employed, in which the drive of the drive source causes the entirety of or a part of the wiper moving mechanism 62 to move, and thereby the wiping member wipes the nozzle-formed surface 271 of the liquid ejecting head 27 that is on standby at the predetermined wiping performing portion.

The liquid ejecting apparatus 11 is not limited to the serial printer and may be a lateral printer in which the carriage 26 is movable in two directions of the width direction X and the transport direction Y.

The liquid ejecting apparatus 11 is not limited to a printing printer. For example, the liquid ejecting apparatus may eject a liquid body obtained by dispersing or mixing particles of an organic material in a liquid. For example, the liquid ejecting apparatus may eject liquid droplets of a liquid body obtained by dispersing metal powder of a wiring material and form an electric wiring pattern on a board as an example of the medium. In addition, the liquid ejecting apparatus may eject a liquid body obtained by dispersing powder of color material (pixel material) on an elongated board that is an example of the medium and manufacture pixels of various types of displays (display boards for a display device) such as a liquid crystal display, an electroluminescence (EL) display, or a field-emission display. Further, the liquid ejecting apparatus may be a liquid ejecting apparatus for three-dimensional forming which ejects an uncured resin droplet and forms a three-dimensional object.

The medium M to which the liquid ejecting apparatus 11 ejects the liquid is not limited to paper and may be a cloth material, a plastic film, a metal film, or the like.

Hereinafter, a technical idea, which is known from the embodiment and the modification examples described above, and operation effects thereof will be described.

Idea 1

There is provided a liquid ejecting apparatus including: a liquid ejecting head provided with a nozzle that is capable of ejecting a liquid; and a cap that is configured to execute capping for forming a first space to which the nozzle is open, in a surrounding manner, when coming into contact with the liquid ejecting head, in which the cap includes a capping member that is provided with a suction hole which is configured to suction a fluid inside the cap and an atmosphere communicating hole which is configured to allow an inside of the cap to communicate with an outside, a liquid absorber that is disposed inside the capping member so as to come into contact with at least a part of an opening of the suction hole and is capable of absorbing the liquid, and a reception member that is disposed at an interval from the liquid absorber inside the capping member so as to form a second space between the liquid absorber and the reception member and is provided with a reception surface which receives the liquid that is discharged from the nozzle, in which the second space is positioned closer to a side of the liquid ejecting head than to the liquid absorber in a posture of capping, and the atmosphere communicating hole is open to the second space.

For example, when the inside of the cap is opened to the atmosphere through the atmosphere communicating hole after the suction cleaning of suctioning the liquid from the nozzle by causing the pressure in the inside of the cap to become the negative pressure, the gas flows swiftly from the atmosphere communicating hole to the inside of the cap. When the gas flows swiftly into the cap through the atmosphere communicating hole, there is a concern that the gas will flow to the nozzle.

In this respect, in the above-described configuration, the second space, to which the atmosphere communicating hole is open, and the first space, to which the nozzle is open, are partitioned by the reception member in the cap. Therefore, the gas flowing through the atmosphere communicating hole is prevented from flowing swiftly to the first space. Consequently, it is possible to reduce the concern that the gas will flow to the nozzle. Hence, it is possible to reduce an occurrence of the defective ejection.

Idea 2

In the liquid ejecting apparatus according to Idea 1, the atmosphere communicating hole is open at a position closer to the liquid absorber than to the reception member in the second space.

In this configuration, the gas flowing to the inside of the cap through the atmosphere communicating hole is further prevented from flowing swiftly to the first space. Consequently, it is possible to reduce the concern that the gas will flow to the nozzle.

Idea 3

In the liquid ejecting apparatus according to Idea 1 or 2, the reception member is provided with a through-hole through which the second space communicates with the first space which is formed closer to the liquid ejecting head than to the reception surface in a posture of capping, and an opening of the through-hole on a side of the second space is provided at a position that is not opposite to an opening of the atmosphere communicating hole.

In this manner, the distance from the through-hole to the atmosphere communicating hole more increases in the second space, compared to a case where the opening of the through-hole on the side of the second space is opposite to the opening of the atmosphere communicating hole. Therefore, the gas flowing to the inside of the cap through the atmosphere communicating hole is prevented from passing swiftly through the through-hole. Consequently, it is possible to reduce the concern that the gas will flow to the nozzle.

Idea 4

In the liquid ejecting apparatus according to Idea 3, an opening of the through-hole on a side of the first space is provided at a position that is not opposite to the nozzle during capping.

In this manner, the distance from the through-hole to the nozzle more increases in the first space, compared to a case where the opening of the through-hole on the side of the first space is opposite to the nozzle. Therefore, it is possible to reduce the concern that the gas flowing into the first space through the through-hole will flow to the nozzle.

Idea 5

The liquid ejecting apparatus according to Idea 3 or 4], the opening of the through-hole on the side of the second space is provided at a position that is more separated from the opening of the atmosphere communicating hole than from the opening of the suction hole.

In this manner, the distance from the atmosphere communicating hole to the through-hole more increases in the second space, compared to a case where the opening of the through-hole on the side of the second space is closer to the opening of the atmosphere communicating hole than to the opening of the suction hole. In other words, since the through-hole and the atmosphere communicating hole are disposed to be separated from each other in the second space, the gas flowing to the inside of the cap is prevented from flowing swiftly to the first space. Consequently, it is possible to reduce the concern that the gas will flow to the nozzle.

Idea 6

In the liquid ejecting apparatus according to any one of Ideas 3 to 5, the reception member is configured to absorb the liquid, the cap is provided with a regulation member that regulates the reception member from being detached from the capping member and a fixing column for fixing the regulation member to the capping member, and the fixing column penetrates the reception member through the through-hole.

In this configuration, the through-hole can also serve as a hole through which the fixing column penetrates the reception member. Consequently, since there is no need to provide another hole in addition to the through-hole in the reception member, it is possible to simplify a configuration of the reception member.

Idea 7

In the liquid ejecting apparatus according to Idea 6, the regulation member has a cover portion that covers the opening of the atmosphere communicating hole at a position that overlaps the opening of the atmosphere communicating hole in a case where the cap is viewed from a side of the reception surface.

Since the gas flowing into the cap through the atmosphere communicating hole is received by the cover portion, it is possible to reduce the concern that the gas will flow to the nozzle.

Idea 8

In the liquid ejecting apparatus according to any one of Ideas 1 to 7, the reception member is configured to absorb the liquid, the cap has a space forming member that forms the second space, and the space forming member has a suppressing portion that is positioned closer to a side of the reception member than to the opening of the atmosphere communicating hole and suppresses a flow of a fluid from the opening of the atmosphere communicating hole toward the reception member.

Since the gas flowing into the cap through the atmosphere communicating hole is received by the suppressing portion, it is possible to reduce the concern that the gas will flow to the nozzle.

Idea 9

There is provided a cap that is configured to come into contact with a liquid ejecting head provided with a nozzle that is capable of ejecting a liquid and to execute capping for forming a first space to which a nozzle is open, in a surrounding manner, the cap including: a capping member that is provided with a suction hole which is configured to suction a fluid inside the cap and an atmosphere communicating hole which is configured to allow an inside of the cap to communicate with an outside, a liquid absorber that is disposed inside the capping member so as to come into contact with at least a part of an opening of the suction hole and is capable of absorbing the liquid, and a reception member that is disposed at an interval from the liquid absorber inside the capping member so as to form a second space between the liquid absorber and the reception member and is provided with a reception surface which receives the liquid that is discharged from the nozzle, in which the second space is positioned closer to a side of the liquid ejecting head than to the liquid absorber in a posture of capping, and the atmosphere communicating hole is open to the second space.

According to this configuration, it is possible to obtain the same effect as those of the above described liquid ejecting apparatus.

The entire disclosure of Japanese Patent Application No. 2017-234898, filed Dec. 7, 2017, is expressly incorporated by reference herein.

What is claimed is:

1. A liquid ejecting apparatus comprising:

a liquid ejecting head provided with a nozzle that is capable of ejecting a liquid; and a cap that is configured to execute capping for forming a first space to which the nozzle is open, in a surrounding manner, when coming into contact with the liquid ejecting head, wherein the cap includes a capping member that is provided with an accommodation portion configured to form the first space during the capping, an atmosphere communicating hole which is configured to allow the accommodation portion to communicate with an outside, and a suction hole which is separate from the atmosphere communicating hole and is configured to suction a fluid in the accommodation portion, the suction hole being configured to suction a fluid in the accommodation portion during the capping and in a state where the accommodation portion communicates with atmosphere by the atmosphere communicating hole, a liquid absorber that is disposed in the accommodation portion so as to come into contact with at least a part of an opening of the suction hole and is configured to absorb the liquid, and a reception member that is disposed in the accommodation portion at an interval from the liquid absorber so as to form a second space between the liquid absorber and the reception member and is provided with a reception surface which receives the liquid that is discharged from the nozzle, wherein the second space is positioned closer to the liquid ejecting head than the liquid absorber in a posture of the capping, and wherein the atmosphere communicating hole is open to the second space.

2. The liquid ejecting apparatus according to claim 1, wherein the atmosphere communicating hole is open at a position closer to the liquid absorber than to the reception member in the second space.

3. The liquid ejecting apparatus according to claim 1, wherein the reception member is provided with a through-hole through which the second space communicates with the first space which is formed closer to the liquid ejecting head than the reception surface in a posture of the capping, and wherein an opening of the through-hole on a side of the second space is provided at a position that is not opposite to an opening of the atmosphere communicating hole.

4. The liquid ejecting apparatus according to claim 3, wherein an opening of the through-hole on a side of the first space is provided at a position that is not opposite to the nozzle during the capping.

5. The liquid ejecting apparatus according to claim 3, wherein the opening of the through-hole on the side of the second space is provided at a position that is more separated from the opening of the atmosphere communicating hole than from the opening of the suction hole.

6. The liquid ejecting apparatus according to claim 3, wherein the reception member is configured to absorb the liquid, wherein the cap is provided with a regulation member that regulates the reception member from being detached from the capping member and a fixing column for fixing the regulation member to the capping member, and wherein the fixing column penetrates the reception member through the through-hole.

7. The liquid ejecting apparatus according to claim 6, wherein the regulation member has a cover portion that covers the opening of the atmosphere communicating hole at a position that overlaps the opening of the atmosphere communicating hole in a case where the cap is viewed from a side of the reception surface.

8. The liquid ejecting apparatus according to claim 1, wherein the reception member is configured to absorb the liquid, wherein the cap has a space forming member that forms the second space, and wherein the space forming member has a suppressing portion that is positioned closer to a side of the reception member than the opening of the atmosphere communicating hole and suppresses a flow of a fluid from the opening of the atmosphere communicating hole toward the reception member.

9. A cap that is configured to come into contact with a liquid ejecting head provided with a nozzle that is capable of ejecting a liquid and to execute capping for forming a first space to which a nozzle is open, in a surrounding manner, the cap comprising:

a capping member that is provided with an accommodation portion configured to form the first space during the capping, an atmosphere communicating hole which is configured to allow the accommodation portion to communicate with an outside, and a suction hole which is separate from the atmosphere communicating hole and is configured to suction a fluid in the accommodation portion, the suction hole being configured to suction a fluid in the accommodation portion in a state where the accommodation portion communicates with atmosphere by the atmosphere communicating hole, a liquid absorber that is disposed in the accommodation portion so as to come into contact with at least a part of an opening of the suction hole and is configured to absorb the liquid, and a reception member that is disposed in the accommodation portion at an interval from the liquid absorber so as to form a second space between the liquid absorber and the reception member and is provided with a reception surface which receives the liquid that is discharged from the nozzle, wherein the second space is positioned closer to the liquid ejecting head than to the liquid absorber in a posture of the capping, and wherein the atmosphere communicating hole is open to the second space.

* * * * *